US006096468A

United States Patent [19]

Ohno et al.

[11] Patent Number: 6,096,468

[45] Date of Patent: Aug. 1, 2000

[54] TONER, TONER PRODUCTION PROCESS, AND IMAGE FORMING METHOD

[75] Inventors: Manabu Ohno, Numazu; Satoshi Handa, Shizuoka-ken; Akira Hashimoto, Numazu; Keiji Komoto, Numazu; Yasukazu Ayaki, Numazu, all of Japan

[73] Assignee: Canon Kabushiki Kaisha, Tokyo, Japan

[21] Appl. No.: 09/325,711

[22] Filed: May 4, 1999

[30] Foreign Application Priority Data

| | | | |
|---|---|---|---|
| Jun. 5, 1998 | [JP] | Japan | 10-156999 |
| Apr. 27, 1999 | [JP] | Japan | 11-118931 |

[51] Int. Cl.[7] ..... G03G 9/097; G03G 13/22

[52] U.S. Cl. ..... 430/110; 430/111; 430/124; 430/126; 430/137

[58] Field of Search ..... 430/110, 111, 430/124, 126, 137

[56] References Cited

U.S. PATENT DOCUMENTS

| | | | |
|---|---|---|---|
| 5,300,387 | 4/1994 | Ong | 430/110 |
| 5,738,966 | 4/1998 | Okuno et al. | 430/110 |
| 5,776,647 | 7/1998 | Kido et al. | 430/110 |
| 5,863,692 | 1/1999 | Nakamura et al. | 430/137 |
| 5,948,582 | 9/1999 | Nakamura et al. | 430/111 |
| 5,948,584 | 9/1999 | Hashimoto et al. | 430/110 |

FOREIGN PATENT DOCUMENTS

| | | |
|---|---|---|
| 0658816 | 6/1995 | European Pat. Off. . |
| 0791861 | 8/1997 | European Pat. Off. . |
| 36-10231 | 7/1961 | Japan . |
| 56-13945 | 4/1981 | Japan . |
| 59-53856 | 3/1984 | Japan . |
| 59-61842 | 4/1984 | Japan . |
| 2-221967 | 9/1990 | Japan . |
| 3-39973 | 2/1991 | Japan . |
| 5-61257 | 3/1993 | Japan . |
| 5-72812 | 3/1993 | Japan . |
| 5-165257 | 7/1993 | Japan . |
| 6-301240 | 10/1994 | Japan . |
| 10-90946 | 4/1998 | Japan . |
| 10-312089 | 11/1998 | Japan . |

OTHER PUBLICATIONS

Patent Abstracts of Japan, vol. 18, No. 21 (P–1674); 194 for J.P. 05–257324.

Patent Abstracts of Japan, vol. 15, No. 511 (P–1292), Dec. 1991, for JP 03–221967.

Patent Abstracts of Japan, vol. 98, No. 3, Feb. 1998 for JP 09–288383.

*Primary Examiner*—Roland Martin

*Attorney, Agent, or Firm*—Fitzpatrick, Cella, Harper & Scinto

[57] ABSTRACT

A toner for use in development of electrostatic latent images is disclosed. The toner has toner particles containing a binder resin, a colorant, a wax and a compound of Formula (A):

(A)

wherein $R_1$ and $R_4$ each represent a substituted or unsubstituted aromatic group, inclusive of a condensed ring; $R_2$ and $R_3$ each represent a hydrogen atom, an alkyl group, a substituted or unsubstituted aromatic group, inclusive of a condensed ring; M represents an element selected from B, Ti, Fe, Co, Cr, Al and Ni; and $X^{n+}$ represents a cation. The toner has the shape factors SF-1 and SF-2 with the specified range. Further, disclosed are a process for producing the toner and an image forming method using the toner.

66 Claims, 10 Drawing Sheets

TONER, TONER PRODUCTION PROCESS, AND IMAGE FORMING METHOD

BACKGROUND OF THE INVENTION

1. Field of the invention

This invention relates to a toner and an image forming method which are used in recording processes such as electrophotography, electrostatic recording, magnetic recording and toner-jet recording. More particularly, the present invention relates to a toner and an image forming method which are used in copying machines, printers and facsimile machines in which toner images are previously formed on an electrostatic latent image bearing member and thereafter transferred onto transfer mediums to form images. The present invention also provides a process for producing the toner.

2. Related Background Art

A number of methods are known as electrophotography. In general, final images are obtained by forming an electrostatic latent image on a photosensitive member by utilizing a photoconductive material and by various means, subsequently developing the latent image by the use of a toner to form a toner image as a visible image, transferring the toner image to a transfer medium, and then fixing to the transfer medium the toner image formed thereon, by heating and/or pressing.

As methods by which the electrostatic latent image is formed into a visible image, developing methods such as cascade development, magnetic brush development and pressure development are known in the art. Another method is also known in which, using a magnetic toner and using a rotary sleeve provided with a magnet at the core, the magnetic toner is caused to fly across the sleeve and a photosensitive member by the aid of an electric field.

One-component development systems require no carrier such as glass beads or iron powder required in two-component development systems, and hence can make developing assemblies themselves small-sized and light-weight. Also, since in the two-component development systems the concentration of toner in carrier must be kept constant, a device for detecting toner concentration so as to supply the toner in the desired quantity is required, resulting in a large size and weight for the developing assemblies. In the one-component development system, such a device is not required, and hence the developing assemblies can also be made small and light as being preferable.

As printers, LED printers or LBP printers are prevailing in the recent market. As a trend of techniques, there is a tendency toward higher resolution. More specifically, those which hitherto have a resolution of 300 or 600 dpi are being replaced by those having a resolution of 1,200 or 2,400 dpi. accordingly, with such a trend, the developing systems are now required to achieve a high minuteness. Copying machines have also progressed to have higher functions, and hence they trend toward digital systems. In this trend, chiefly employed is a method in which electrostatic latent images are formed by using a laser. Hence, the copying machines also trend toward a high resolution and, like the printers, it has been sought to provide a developing system with higher resolution and higher minuteness.

Accordingly, in order to meet such a demand, a specific charge control agent is added so that the desired triboelectric chargeability can be imparted to toner particles. Charge control agents nowadays known in the present technical field include, as those for controlling negative triboelectric chargeability, metal complex salts of monoazo dyes, metal complex salts of hydroxycarboxylic acids, dicarboxylic acids and aromatic diols, and resins containing acid components. As those for controlling positive triboelectric chargeability, they are known to include nigrosine dyes, azine dyes, triphenylmethane dyes, quaternary ammonium salts, and polymers having quaternary ammonium salts in the side chains.

Proposals have ever been made in regard to toners containing metal compounds of oxycarboxylic acids. For example, Japanese Patent Application Laid-Open No. 2-221967 discloses a toner containing a metal complex salt of an oxycarboxylic acid having an aromatic ring. Japanese Patent Application Laid-Open No. 5-61257 discloses a toner comprising a toner precursor in which a boron compound of an oxycarboxylic acid has been embedded. Japanese Patent Application Laid-Open Nos. 3-39973 and 5-72812 discloses a toner containing a boron complex salt of benzilic acid. Japanese Patent Application Laid-Open No. 5-165257 discloses a color toner containing a boron complex salt of benzilic acid and an inorganic fine powder subjected to hydrophobic-treatment with silicone oil. Japanese Patent Application Laid-Open No. 6-301240 discloses a color toner containing a benzilic acid metal complex salt having an amide as a counter ion. These toners were improved in their charging rate to a certain extent. However, these have such disadvantages that a sufficient quantity of triboelectricity cannot be imparted to the toner.

In order to eliminate such a problem, Japanese Patent Application Laid-Open No. 10-90946 discloses a toner comprising toner particles in which a charge control agent such as a boron complex salt of benzilic acid has been added and fixed without being dried. Japanese Patent Application Laid-Open No. 10-312089 also discloses a toner using a boron complex salt of benzilic acid and a metal salt of a salicylic acid derivative in combination. According to studies of the present inventors, these toner can achieve an improvement in the quantity of triboelectricity and the charging rate to a certain extent. However, in the former case a complicated production process is required, and in the latter case the use of a boron complex salt of benzilic acid and a metal salt of a salicylic acid derivative in combination results in inclusion of charge control agents presenting different triboelectric series. Thus, there has been room for further improvement in regard to triboelectric charge quantity distribution. Also, in the above toners, further reseaches have been required for matching themselves to image forming apparatus.

SUMMARY OF THE INVENTION

An object of the present invention is to provide a toner and an image forming method which have solved the problems the prior art has had.

More specifically, an object of the present invention is to provide a toner and an image forming method which are superior in transfer performance and less in transfer residual toner.

Another object of the present invention is to provide a toner and an image forming method which do not adversely affect the photosensitive member or intermediate transfer member, may less cause image deterioration such as fog and are highly applicable to electrophotographic processes.

Still another object of the present invention is to provide a toner and an image forming method which are used for an electrostatic latent image bearing member having good releasability and slip properties, retaining such functions over a long period of time and less undergoing photosensitive member scrape even after printing many sheets to enjoy a long service life.

A further object of the present invention is to provide a toner and an image forming method which do not cause any abnormal charging or faulty images due to contamination of a member coming into pressure contact with an electrostatic latent image bearing member, or can restrain such a phenomenon from occurring, and are well matchable to image forming apparatus.

A still further object of the present invention is to provide a toner and an image forming method in which the performance of uniformly coating toner on a toner carrying member is enhanced.

To achieve the above objects, the present invention provides a toner comprising toner particles containing at least a binder resin, a wax and a compound represented by Formula (A);

the toner having shape factors SF-1 and SF-2 with a value of 100<SF-1≦160 and a value of 100 <SF-2≦140.

Formula (A)

(A)

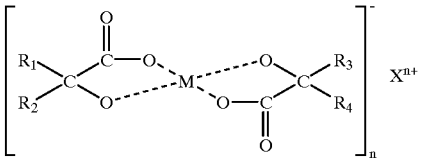

wherein $R_1$ and $R_4$ each represent a substituted or unsubstituted aromatic group, inclusive of a condensed ring; $R_2$ and $R_3$ each represent a hydrogen atom, an alkyl group, a substituted or unsubstituted aromatic group, inclusive of a condensed ring; M represents an element selected from B, Ti, Fe, Co, Cr, Al and Ni; and $X^{n+}$ represents a cation.

The present invention also provides a process for producing a toner, comprising;

a granulation step of dispersing in an aqueous medium a polymerizable monomer composition containing at least a polymerizable monomer, a colorant, a wax, a polymerization initiator and a compound represented by Formula (A), to form particles of the polymerizable monomer composition; and a polymerization step of polymerizing the polymerizable monomer present in the particles of the polymerizable monomer composition to form toner particles;

the polymerization reaction of the polymerizable monomer from the granulation step to the polymerization step being carried out while keeping the pH of the aqueous medium at 4.5 to 8.5, until the polymerization conversion of the polymerizable monomer comes to be 10% or more; and the toner having shape factors SF-1 and SF-2 with a value of 100<SF-1≦160 and a value of 100<SF-2≦140.

Formula (A)

(A)

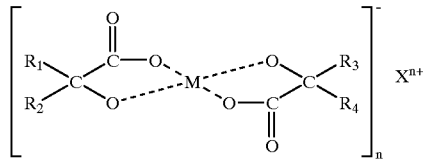

wherein $R_1$ and $R_4$ each represent a substituted or unsubstituted aromatic group, inclusive of a condensed ring; $R_2$ and $R_3$ each represent a hydrogen atom, an alkyl group, a substituted or unsubstituted aromatic group, inclusive of a condensed ring; M represents an element selected from B, Ti, Fe, Co, Cr, Al and Ni; and $X^{n+}$ represents a cation.

The present invention still also provides an image forming method comprising;

a charging step of applying a voltage to a charging member from the outside to charge an electrostatic latent image bearing member;

a latent image forming step of forming an electrostatic latent image on the electrostatic latent image bearing member thus charged;

a developing step of developing the electrostatic latent image by the use of a toner to from a toner image on the electrostatic latent image bearing member;

a transfer step of transferring the toner image formed on the electrostatic latent image bearing member, to a transfer medium with or without intervention of an intermediate transfer member; and a fixing step of heat-fixing the toner image transferred to the transfer medium;

wherein the toner comprises toner particles containing at least a binder resin, a wax and a compound represented by Formula (A); and the toner has shape factors SF-1 and SF-2 with a value of 100<SF-1≦160 and a value of 100<SF-2≦140.

Formula (A)

(A)

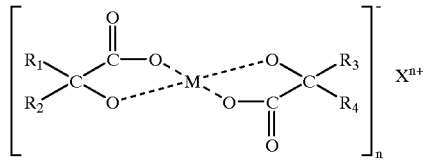

wherein $R_1$ and $R_4$ each represent a substituted or unsubstituted aromatic group, inclusive of a condensed ring; $R_2$ and $R_3$ each represent a hydrogen atom, an alkyl group, a substituted or unsubstituted aromatic group, inclusive of a condensed ring; M represents an element selected from B, Ti, Fe, Co, Cr, Al and Ni; and $X^{n+}$ represents a cation.

DESCRIPTION OF THE PREFERRED EMBODIMENTS

Figure 1:
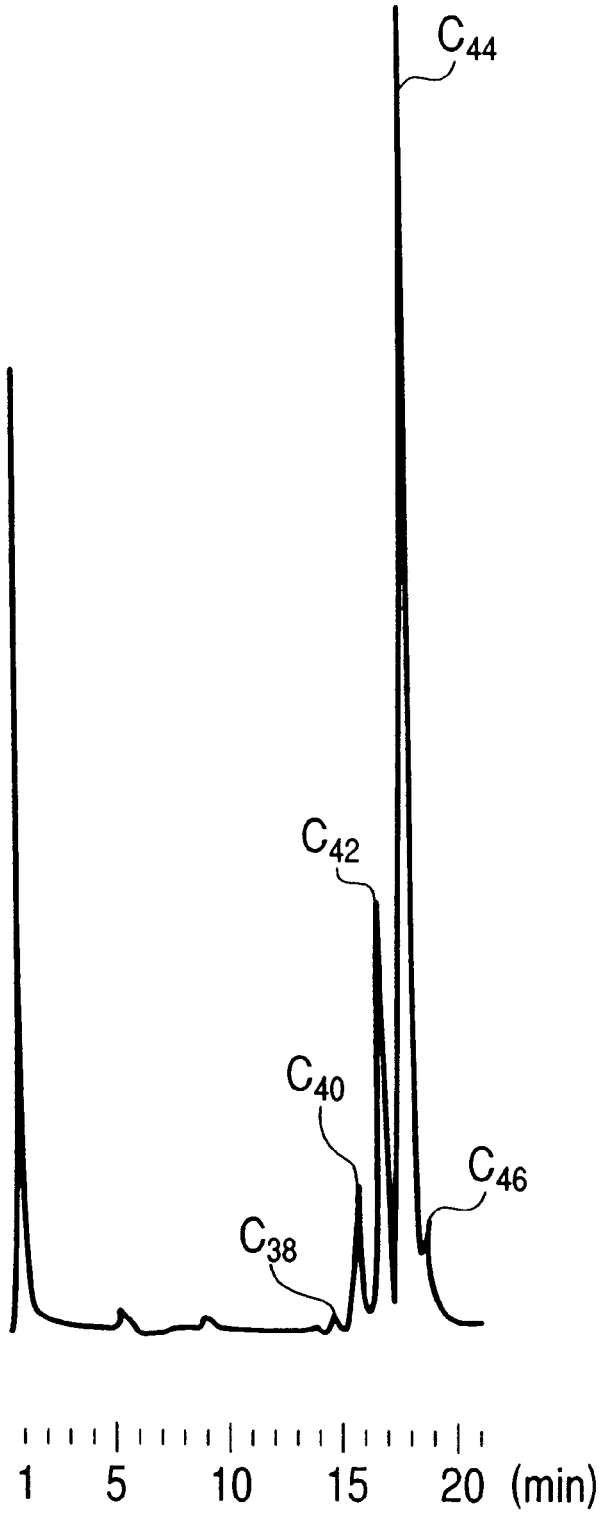
FIG. 1 shows an example of a gas chromatogram of an ester wax.

The toner of the present invention contains at least a binder resin, a wax and, as a charge control agent, a compound represented by Formula (A).

The compound represented by Formula (A) will be described below in detail.

Formula (A)

(A)

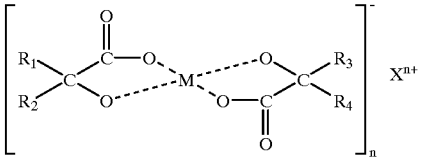

In the formula, $R_1$ and $R_4$ each represent a substituted or unsubstituted aromatic group, inclusive of a condensed ring; $R_2$ and $R_3$ each represent a hydrogen atom, an alkyl group, a substituted or unsubstituted aromatic group, inclusive of a condensed ring; M represents an element selected from B, Ti, Fe, Co, Cr, Al and Ni; and $X^{n+}$ represents a cation.

Stated specifically, the aromatic groups represented by $R_1$, $R_2$, $R_3$ and $R_4$ may include benzene and naphthalene. The substituents of the aromatic groups may include an alkyl group, an aralkyl group, an alkoxyl group, an alkenyl group, an aryl group, a halogen atom, a nitro group, a cyano group, an amino group and a hydroxyl group. The alkyl groups represented by $R_2$ and $R_3$ may include a methyl group, an ethyl group, a n-butyl group, a t-butyl group, an isopropyl group, an isoamyl group, a n-dodecyl group, a n-octadecyl group and a cyclohexyl group. The element represented by M may preferably include trivalent metals Cr, Al, Fe, Co, Ti and B. As the $X^{n+}$, various inorganic cations and organic cations may be used. The inorganic cations may include hydrogen ions and metal ions, and the metal ions may include monovalent or divalent metal ions such as $Li^+$, $Na^+$, $Mg^{2+}$, $Ca^{2+}$, $Zn^{2+}$ and $Ba^{2+}$. The organic cations may include ammonium ions, iminium ions and phosphonium ions.

Of the cations $X^{n+}$ exemplified above, inorganic cations are preferred in view of charging rate and charging stability.

Of the above organic cations, preferred are those represented by the following Formulas (B), (C), (D) and (E).

(B)

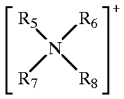

(C)

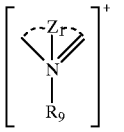

(D)

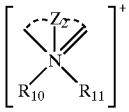

(E)

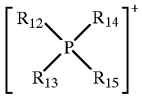

In the formulas, $R_5$ to $R_{15}$ each represent a hydrogen atom, a substituted or unsubstituted alkyl group or a substituted or unsubstituted aryl group, and $Z_1$ and $Z_2$ in Formulas (B), (C) and (D) each represent a non-metallic atomic group which combines with the nitrogen atom of the cation of each Formula to form a 5-membered ring or a 6-membered ring.

The alkyl group may include a methyl group, an ethyl group, an n-butyl group, a t-butyl group, an isopropyl group, an isoamyl group, an n-dodecyl group, an n-octadecyl group and a cyclohexyl group. The aryl group may include a phenyl group and an a-naphthyl group, and these alkyl groups may be substituted with a substituent such as an alkyl group, an aralkyl group, a halogen atom, an alkoxyl group, a hydroxyl group, a cyano group or an aryl group. The groups $Z_1$ and $Z_2$ may include non-metallic atomic groups necessary to form heterocyclic rings such as a pyridine ring, an isoquinoline ring, a pyrrole ring, an imidazole ring, a piperidine ring and a pyrrolidine ring.

Examples of the compound represented by Formula (A) are shown in Tables 1 and 2 below. In the following, the compound number (No.) is also used in common in Examples.

The compound represented by Formula (A), which is used as a charge control agent in the present invention, is readily obtained by, e.g., adding a compound represented by Formula (F) or (G) [wherein $R_1$ to $R_4$ are as defined in Formula (A)] in an aqueous solution of boric acid and an amine to carry out reaction.

(F)

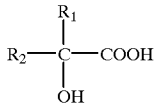

(G)

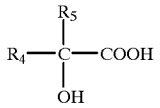

When the toner is produced by polymerization, the compound represented by Formula (A) may be added in an amount of from 0.1 to 10 parts by weight, and preferably from 0.6 to 5 parts by weight, based on 100 parts by weight of the polymerizable monomer.

The compound represented by Formula (A), added in the toner components may usually be in an amount of from 0.1 to 10 parts by weight, and preferably from 0.6 to 5 parts by weight, based on 100 parts by weight of the polymerizable monomer.

Addition of the Formula (A) compound in the toner components in an amount less than 0.1 part by weight is not preferable because the effect of charging toner particles can not be obtained. Addition of the Formula (A) compound in an amount more than 10 parts by weight results in a high cost and is not preferable from an economical viewpoint.

The toner of the present invention has specific shape factors SF-1 and SF-2.

In the present invention, the SF-1 and SF-2 each indicating the shape coefficient of the toner are values obtained by sampling at random 100 images of 2 $\mu$m or larger toner particle as magnified 1,000 times with, e.g., FE-SEM (S-800; a scanning electron microscope manufactured by Hitachi Ltd.), introducing their image information into an image analyzer (e.g., LUSEX III; manufactured by Nikore Co.) through an interface to make analysis, and calculating the data according to the following expression. The values thus obtained are defined as shape coefficient SF-1, SF-2.

$$SF\text{-}1=(MXLNG)^2/AREA\times\pi/4\times100$$

$$SF\text{-}2=(PERIME)^2/AREA\times1/4\pi\times100$$

wherein MXLNG represents an absolute maximum length of a particle; PERIME represents a peripheral length of the particle; and AREA represents a projected area of the particle.

When the shape factors of toner particles are measured by the above method after any external additive has been added to the toner particles, they are so measured that the external additive having adhered to the toner particle surfaces are not included in the data for image analysis.

The shape factor SF-1 of toner indicates the degree of sphericity of a particle, and the shape factor SF-2 indicates the degree of unevenness of the particle.

If the shape factor ratio of the toner SF-2)/(SF-1) is in a value more than 1.0, faulty leaning tends to occur in usual instances. If the shape factor SF-1 is more than 160, the particle becomes less spherical, and more amorphous (shapeless), so that the toner particles tend to be pulverized in the developing assembly and to cause variations of particle size distribution or result in a broad charge quantity distribution. A shape factor SF-2 of more than 140 is not preferable because the toner image may be transferred in a low transfer efficiency when transferred from the photosensitive member to the intermediate transfer member and also to the transfer medium and blank areas may be caused by poor transfer in character or line images.

The tendencies as stated above may be remarkable especially when a full-color copying machine in which a plurality of toner images are developed and transferred is used. More specifically, when a full-color image is formed, the four color toner images are hard to uniformly transfer, and also, when the intermediate transfer member is used, a problem is liable to occur in respect of color uniformity and color balance, and it is hard to stably reproduce high-quality full-color images.

In addition, when a usual amorphous toner is used, melt-adhesion or filming of toner may occur on the photosensitive member surface or intermediate transfer ember surface because of a shear force or rubbing force acting between the photosensitive member and the cleaning member and/or between the photosensitive member and the intermediate transfer member.

Accordingly, in order to avoid these problems, the toner of the present invention may preferably have shape factors SF-1 and SF-2 with a value of $100<SF\text{-}1\leqq160$ and a value of $100<SF\text{-}2\leqq140$, more preferably shape factors SF-1 and SF-2 with a value of $100<SF\text{-}1\leqq150$ and a value of $100<SF\text{-}2\leqq130$, and still more preferably shape factors SF-1 and SF-2 with a value of $100<SF\text{-}1\leqq140$ and a value of $100<SF\text{-}1\leqq120$. Also, the value of (SF-2)/(SF-1) may preferably be 1.0 or less.

The toner of the present invention can be prevented from melt-adhering to the toner carrying member due to an increase in transfer residual toner or a lowering of developing efficiency, especially when a toner having a good circularity distribution is produced.

In the toner of the present invention, the particle shape of the toner may precisely be so controlled that the toner can have an average circularity of from 0.920 to 0.995 and a circularity standard deviation of less than 0.040 in circularity frequency distribution of the toner as measured with a low type particle image analyzer, whereby the toner an be improved in developing performance and transfer performance in a well balanced state and also can greatly be improved so as to match itself to image forming apparatus.

More specifically, when the toner is made to have an average circularity of from 0.920 to 0.995, preferably from 0.950 to 0.995, and more preferably from 0.970 to 0.990 in its circularity frequency distribution, the toner having a small particle diameter can greatly be improved in transfer performance, which has ever been difficult to do, and also can greatly be improved in the developability for low-potential latent images. Such tendencies are very effectively appear especially when a digital system of minute spot latent images are developed or when toner images are transferred many times through the intermediate transfer member to form a full-color image, bringing about a good compatibility with image forming apparatus.

In the toner of the present invention, it is also possible to arbitrarily control the circularity standard deviation of circularity frequency distribution of the toner. The circularity standard deviation may be controlled to be less than 0.040, preferably less than 0.035, and more preferably from 0.015 to less than 0.035. This can bring about a great improvement in properties relating to developing performance.

A toner having an average circularity less than 0.950 in its circularity frequency distribution may be in a content of 15% by number or less. This brings the development efficiency in image formation to a satisfactory level and also enables good images to be formed.

The average circularity, the circularity standard deviation and the percent by number of the toner having an average circularity less than 0.950 can be controlled by adjusting the pH of an aqueous medium in the step of granulation in suspension polymerization.

The circularity and the frequency distribution thereof referred to in the present invention are used as a simple method for expressing the shape of toner quantitatively. In the present invention, they are measured with a flow type particle image analyzer FPIA-1000, manufactured by Toa Iyou Denshi K.K., and the average circularity is calculated according to the following expression.

Circularity=

$$\text{Circularity} = \frac{\text{Circumferential length of a circle with the same area as particle projected area}}{\text{Circumferential length of particle projected image}}$$

Here, the "particle projected area" is meant to be the area of a binary-coded toner particle image, and the "circumferential length of particle projected image" is defined to be the length of a contour line formed by connecting edge points of the toner particle image.

The circularity referred to in the present invention is an index showing the degree of surface unevenness of toner particles. It is indicated as 1.000 when the toner particles are perfectly spherical. The more complicate the surface shape is, the smaller the value of circularity is.

Average circularity $\bar{c}$ which means an average value of circularity frequency distribution and circularity distribution SDc are calculated from the following expression where the circularity at a partition point i of particle size distribution (a central value) is represented by ci, and the frequency by $f_{ci}$.

Average circularity $$\text{Average circularity } \bar{c} = \sum_{i=1}^{m} (ci \times f_{ci}) \Big/ \sum_{i=1}^{m} (f_{ci})$$

Circularity standard deviation SDc=

$$\text{Circularity standard deviation } SDc = \left\{ \sum_{i=1}^{m} (\bar{c} - ci)^2 \Big/ \sum_{i=1}^{m-1} (f_{ci}) \right\}^{1/2}$$

As a specific measuring method, 10 ml of ion-exchanged water from which impurity solid matter has been removed is put in a container, and as a dispersant a surface-active agent, preferably alkylbenzene sulfonate, is added therein. Thereafter, 0.02 g of a sample to be measured is further added therein, then uniformly dispersed. As a dispersing means, an ultrasonic dispersion machine UH-50 (manufactured by SMT Co.) to which a 5 mm diameter titanium alloy tip is attached as a vibrator is used, and dispersion treatment is carried out for 5 minutes to prepare a dispersion for measurement. Here, the dispersion is appropriately cooled so that its temperature does not exceed 40° C.

The toner shape is measured using the above flow type particle image analyzer. Concentration of the dispersion is again so adjusted that the toner particles are in a concentration of from 3,000 to 10,000 particles/μl at the time of measurement, and 1,000 or more particles are measured. After measurement, the data obtained are used to determine a circle-corresponding diameter and circularity frequency distribution of the toner.

In order to faithfully develop minute latent image dots to make image quality higher, the toner may preferably have a weight-average particle diameter (D4) of from 4 to 9 μm and a coefficient of variation A in number distribution, of 30t or less, and may more preferably have a coefficient of variation A of 25 or less. Also, a toner fine powder having particle diameters of 4.00 μm or smaller in number distribution may preferably be in a content not more than 25% by number, and more preferably not more than 20% by number. Controlling toner particle size distribution in such a manner as described above allows the toner particles to have good powder characteristics. Accordingly, when the compound represented by Formula (A) according to the present invention is added and used in the toner, a very good charging performance can be exhibited. If the toner has a weight-average particle diameter smaller than 4 μm or the toner fine powder is in a content more than 25% by number, its fluidity may lower when toner particles are loaded, and hence it tends to become difficult for the toner to be triboelectrically charged uniformly, causing uneven image density or image fog, or a decrease in image density. Transfer efficiency may also lower, and hence this not only can be a cause of uneven image density, but also may result in an increase in transfer residual toner on the surface of the photosensitive member or intermediate transfer member, undesirably resulting in an increase in a load on the image forming apparatus.

If on the other hand the toner has a weight-average particle diameter larger than 10 μm, the minute latent image dots may no longer faithfully be reproduced.

In the past, the use of toner particles having such a small particle diameter have often caused problems concerning the charging performance of toners. However, when the compound represented by Formula (A) according to the present invention is added in the toner, the toner can be more improved in uniform charging performance and charging stability.

The particle size distribution of the toner may be measured by various methods. In the present invention, it is measured with a Coulter counter Model TA-II or Coulter Multisizer (both manufactured by Coulter Electronics, Inc.) as a measuring device. As an electrolytic solution for measurement, an aqueous 1% by weight NaCl solution of first-grade sodium chloride is prepared and used, or commercially available ISOTON R-II (trade name, manufactured by Coulter Scientific Japan Co.) may be used. Measurement is carried out by adding as a dispersant 0.1 to 5 ml of a surface active agent, preferably an alkylbenzene sulfonate, to 100 to 150 ml of the above electrolytic solution, and further adding 2 to 20 mg of a sample to be measured. Next, the electrolytic solution to which the measuring sample has been added is subjected to dispersion for about 1 minute to about 3 minutes in an ultrasonic dispersion machine. Using an aperture of 100 μm in the above particle size distribution measuring device, the volume and number of toner particles are measured for each channel, and the volume distribution and number distribution of the toner are calculated, and the weight-average particle diameter (D4) of the toner is determined from that volume distribution, and the number-average particle diameter (D1) and standard deviation (S) from that number distribution.

As measuring channels, the following 13 channels are set: 2.00 to less than 2.52 μm, 2.52 to less than 3.17 μm, 3.17 to less than 4.00 μm, 4.00 to less than 5.04 μm, 5.04 to less than 6.35 μm, 6.35 to less than 8.00 μm, 8.00 to less than 10.08 μm, 10.08 to less than 12.70 μm, 12.70 to less than 16.00 μm, 16.00 to less than 20.20 μm, 20.20 to less than 25.40 μm, 25.40 to less than 32.00 μm, and 32.00 to less than 40.30 μm. The middle value of each channel is used as the representative value of each channel for calculating the particle size distribution.

The coefficient of variation A of number distribution of the toner is calculated according to the following expression.

$$\text{Coefficient of variation } A=[S/D1]\times 100$$

wherein S represents a value of standard deviation in the number distribution of toner particles, and D1 represents number-average particle diameter (μm) of the toner particles.

The binder resin used in the toner according to the present invention may preferably have a low-molecular weight peak ranging from 3,000 to 150,000 in GPC molecular weight so that the shape of toner particles produced by pulverization can be controlled by thermomechanical impact force.

If the binder resin has a low-molecular weight peak at more than 150,000, it may be difficult to control the shape factors SF-1 and SF-2 within the range of the present invention, resulting in insufficient improvement of transfer efficiency. If the peak is at less than 3,000, melt-adhesion tends to occur.

Molecular weight is measured by GPC (gel permeation chromatography). As a specific method for measurement by GPC, a sample obtained by beforehand subjecting the toner to extraction with a THF (tetrahydrofuran) solvent for 20 hours by means of a Soxhlet extractor. As column constitution, A-801, A-802, A-803, A-804, A-805, A-806 and A-807, available from Showa Denko K.K., are connected, and the molecular weight distribution is measured using a calibration curve of standard polystyrene resin.

The binder resin used in the toner according to the present invention may preferably have a ratio of weight-average molecular weight (Mw) to number-average molecular weight (Mn), Mw/Mn, of from 2 to 100.

The binder resin used in the toner may preferably have a glass transition point Tg of from 40° C. to 75° C., and more preferably from 52° C. to 70° C., in view of fixing performance and storage stability.

The glass transition point Tg of the binder resin used in the toner according to the present invention is measured by, e.g., using a differential scanning calorimeter of a highly precise, inner-heat input compensation type, such as DSC-7, manufactured by Perkin Elmer Co. It is measured according to ASTM D3418-82. The temperature of a sample is once raised to take a previous history and thereafter dropped rapidly. Then, the temperature is again raised at a temperature rise rate of 10° C./min within the temperature range of 0 to 200° C. The DSC curve thus measured is used in the present invention.

In general, in the toner having the particle size distribution as previously described, the state of charging is uniformed as the particle shape is uniformed, but the quantity of triboelectricity tends to decrease with a decrease in surface area. Since, however, the toner of the present invention contains the compound represented by Formula (A), the changed state of the toner can be improved without lowering the quantity of triboelectricity.

The binder resin used in the present invention may be any of those used in the production of toners and there are no particular limitations. As examples of the binder resin used in the present invention, named are homopolymers of polymerizable monomers shown below, or mixtures of homopolymers of the polymerizable monomers, or copolymers of two or more of the polymerizable monomers. Stated more specifically, styrene-acrylic acid type copolymers or styrene-methacrylic acid type copolymers are preferred.

Styrene type polymerizable monomers may include, e.g., styrene, and styrene derivatives such as o-methylstyrene, m-methylstyrene, p-methylstyrene, p-methoxystyrene, p-phenylstyrene, p-chlorostyrene, 3,4-dichlorostyrene, p-ethylstyrenee, 2,4-dimethylstyrene, p-n-butylstyrene, p-tert-butylstyrene, p-n-hexystyelene, p-n-octylstyrene, p-n-nonylstyrene, p-n-decylstyrene and p-n-dodecylstyrene.

Acrylate type polymerizable monomers may include, e.g., acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate. Methacrylate type polymerizable monomers may include, e.g., α-methylene aliphatic monocarboxylic esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate.

In order to adjust fixing temperature of the toner, the binder resin used in the present invention may preferably contain a cross-linkable polymerizable monomer as exemplified below.

As the cross-linkable polymerizable monomer, a polymerizable monomer having at least two polymerizable double bonds may be used. Specific examples include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether linkage, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether linkage, as exemplified by polyoxyethylene(2)-2,2-bis(4-hydroxyphenyl)propane diacrylate, polyoxyethylene(4)-2,2-bis(4-hydroxyphenyl)propane diacrylate, and the above compounds whose acrylate moiety has been replaced with methacrylate; and also polyester type diacrylate compounds as exemplified by MANDA (trade name; available from Nippon Kayaku Co., Ltd.). Polyfunctional cross-linking agents may include pentaerythritol triacrylate, trimethylolethane triacrylate, trimethylolpropane triacrylate, tetramethylolpropane triacrylate, tetramethylolmethane tetraacrylate, oligoester acrylate, and the above compounds whose acrylate moiety has been replaced with methacrylate; triallylcyanurate, and triallyltrimellitate.

Any of these cross-linkable polymerizable monomers may preferably be used in an amount of 1 part by weight or less based on 100 parts by weight of other polymerizable monomer components, whereby not only low-temperature fixing performance and anti-offset properties can well be satisfied but also the storage stability of toner can be improved.

Of these cross-linkable polymerizable monomers, preferred is the use of aromatic divinyl compounds (in particular, divinylbenzene) and diacrylate compounds linked with a chain containing an aromatic group and an ether linkage, any of which may be used in an amount ranging from 0.001 to 0.05 part by weight based on 100 parts by weight of other polymerizable monomer components. Thus, even when toner particle diameter is made finer, developers can have a stable developing performance in any environment, and also can be improved in running performance.

To obtain the binder resin used in the present invention, it is preferable to use a polymerization initiator as exemplified below.

Stated specifically, usable are organic peroxides such as di-t-butyl peroxide, dicumyl peroxide, benzoyl peroxide, t-butylperoxy-2-ethylhexanoate and t-butylperoxybenzoate; and azo and diazo compounds such as azobisbutyronitrile, diazoaminoazobenzene, 2,2'-azobis-2-methylbutyronitrile, 2,2'-azobis(2-amidinobutane) dihydrochloride, 2,2'-azobis (2,4-dimethylvaleronitrile), and dimethyl-2,2'-azobis(2-methylpropylate)(dimethyl-2,2'-a zobisisobutyrate).

Any of these polymerization initiators may be used alone or in combination, and may be used in an amount of from 0.05 to 20 parts by weight, and more preferably from 0.5 to 10 parts by weight, based on 100 parts by weight of the polymerizable monomers.

In the present invention, the binder resin described above may be used in combination with a resin having a polarity (hereinafter "polar resin") such as polyester resin or polycarbonate resin. The addition of a polar resin in the toner brings about an improves a state of the compound of Formula (A) contained in the toner, and the charging performance can be improved.

For example, when the toner is directly produced by suspension polymerization described later, such a polar resin may be added during polymerization reaction from a dispersion step to a polymerization step, thus, the formation of toner particles can be so controlled that the polar resin added forms thin layers on the surfaces of toner particles or is present in the toner particles with a gradation from their surfaces to cores, in accordance with a balance of the polarity shown by a toner particle-forming polymerizable monomer composition and an aqueous dispersion medium. Here, a polar resin that may interact with the compound represented by Formula (A) may be used, whereby a state of the compound present in the toner can be made into a desirable form. In particular, the presence state of the compound can be easily controlled when a polar resin having an acid value of from 1 to 20 mg KOH/g is used.

The polar resin may preferably be used in an amount of from 1 to 25 parts by weight, and more preferably from 2 to 15 parts by weight, based on 100 parts by weight of the binder resin. When used in an amount less than 1 part by weight, the presence state of the polar resin in the toner may be non-uniform, and when used in an amount more than 25 parts by weight, the thin layers of polar resin formed on the toner particle surfaces may be thicker. Hence, in both instances, it may be difficult to control the presence state of the compound represented by Formula (A), so that the polar resin can not sufficiently exhibit its function.

A typical polyester resin used as the polar resin has the following composition.

An alcohol component of the polyester resin may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following Formula (a) and a diol represented by the following Formula (b):

(a)

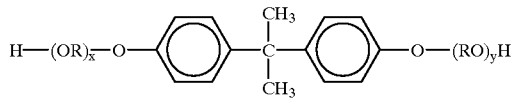

wherein R represents an ethylene group or a propylene group, x and y are each an integer of 1 or more, and an average value of x+y is 2 to 10;

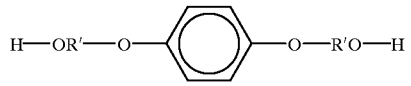

wherein R' represents

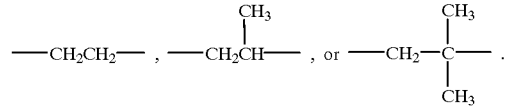

It is a preferred embodiment of the present invention to use a reactive polyester resin or a polycarbonate resin as the polar resin. When such a polar resin is used, the toner can be improved in charging performance, the image fog and spots around line images can be better prevented, and also high-grade images having superior dot reproducibility can be formed. Also, it is possible to impart an appropriate mechanical strength to the toner particles, so that any influence of toner deterioration ascribable to image forming apparatus can be confined to a minimum, bringing about improvements in running performance against printing on a large number of sheets and in the matching to image forming apparatus, as detailed later. Moreover, when the toner particles are treated to be more spherical so that the shape distribution of the toner as described previously can be achieved or when the toner is directly produced by suspension polymerization, any influence from toner production steps such as drying can be confined to a minimum. Also, the polar resin may be used in a combination of two or more kinds, and the chargeability inherent in themselves can be utilized.

The reactive polyester resin used in the present invention includes condensation polymers having a reactive group in the backbone or side chain, which can be obtained by condensation polymerization of a polybasic acid with a polyhydric alcohol; the polybasic acid including terephthalic acid, isophthalic acid, adipic acid, maleic acid, succinic acid, sebacic acid, thiodiglycolic acid, diglycolic acid, malonic acid, glutaric acid, pimelic acid, suberic acid, azelaic acid, comphoric acid, cyclohexanedicarboxylic acid and trimellitic acid; and the polyhydric alcohol including ethylene glycol, diethylene glycol, triethylene glycol, 1,2-propylene glycol, 1,3-propylene glycol, 1,4-butane diol, neopentyl glycol, 1,4-bis(hydroxymethyl)cyclohexane, 1,4-bis(2-hydroxyethyl)benzene, 1,4-cyclohexanedimethanol, polyethylene glycol, polypropylene glycol, bisphenol A, hydrogenated bisphenol, an ethylene oxide addition product of bisphenol A, a propylene oxide addition product of bisphenol A, glycerol, trimethylolpropane and pentaerythritol. The reactive group may be exemplified by carboxylic acid (or a salt thereof), sulfonic acid (or a salt thereof), ethyleneimino acid, an epoxy group, an isocyanate group, a double bond, an acid anhydride and a halogen atom. This reactive polyester resin may be allowed to react with each other, or react with a polyfunctional cross-linking agent (e.g., polyhydric alcohols and polybasic acids), or the reactive polyester resin may further be allowed to react with a vinyl monomer (e.g., esterification or copolymerization) to obtain THF-insoluble matter. For example, when the toner is obtained by polymerization, an unsaturated polyester resin may be used as the reactive polyester, and copolymerized with the vinyl monomer (optionally inclusive of a cross-linking agent such as divinylbenzene). In such a case, the unsaturated polyester resin having a polarity migrates to the vicinity of toner particle surfaces with progress of polymerization to form thin layers on the toner particle surfaces. Thus, it is possible to obtain a toner having especially superior blocking resistance and anti-offset properties.

In the present invention, any resin may be used as the reactive polyester resin so long as it contain one of the reactive groups as described above. However, when having a too low molecular weight, polyester resins not involved in the cross-linking reaction may consequently be present on the toner particle surfaces to cause a lowering of blocking resistance in some cases. On the other hand, when having a too high molecular weight, the reactive polyester resin may be hard to dissolve in the vinyl monomer if the toner is obtained in polymerization method, making the production of toner difficult. Accordingly, the reactive polyester resin may preferably have a weight-average molecular weight of from about 3,000 to about 100,000 in order to obtain a toner having especially superior performances.

As for the polycarbonate resin used the present invention, a polycarbonate resin having in its molecular structure a repeating unit represented by the following Formula (I) may preferably be used.

(I)

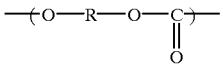

wherein R represents an organic group.

The repeating unit represented by the above Formula (I) includes those having various structures. All known polycarbonates produced by, e.g., allowing divalent phenols to react with carbonate precursors by a solution process or a melting process. For example, it may include polymers having a repeating unit represented by the following Formula (II)

(II)

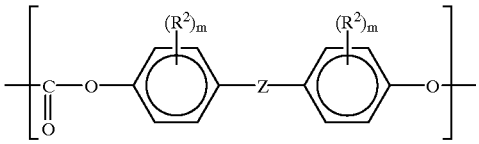

wherein $R_2$ represents a hydrogen atom, an aliphatic hydrocarbon group or an aromatic substituent, m represents an integer of 0 to 4, and when $R_2$ is in plurality, they may be the same or different; and Z represents a linkage represented by a single bond, an aliphatic hydrocarbon group, an aromatic substituent, or —S—, —SO—, —$SO_2$—, —O— or —CO—linkage.

This polycarbonate resin is available from various routes. Usually, it can readily be produced by allowing a divalent phenol represented by any of Formulas (III) to (V):

(III)

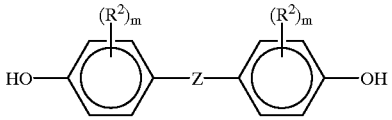

(IV)

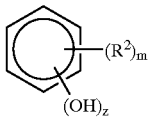

(V)

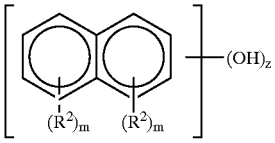

wherein $R_2$, m and Z are as defined above; to react with a carbonate precursor such as phosgene or a carbonate compound. More specifically, it can be produced by, e.g., allowing the divalent phenol to react with a carbonate precursor such as phosgene or subjecting the divalent phenol and a carbonate precursor such as diphenyl carbonate to transesterification, in a solvent such as methylene chloride in the presence of a known acid acceptor or molecular weight modifier.

The divalent phenols represented by the above Formulas (III) to (V) may include various ones, for example, 2,2-bis(4-hydroxyphenyl)propane (commonly called "bisphenol A"), dihydroxyarylalkanes such as bis(4-hydroxyphenyl)methane, bis(4-hydroxyphenyl)phenylmethane, bis(4-hydroxyphenyl)naphthylmethane, bis(4-hydroxyphenyl)-(4-isopropylphenyl)methane, bis(3,5-dimethyl-4-hydroxyphenyl)methane, 1,1-bis(4-hydroxyphenyl)ethane, 1-naphthyl-1,1-bis(4-hydroxyphenyl)ethane, 1-phenyl-1,1-bis(4-hydroxyphenyl)ethane, 1,2-bis(4-hydroxyphenyl)ethane, 2-methyl-1,1-bis(4-hydroxyphenyl)propane, 2,2-bis(3,5-dimethyl-4-hydroxyphenyl)propane, 1-ethyl-1,1-bis(4-hydroxyphenyl)propane, 2,2-bis(3-methyl-4-hydroxyphenyl)propane, 1,1-bis(4-hydroxyphenyl)butane, 2,2-bis(4-hydroxyphenyl)butane, 1,4-bis(4-hydroxyphenyl)butane, 2,2-bis(4-hydroxyphenyl)pentane, 4-methyl-2,2-bis(4-hydroxyphenyl )pentane, 1,1-bis(4-hydroxyphenyl)cyclohexane, 2,2-bis(4-hydroxyphenyl )hexane, 4,4-bis(4-hydroxyphenyl)heptane, 2,2-bis(4-hydroxyphenyl )nonane, 1,10-bis(4-hydroxyphenyl)decane and 1,1-bis(4-hydroxyphenyl)cyclodecane; dihydroxyarylsulfones such as bis(4-hydroxyphenyl)sulfone and bis(3,5-dimethyl-4-hydroxyphenyl)sulfone; dihydroxyaryl ethers such as bis(4-hydroxyphenyl) ether and bis(3,5-dimethyl-4-hydroxyphenyl) ether; dihydroxyaryl ketones such as 4,4'-dihydroxybenzophenone and 3,3',5,5'-tetramethyl-4,4'-dihydroxybenzophenone; dihydroxyaryl sulfides such as bis(4-hydroxyphenyl) sulfide, bis(3-methyl-4-hydroxyphenyl) sulfide and bis(3,5-dimethyl-4-hydroxyphenyl) sulfide; dihydroxyaryl sulfoxides such as bis(4-hydroxyphenyl) sulfoxide; dihyroxydiphenyls such as 4,4'-dihydroxydiphenyl; dihyroxybenzenes such as hydroquinone, resorcinol and methylhydroquinone; and dihyroxynaphthalenes such as 1,5-dihydroxynaphthalene and 2,6-dihydroxynaphthalene. These divalent phenols may be used alone or in combination.

The carbonate compound may include diaryl carbonates such as diphenyl carbonate, and dialkyl carbonates such as dimethyl carbonate and diethyl carbonate.

The polycarbonate resin used in the present invention may be used in the form of a homopolymer making use of one of these divalent phenols, a copolymer making use of two or more of them, or a blend of any of these. It may also be a thermoplastic random-branched polycarbonate resin obtained by allowing a polyfunctional aromatic compound to react with the above divalent phenol and/or carbonate precursor.

In order to control the glass transition temperature or viscoelasticity of the polycarbonate resin, a modified polycarbonate resin may also preferably be used which has such a form that part of the above divalent phenol has been substituted with a polyhydric alcohol such as ethylene glycol, diethylene glycol, triethylene glycol, 1,2-propylene glycol, 1,3-propylene glycol, 1,4-butanediol, neopentyl glycol, 1,4-bis(hydroxymethyl)cyclohexane, 1,4-bis(2-hydroxyethyl)benzene, 1,4-cyclohexanedimethanol, polyethylene glycol, propylene glycol, hydrogenated bisphenol A or a derivative thereof, an ethylene oxide addition product of bisphenol A, a propylene oxide addition product of bisphenol A, glycerol, trimethylolpropane or pentaerythritol. In this instance, it may be produced by simply substituting part of the divalent phenol and by the above process. As another example of the production process, a method may be used in which the divalent phenol is reacted with an aliphatic or aromatic bischloroformate in a methylene chloride solvent using pyridine as a catalyst. Of course, it may be synthesized by any production process other than these.

In the present invention, as the polycarbonate resin, it is also possible to use a block copolymer of the above polycarbonate with a polymer such as polystyrene, styrene-acrylic or methacrylic copolymer, polyester, polyurethane, epoxy resin, polyolefin, polyamide, polysulfone, polycyanoaryl ether or polyarylene sulfide, and a graft-modified copolymer obtained by grafting an alkyl acrylate or methacrylate monomer, an acrylic or methacrylic acid monomer, a maleic acid monomer or a styrene monomer.

There are no particular limitations on the molecular weight of the polycarbonate resin used in the present invention. The polycarbonate resin may preferably be those having a peak molecular weight within the range of from 1,000 to 500,000, and more preferably from 2,000 to 100,000, as measured by GPC. If the peak molecular weight is lower than 1,000, the resin may adversely affect the charging performance, and if it is higher than 500,000, the resin may have so high a melt viscosity as to cause a problem in fixing performance in some cases. Also, when the polycarbonate resin used in the present invention is produced, an appropriate molecular weight modifier, a branching agent for improving viscoelasticity, a catalyst for accelerating reaction and so forth may be used as occasion calls.

The polar resin as described above is by no means limited to one type of polymer for each case. For example, two or more types of reactive polyester resins may simultaneously be used, or two or more types of vinyl monomers may be used. Polymers of quite different types may also optionally be added to the binder resin, as exemplified by polymers such as polyester resins having no reactivity, epoxy resins, polycarbonate resins, polyolefins, polyvinyl acetate, polyvinyl chloride, polyalkyl vinyl ethers, polyalkyl vinyl ketones, polystyrene, polyacrylate or methacrylate, melamine formaldehyde resin, polyethylene terephthalate, nylons and polyurethanes.

As colorants used in the present invention, any of those known in the art may be used. Stated specifically, those given below may be used. Carbon black, aniline black, acetylene black, magnetic materials, and colorants toned in black by the use of yellow, magenta and cyan colorants shown below may be used as black colorants.

As yellow colorants usable in the present invention, compounds typified by condensation azo compounds, isoindolinone compounds, anthraquinone compounds, azo metal complexes, methine compounds and allylamide compounds are used. Stated specifically, e.g., C.I. Pigment Yellow 12, 13, 14, 15, 16, 17, 62, 74, 83, 93, 94, 95, 97, 109, 110, 111, 120, 127, 128, 129, 147, 168, 174, 176, 180, 181 and 191 are preferably used.

As magenta colorants usable in the present invention, condensation azo compounds, diketopyropyyrole compounds, anthraquinone compounds, quinacridone compounds, basic dye lake compounds, naphthol compounds, benzimidazolone compounds, thioindigo compounds and perylene compounds are used. Stated specifically, e.g., C.I. Pigment Red 1, 2, 3, 5, 6, 7, 23, 48:2, 48:3, 48:4, 57:1, 81:1, 144, 146, 166, 169, 177, 184, 185, 202, 206, 220, 221 and 254 are particularly preferably used.

As cyan colorants usable in the present invention, copper phthalocyanine compounds and derivatives thereof, anthraquinone compounds and basic dye lake compounds may be used. Stated specifically, C.I. Pigment Blue 1, 2, 7, 15:1, 15:2, 15:3, 15:4, 60, 62 and 66 are particularly preferred.

These colorants may be used alone, in the form of a mixture, or in the solid solution state. When a magnetic material is used as the colorant, it may preferably be added in an amount of from 40 to 50 parts by weight based on 100 parts by weight of the binder resin. When other colorant is used, it may preferably be added in an amount of from 0.1 to 20 parts, and more preferably from 2 to 10 parts by weight, based on 100 parts by weight of the binder resin.

The toner of the present invention may also be incorporated with a magnetic material so that it can be used as a magnetic toner. In this case, the magnetic material may also serve as the colorant. The magnetic material usable in the present invention may include iron oxides such as magnetite, hematite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

The magnetic material used in the present invention may preferably be a surface-modified magnetic material. It is particularly preferable to use materials having been subjected to hydrophobic treatment with a surface modifier having no polymerization inhibitory action. Such a surface modifier may include, e.g., silane coupling agents and titanium coupling agents.

These magnetic materials may have an average particle diameter of 1 $\mu$m or less, and preferably from 0.1 to 1 $\mu$m. As the magnetic material, it is preferable to use those having a coercive force (Hc) of from 20 to 300 oersted, a saturation magnetization ($\sigma s$) of from 50 to 200 emu/g and a residual magnetization ($\sigma r$) of from 2 to 20 emu/g, as magnetic characteristics under application of 10 K oersted.

Figure 11A:
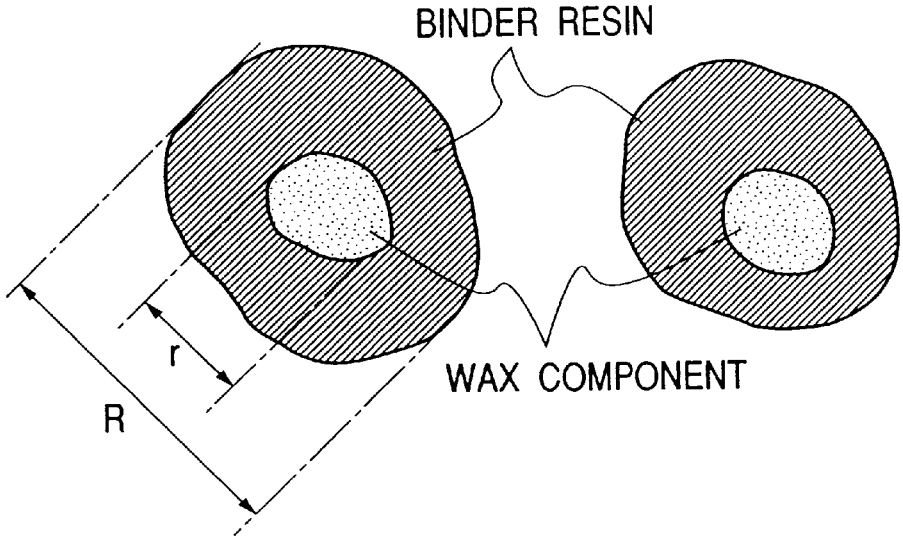
FIGS. 11A and 11B are diagrammatic illustrations of cross sections of toner particles in which a wax is embraced.
Figure 11B:
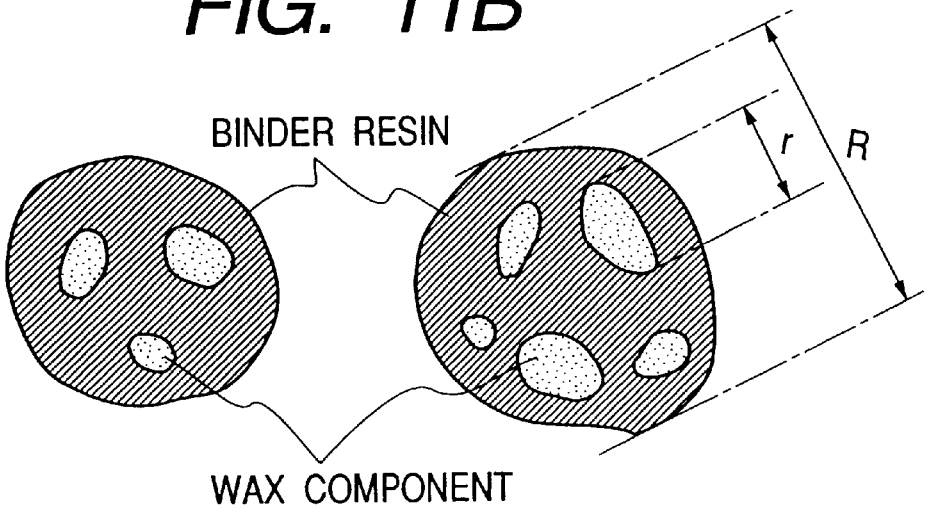

The wax according to the present invention may preferably be, in cross-sectional observation of toner particles with a transmission electron microscope (TEM), dispersed in the binder resin in the form of, substantially, a spherical and/or spindle-shaped island or islands in such a state that the wax and the binder resin are not soluble in each other. Typical examples are shown in FIGS. 11A and 11B.

Since the wax is dispersed in the above manner to be embraced in toner particles, the compound represented by Formula (A) according to the present invention can be allowed to be present in the vicinity of the toner particle surfaces in a good efficiency, and hence the charge controllability inherent in the compound can be well exhibited. Also, the prevention of deterioration of toner and the matching to image forming apparatus can be improved, and hence good charging performance can be maintained, so that toner images having superior dot reproduction can be formed over a long period of time. Moreover, the wax can act in a good efficiency at the time of heat-fixing, and hence satisfactory low-temperature fixing performance and anti-offset properties can be attained.

In the present invention, the state of dispersion of the wax as in the above is defined in the following way: Of toner particles having length of from D4×0.9 to D4×1.1 with respect to a weight-average particle diameter D4 ($\mu$m) of toner as measured in the manner as described previously, twenty (20) planes of cross sections are picked up. Then, a length R of each toner particle cross-sectional plane thus picked up and a length r of the largest island in the phase-separated structure ascribable to the wax present in the toner particle cross-sectional plane having the length R are measured to determine the arithmetic mean value of r/R, $(r/R)_{st}$. When the resultant arithmetic mean value of r/R, $(r/R)_{st}$, satisfies $0.05 \leqq (r/R)_{st} \leqq 0.95$, the wax is regarded as being in the form of, substantially, a spherical and/or spindle-shaped island or islands in such a state that the wax and the binder resin are not soluble in each other.

When the wax is so dispersed that the arithmetic mean value of r/R, $(r/R)_{st}$, satisfies $0.05 \leqq (r/R)_{st} \leqq 0.95$, the compound represented by Formula (A) can be made localized to the toner particle surfaces in a good efficiency, so that the charging performance of toner can be stabilized. Since the wax is embraced in toner particles, the toner particle surfaces can be prevented from deteriorating or the image forming apparatus can be prevented from being contaminated, and thus, the effect of keeping the Formula (A) compound in the vicinity of toner particle surfaces can be maintained. In addition, an instance where the wax is dispersed in such a state that the arithmetic mean value of r/R, $(r/R)_{st}$, satisfies $0.25 \leqq (r/R)_{st} \leqq 0.95$ is preferred because good charging performance can be maintained and toner images having superior dot reproduction can be formed over a long period of time. Since the wax can act in a good efficiency at the time of heat-fixing, satisfactory low-temperature fixing performance and anti-offset properties can be attained.

As a method for the cross-sectional observation of toner particles, it is preferable to use an electron dyeing method in which a contrast is formed between materials by allowing one of the materials to have higher electron density than another by the use of heavy metal, utilizing a difference in the micro-structure of a crystal layer and an amorphous phase between the wax used and the resin constituting the shell. Stated specifically, toner particles are well dispersed in a room-temperature curing epoxy resin, followed by curing in an environment of temperature 40° C. for 2 days, the resulting cured product is electron-dyed with ruthenium tetraoxide ($RuO_4$) and optionally in combination with osmium tetraoxide ($OsO_4$), and thereafter samples are cut into slices by means of an ultra microtome having a diamond cutter, observing the cross-sectional form of toner particles using a transmission electron microscope (TEM).

By the above method, polar resin thin layers present on the toner particle surfaces can also be observed.

As the wax used in the present invention, any known waxes usable in toner may be used, which may include, e.g., paraffin wax and derivatives thereof, montan wax and derivatives thereof, microcrystalline wax and derivatives thereof, Fischer-Tropsch wax and derivatives thereof, polyolefin wax and derivatives thereof, polyester wax and derivatives thereof, ester wax and derivatives thereof, vegetable waxes and derivatives thereof, animal waxes and derivatives thereof, and mineral waxes and derivatives thereof, and petrolactams. The derivatives include oxides, alkylene oxide addition products, saponified products and salts.

In particular, waxes preferably usable are low-molecular weight polyalkylene wax, low-molecular weight polyester wax, ester wax, and aromatic derivatives.

From these waxes, waxes may be fractionated according to the size of molecular weight by press sweating, solvent fractionation, vacuum distillation, ultracritical gas extraction or fractionation recrystallization (e.g., molten liquid crystallization and crystal filtration). Such waxes may also preferably be used in the present invention. After the fractionation, they may be subjected to block copolymerization or graft modification.

For the wax used in the present invention, it is preferred that, in the DSC curve as measured with a differential scanning calorimeter, a maximum endothermic peak at the time of temperature rise is within the region of from 50 to 100° C. and the on-set temperature at the starting point of a endothermic curve including the maximum endothermic peak is 40° C. or above. In particular, it is preferred that the temperature difference between the peak temperature of the maximum endothermic peak and the on-set temperature is within the range of from 5 to 50° C.

When the wax having thermal properties as described above is used, the resulting toner has a good fixing performance as a matter of course, the release effect attributable to the wax is exhibited in a good efficiency, a sufficient fixing region is ensured, and also any bad influence of conventionally known waxes on blocking resistance and image forming apparatus can be eliminated. Hence, the effect attributable to the compound represented by Formula (A) according to the present invention can be well brought out. Especially, since specific surface area of toner particles decreases as the toner particle shape is made spherical, it is very effective to control the thermal properties and dispersion state of the wax.

In the present invention, the thermal properties of the wax is measured according to ASTM D3418-82, using, e.g., a differential scanning calorimeter DSC-7, manufactured by Perkin Elmer Co. The temperature at the detecting portion of the device is corrected on the basis of melting points of indium and zinc, and the calorie is corrected on the basis of the heat fusion of iridium. In the measurement, a sample is put in a pan made of aluminum and an empty pan made of aluminum is set as a control. A DSC curve is used which is obtained when temperature is raised at a temperature rise rate of 10° C./min in the temperature region of from 20° C. to 180° C. Here, when the measurement is made on the wax component alone, the temperature is previously raised-and-dropped once under the same conditions as those at the time of measurement, and measurement is started after the pre-history the wax component has is removed. When the measurement is made on the wax component kept in toner particles, the measurement is made without the operation of removing the pre-history.

The wax may preferably be used in an amount of from 3 to 40 parts by weight, and more preferably from 5 to 35 parts by weight, based on 100 parts by weight of the binder resin.

As the ester wax, ester waxes having ester compounds satisfying the following general formula are preferred.

$$R_1—COO—R_2$$

wherein $R_1$ and $R_2$ each represent a hydrocarbon group having 15 to 45 carbon atoms.

The ester wax may further preferably be an ester wax which contains the ester compounds represented by the above formula and in which ester compounds having the same number of carbon atoms in total are in a content ranging from 50 to 95% by weight.

In the present invention, the content of the ester compounds having the same number of carbon atoms in total are measured by gas chromatography (GC) described below.

In the present invention, a gas chromatogram is obtained by measurement with GC-17A (manufactured by Shimadzu Corporation). In this measurement, a solution previously dissolved in toluene in a concentration of 1% by weight is used as a sample, and 1 $\mu$l of the sample is injected into a GC system having an on-column injector. As a column, Ultra Alloy-1 (HT) 0.5 mm in diameter and 10 mm in length is used. The column is kept at an initial temperature of 40° C., from which the temperature is raised to 200° C. at a rate of 40° C./min, and is further raised to 350° C. at a rate of 15° C./min, and still further raised to 450° C. at a rate of 7° C./min. As a carrier gas, He gas is flowed under a pressure of 50 kPa. When the types of compounds are identified, an alkane having a known number of carbon atoms is injected and the measurement is made in the same flow-out time as the above, identifying their structures by comparing the resulting gas chromatograms with each other or introducing gasified components into mass spectrography. Each content of the ester compounds having the same number of carbon atoms is calculated by determining the ratio of each peak area to the total peak area of chromatograms.

An example of a chromatogram of the ester wax is shown in FIG. 1. As can be seen from FIG. 1, ester compounds as shown below, having 38 carbon atoms in total, are contained in an amount of about 0.6% by weight;

$$CH_3—(CH_2)—_{18}COO—(CH_2)—_{17}CH_3$$

$$CH_2—(CH_2)—_{16}COO—(CH_2)—_{19}CH_3$$

ester compounds as shown below, having 40 carbon atoms in total, are contained in an amount of about 5.8% by weight;

$$CH_3—(CH_2)—_{18}COO—(CH_2)—_{19}CH_3$$

$$CH_3—(CH_2)—_{16}COO—(CH_2)—_{21}CH_3$$

$$CH_3—(CH_2)—_{20}COO—(CH_2)—_{17}CH_3$$

ester compounds as shown below, having 42 carbon atoms in total, are contained in an amount of about 19.0% by weight;

$$CH_3—(CH_2)—_{22}COO—(CH_2)—_{17}CH_3$$

$$CH_3—(CH_2)—_{20}COO—(CH_2)—_{19}CH_3$$

$$CH_3—(CH_2)—_{18}COO—(CH_2)—_{21}CH_3$$

ester compounds as shown below, having 44 carbon atoms in total, are contained in an amount of about 72.9% by weight;

$$CH_3—(CH_2)—_{22}COO—(CH_2)—_{19}CH_3$$

$$CH_3—(CH_2)—_{20}COO—(CH_2)—_{21}CH_3$$

and further, ester compounds as shown below, having 46 carbon atoms in total, are contained in an amount of about 1.7% by weight.

$$CH_2—(CH_2)—_{22}COO—(CH_2)—_{21}CH_3$$

With regard to the ester wax used in the above measurement, it has been ascertained that ester compounds as shown blow, having 44 carbon atoms in total, are contained in an amount of about 72.6% by weight as the main component.

$$CH_3—(CH_2)—_{20}COO—(CH_2)—_{21}CH_3$$

Ester waxes particularly preferably used as the ester wax are commonly synthesized from higher carboxylic acid components as in the case of higher alcohol components. Usually, these higher alcohol components or higher carboxylic acid components are often obtained from natural products, and are commonly constituted of mixtures having an even number of carbon atoms. When such mixtures are esterified as they are, by-products having various analogous structures other than the intended ester compounds are formed, and hence they tend to adversely affect various performances of the toner. Accordingly, in the present invention, it is preferable to use ester waxes obtained by purifying raw materials or products by solvent extraction or vacuum distillation.

In the measurement by the gas chromatography described above, those in which ester compounds having the same number of carbon atoms in total are in a content less than 50% by weight may cause complicated crystal polymorphism or freezing-point depression. Hence, if such ester compounds are incorporated in toner particles, they tend to provide a cause of an ill effect chiefly on the blocking resistance and charge developing performance of the toner. Moreover, if such ester compounds are used in the present invention, a stated fluidity of the toner may be hard to attain, or filming ascribable to ester wax tends to occur on the surfaces of carrier particles and photosensitive member, so that the quantity of triboelectricity of the toner may decrease, making it difficult to attain a sufficient quantity of triboelectricity continually.

As the ester wax, it is preferable to use those in which the ester compounds having the same number of carbon atoms in total may preferably be in a content of from 55 to 95% by weight, and more preferably from 60 to 95% by weight. It is also preferable to use those in which the total content of ester compounds including ester compounds having the same number of carbon atoms in total, contained in the ester wax in the largest quantity, and ester compounds having the number of carbon atoms in total within the range of ±2 with respect to the former number of carbon atoms is preferably from 80 to 95% by weight, and more preferably from 90 to 95% by weight.

When the toner of the present invention is made up, the most preferable ester wax is one in which the ester compounds having 44 carbon atoms in total as stated above are contained in an amount of from about 50 to 95% by weight The ester compounds represented by the above general formula may include the following ester compounds.

| | Total carbon atoms |
|---|---|
| $CH_3-(CH_2)_{16}-COO-(CH_2)_{17}-CH_3$ | 36 |
| $CH_3-(CH_2)_{18}-COO-(CH_2)_{17}-CH_3$ | 38 |
| $CH_3-(CH_2)_{16}-COO-(CH_2)_{19}-CH_3$ | 38 |
| $CH_3-(CH_2)_{18}-COO-(CH_2)_{19}-CH_3$ | 40 |
| $CH_3-(CH_2)_{20}-COO-(CH_2)_{17}-CH_3$ | 40 |
| $CH_3-(CH_2)_{16}-COO-(CH_2)_{21}-CH_3$ | 40 |
| $CH_3-(CH_2)_{22}-COO-(CH_2)_{17}-CH_3$ | 42 |
| $CH_3-(CH_2)_{18}-COO-(CH_2)_{21}-CH_3$ | 42 |
| $CH_3-(CH_2)_{20}-COO-(CH_2)_{19}-CH_3$ | 42 |
| $CH_3-(CH_2)_{22}-COO-(CH_2)_{19}-CH_3$ | 44 |
| $CH_3-(CH_2)_{22}-COO-(CH_2)_{19}-CH_3$ | 44 |
| $CH_3-(CH_2)_{20}-COO-(CH_2)_{21}-CH_3$ | 44 |
| $CH_3-(CH_2)_{22}-COO-(CH_2)_{21}-CH_3$ | 46 |
| $CH_3-(CH_2)_{27}-COO-(CH_2)_{20}-CH_3$ | 50 |
| $CH_3-(CH_2)_{14}-COO-(CH_2)_{43}-CH_3$ | 60 |
| $CH_3-(CH_2)_{43}-COO-(CH_2)_{22}-CH_3$ | 68 |

For the ester wax, it is preferred that the peak temperature of a maximum endothermic peak in the DSC curve is within the region of from 40 to 90° C., and more preferably from 55 to 85° C., in view of the improvement of low-temperature fixing performance and anti-offset properties of the toner.

More specifically, ester waxes in which the peak temperature is lower than 40° C. have so weak a self cohesive force in themselves that they tend to cause a lowering of high-temperature anti-offset properties of the toner. On the other hand, in the case of ester waxes in which the peak temperature is higher than 40° C., having a high melting point, the ester wax having such a high peak temperature may be deposited during granulation because granulation and polymerization are well carried out in an aqueous medium when toner particles are directly obtained by polymerization, tending to make it difficult to carry out granulation in a sharp particle size distribution.

It is preferred that the ester wax has a hardness of from 0.5 to 5.0. The hardness of the ester wax is a value obtained by preparing a cylindrical sample 20 mm in diameter and 5 mm in wall thickness and then measuring its Vickers hardness using a dynamic ultrafine hardness meter (DUH-200) manufactured by Shimadzu Corporation. As conditions for measurement, using a penetrator, its position is moved by 10 $\mu$m under a load of 0.5 g at a loading rate of 9.67 mg/sec. Thereafter, it is kept as it is for 15 seconds, and a depression made on the sample is analyzed to determine Vickers hardness.

According to studies made by the present inventors, the use of ester waxes whose hardness measured by the above method is less than 0.5 is large in dependence on the pressure and process speed of fixing assemblies, tending to cause a lowering of the effect of high-temperature anti-offset properties. On the other hand, the use of ester waxes whose hardness is more than 5.0 results in a low storage stability of the toner, and also tend to cause a lowering of high-temperature anti-offset properties because such ester waxes themselves have a small self cohesive force.

The ester wax may preferably have a weight-average molecular weight (Mw) of from 200 to 2,000 and a number average molecular weight (Mn) of from 150 to 2,000, and more preferably Mw of from 300 to 1,000 and Mn of from 250 to 1,000. More specifically, when using ester waxes whose Mw is less than 200 and Mn is less than 150, the blocking resistance of the toner may be lowered and low molecular weight components are liable to be present on toner particle surfaces, resulting in a low fluidity of the toner. On the other hand, when using ester waxes whose Mw is more than 2,000 and Mn is more than 2,000, granulation performance is inhibited in the toner production, tending to cause coalescence of toner particles.

In the present invention, the molecular weight distribution of the wax is measured by GPC (gel permeation chromatography) under conditions shown below.

GPC Measurement Conditions

Apparatus: GPC-150C (Waters Co.)

Columns: GMH-HT 30 cm, combination of two columns (available from Toso Co., Ltd.)

Temperature: 135° C.

Solvent: o-Dichlorobenzene (0.1% ionol-added)

Flow rate: 1.0 ml/min

Sample: 0.4 ml of 0.15% sample is injected.

Molecular weights are measured under conditions shown above. The molecular weight of the sample is calculated using a molecular weight calibration curve prepared from a monodisperse polystyrene reference sample. It is further calculated by converting the value into polyethylene according to a conversion expression derived from the Mark-Houwink viscosity equation.

As other additives incorporated in the toner, those shown below for example may be used for the purpose of imparting various properties to the toner. As lubricants, preferably usable are powders of fluorine resins such as polyvinylidene fluoride and polytetrafluoroethylene, and fatty acid metal salts such as zinc stearate and calcium stearate. As charge-controllable particles, preferably usable are metal oxides such as tin oxide, titanium oxide, zinc oxide, silicon oxide and aluminum oxide, and carbon black. These additives may be used in an amount of from 0.1 to 10 parts by weight, preferably from 0.1 to 5 parts by weight, based on 100 parts by weight of the binder resin.

The toner of the present invention, when used as a developer, may preferably be incorporated with an inorganic fine powder (e.g., fine silica powder, fine titania powder and fine alumina powder) having a specific surface area of 30 $m^2/g$ or above as measured by nitrogen gas absorption according to the BET method, and made to have a degree of aggregation of toner in the range of from 1 to 20%. The reason is that when the developer is prepared using the inorganic fine powder controlled to have the specific surface area as described above, the compound represented by Formula (A) present in the vicinity of toner particle surfaces and the inorganic fine powder interact so that the water adsorption to toner particles is controlled more remarkably, bringing about a greater effect of restraining the quantity of triboelectricity or charging rate from lowering. The interaction between that compound and the inorganic fine powder also brings about a greater effect of preventing the toner carrying member from being contaminated with that compound. Moreover, the controlling of the degree of aggregation of toner can regulate the contact state between the toner particles and the inorganic fine powder, so that the above mertorious effect can be maintained during continuous copying.

The inorganic fine powder used in the present invention may preferably have a specific surface area of 30 $m^2/g$ or above as described above, and more preferably in the range of from 50 to 400 $m^2/g$. That is, an inorganic fine powder having a specific surface area below 30 $m^2/g$ makes it difficult to control the aggregation degree of toner. Also, when the compound represented by Formula (A) according to the present invention is present on the toner particle surfaces, the potions where the inorganic fine powder interacts with the compound may become saturated. If the inorganic fine powder has a specific surface area above 400 $m^2/g$, the inorganic fine powder is buried in the toner particle surfaces to change the aggregation degree of toner with time in some cases. The specific surface area is measured according to the BET method, where nitrogen gas is adsorbed on sample surfaces using a specific surface area measuring device AUTOSOBE 1 (manufactured by Yuasa Ionics Co.), and the specific surface area is calculated by the BET multiple point method.

If the inorganic fine powder, which is externally added, is added in an mount less than 0.5 part by weight, it may be difficult to control the aggregation degree of toner. If it is in an amount more than 5 parts by weight, free inorganic fine powder may contaminate the toner carrying member and so forth.

For the purposes of making hydrophobic and control of chargeability, the inorganic fine powder used in the present invention may preferably be treated, if necessary, with a treating agent such as silicone varnish, modified silicone varnish of various types, silicone oil, modified silicone oil of various types, a silane coupling agent, a silane coupling agent having a functional group, or other organosilicon compound. Especially in order to maintain a high charge quantity and achieve a low consumption and a high transfer efficiency, the inorganic fine powder may preferably be treated with silicone oil.

The toner of the present invention may be used as a one-component developer as it is, or may be used in combination with a carrier so as to be used as a two-component developer.

When used as the two-component developer, for example, a magnetic carrier blended with the toner may be made of an element selected from iron, copper, zinc, nickel, cobalt, manganese and chromium, alone or in the composite ferrite state. The magnetic carrier used here may be in any shape, e.g., spherical, flat or shapeless. A magnetic carrier whose particle surface microstructure (e.g., surface unevenness) has appropriately been controlled may also be used. The carrier used may have an average particle diameter of from 10 to 100 $\mu$m, and more preferably from 20 to 50 $\mu$m. In addition, when such a carrier and the toner are blended to prepare the two-component developer, the toner in the developer may preferably be in a concentration of from about 2 to 15% by weight.

As methods for producing the toner of the present invention, any known methods may be used, such as a pulverization method in which the binder resin, the colorant, the wax and so forth are melt-kneaded by means of a pressure kneader, thereafter the kneaded product is cooled and then pulverized to have the desired toner particle diameter, and the pulverized product is further brought to classification to adjust its particle size distribution to produce a toner; the method as disclosed in Japanese Patent Publication No. 36-10231, and Japanese Patent Applications Laid-Open No. 59-53856 and No. 59-61842, in which toner is directly produced by suspension polymerization; such a method as disclosed in Japanese Patent Publication No. 56-13945, in which a melt-kneaded product is atomized in the air by means of a disk or a multiple fluid nozzle to obtain spherical toner particles; and an emulsion polymerization method as typified by soap-free polymerization. It is preferable to produce a shape-controlled toner by suspension polymerization while controlling the polymerization conversion of polymerizable monomers and the pH of aqueous medium.

More specifically, the compound represented by Formula (A) added in the toner in order to control the quantity of triboelectricity and the charging rate has so many hydrophilic functional groups that, when particles formed by granulation of a polymerizable monomer composition are polymerized in an aqueous dispersion medium to form toner particles, it may be dissolved in the aqueous dispersion medium. The compound thus dissolved does not allow the resulting toner particles to sufficiently exhibit the effect of improving the charge quantity and charging rate. Also, the compound dissolved behaves like a surface-active agent to make it very difficult for the toner particles to retain their shape in the step of polymerization, so that the toner can not be made to have the desired particle size distribution and particle shape. Especially when the compound is dissolved in a large quantity, particles having a finer particle diameter than the toner particles may be formed secondarily to bring about a difficulty in the matching to image forming apparatus.

To solve such a problem, the polymerization conversion of polymerizable monomers and the pH of aqueous medium may be controlled, whereby the compound can be prevented from dissolving and the compound can be retained in the vicinity of toner particle surfaces in a good state.

Stated in detail, in the polymerization reaction of the polymerizable monomer composition, a first reaction step is taken to make the polymerization conversion of polymerizable monomers higher by at least 10% while keeping the pH of the aqueous medium at 4.5 to 8.5, and preferably 4.5 to 6.0, whereby the compound represented by Formula (A) is prevented from dissolving in the aqueous medium and is embraced in toner particles. Then, the pH of the aqueous medium is again adjusted to 9 to 13 after the first reaction step, and a second reaction step is taken to make the polymerization conversion still higher, whereby the compound represented by Formula (A) can be drawn out to the vicinity of the surfaces of toner particles capable of participating in triboelectric charging and simultaneously the compound present on the surfaces can be dissolved and removed under alkaline conditions.

Thus, the compound represented by Formula (A) can be kept in the vicinity of toner particle surfaces in a good state, so that the resulting toner can have a very good charging performance. Also, the particle size distribution and shape of the toner particles can be controlled as desired, without causing any secondary formation of particles with fine particle diameter. Hence, the charging performance can be improved cooperatively and also the matching to image forming apparatus can be made very well. Especially when the pH of the aqueous medium in the first reaction step is kept at 4.5 to 6.0, the compound can be embraced more in toner particles, and hence the effect of improvement as stated above can be made much better.

In the present invention, the "polymerization conversion" of polymerizable monomers is found according to the following expression by determining a total weight (W2) of unreacted polymerizable monomers on the basis of a total weight (W1) of polymerizable monomers used in the polymerizable monomer composition. Polymerization conversion (%) $(W1-W2)/W1\times100$ The unreacted polymerizable monomers can be determined by adding, immediately after sampling from a reaction vessel, a short-stop (polymerization terminator) or cold methanol to the collected sample to terminate the polymerization reaction, and by using a known method such as (i) a method making use of thermogravimetry (TG) which makes measurements as a weight loss at the time of heating by means of a thermobalance, or (ii) a method making use of gas chromatography (GC). In particular, the method making use of GC is an especially effective method.

An example in which the polymerizable monomers in the toner are determined by GC is shown below.

GC Measurement Conditions

Apparatus:

GC-14A (manufactured by Shimadzu Corporation)

Column:

Fused silica capillary column (manufactured by J & W Scientific Co; size: 30 m×0.249 mm; liquid phase: DBWAX; layer thickness: 0.25 μm)

Sample:

Using 2.55 mg of DMF as an internal reference, a solvent containing the internal reference is prepared by adding 100 ml of acetone. Next, 400 mg of toner is made into a 10 ml solution using the solvent. After treatment with an ultrasonic shaker for 30 minutes, the solution is left standing for 1 hour. Next, the solution is filtered with a 0.5 μm filter. The sample is injected in an amount of 4 μl.

Detector: FID (split ratio: 1:20)

Carrier gas: $N_2$ gas

Oven temperature:

70° C.→220° C. (temperature rise at a rate of 5° C./min after standing at 70° C. for 2 minutes)

Injection temperature: 200° C.

Detection temperature: 200° C.

Preparation of calibration curve:

A reference sample prepared by adding a target polymerizable vinyl monomer to the same DMF-acetone solution as the sample solution is similarly measured by gas chromatography to determine the value of weight ratio/area ratio of the polymerizable vinyl monomer and the internal reference DMF.

In the present invention, when the toner is produced by suspension polymerization, any known inorganic or organic dispersant may be used as a dispersant used when the aqueous dispersion medium is prepared. Stated specifically, the dispersant used may include, as inorganic dispersants, e.g., tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica and alumina. As organic compounds, it may include, e.g., polyvinyl alcohol, gelatin, methyl cellulose, methyl hydroxypropyl cellulose, ethyl cellulose, carboxymethyl cellulose sodium salt, and starch.

Commercially available nonionic, anionic or cationic surface active agents may also be used. For example, usable are sodium dodecylsulfate, sodium tetradecylsulfate, sodium pentadecylsulfate, sodium octylsulfate, sodium oleate, sodium laurate, potassium stearate and calcium oleate.

In the present invention, a slightly water-soluble dispersant of an inorganic type is preferred, and besides a slightly water-soluble inorganic dispersant which is soluble in acid may preferably be used. In the present invention, when the aqueous dispersion medium is prepared using the slightly water-soluble inorganic dispersant, such a dispersant may preferably be used in a proportion of from 0.2 to 2.0 parts by weight based on 100 parts by weight of the polymerizable monomers. Also, in the present invention, the aqueous dispersion medium may preferably be prepared by using water in an amount of from 300 to 3,000 parts by weight based on 100 parts by weight of the polymerizable monomer composition.

In the present invention, when the aqueous dispersion medium in which the slightly water-soluble inorganic dispersant as described above has been dispersed is prepared, a commercially available dispersant may be used as it is, to make dispersion. In order to obtain dispersant particles having fine and uniform particle size, such a slightly water-soluble inorganic dispersant may be prepared by forming it in a liquid medium such as water under high-speed stirring. For example, when tricalcium phosphate is used as the dispersant, an aqueous sodium phosphate solution and an aqueous calcium chloride solution may be mixed to from fine particles of tricalcium phosphate, thus a preferable dispersant can be obtained.

The toner production process of the present invention, which is comprised as described above, can readily provide a toner which can restrain the decrease in quantity of triboelectricity in a high humidity environment and the lowering of the triboelectric charging rate in a low humidity environment, which have conventionally occurred in toners containing charge control agents, and also can effectively restrain the toner carrying member from being contaminated.

The image forming method to which the toner of the present invention is applied will be described below with reference to the accompanying drawings.

Figure 2:
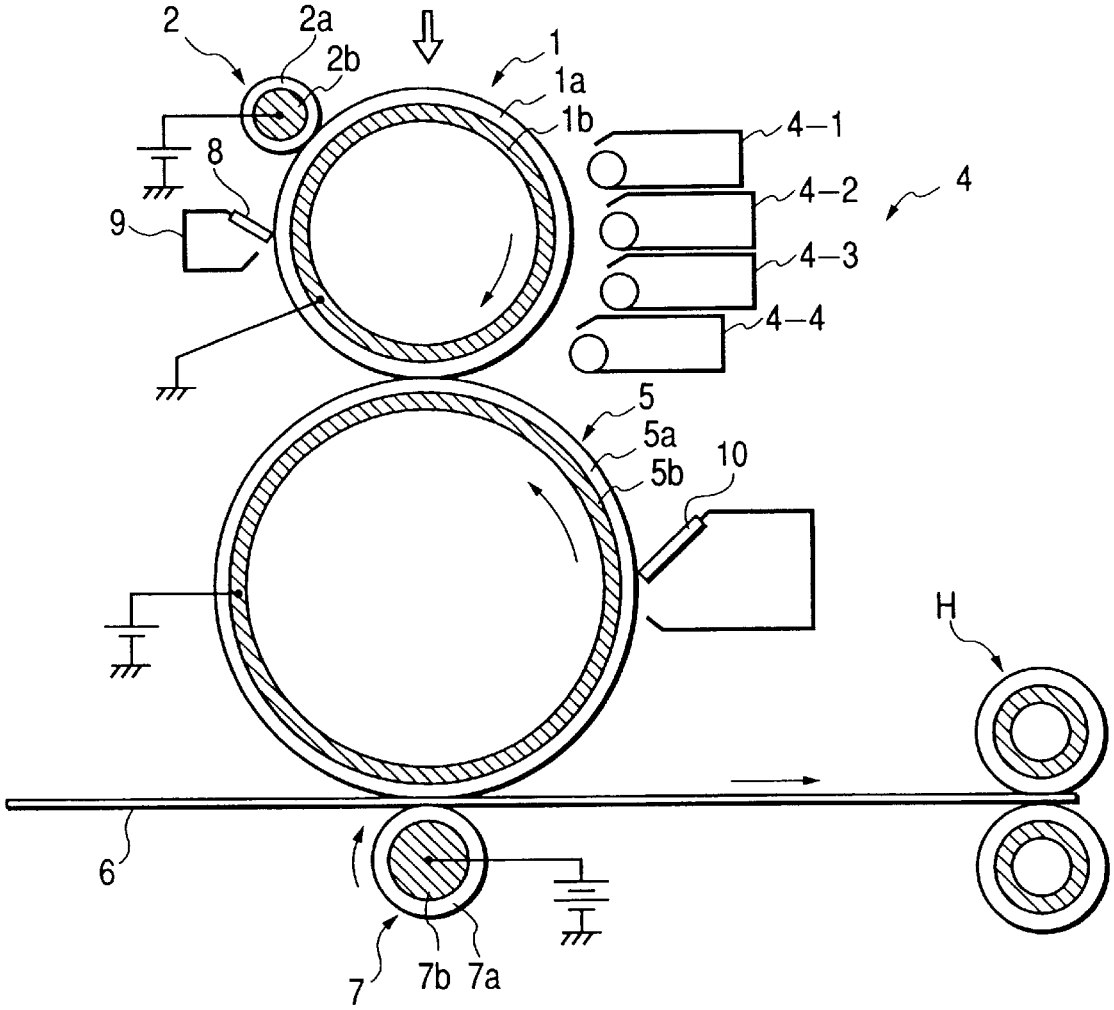
FIG. 2 is a schematic illustration of an image forming apparatus suited for the present invention.

In the apparatus system shown in FIG. 2, a developer having a cyan toner, a developer having a magenta toner, a developer having a yellow toner and a developer having a magnetic black toner are put into developing assemblies 4-1, 4-2, 4-3 and 4-4, respectively. Electrostatic latent images formed on an electrostatic latent image bearing member (e.g., photosensitive drum) 1 are developed by magnetic brush development or non-magnetic one-component development to form toner images of respective colors on the photosensitive drum 1.

Figure 3:
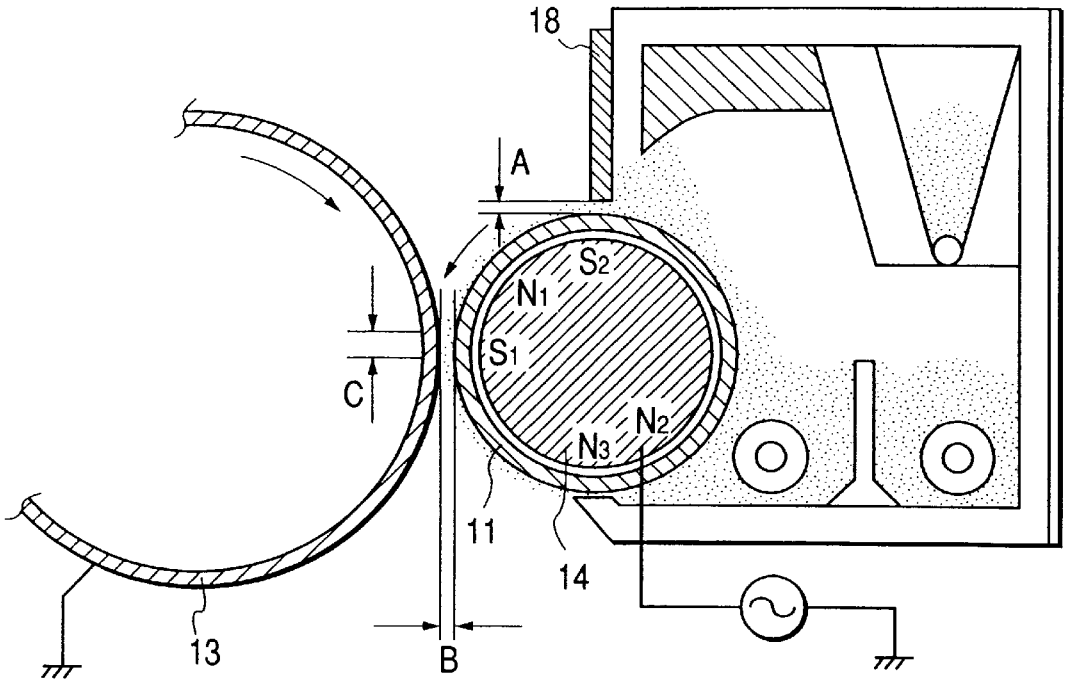
FIG. 3 is an enlarged transverse cross-sectional view of the main part of a developing assembly for a two-component developer used in Examples of the present invention.

The toner of the present invention may be blended with a magnetic carrier so that development can be made using, e.g., a developing means of a two-component development system as shown in FIG. 3. Stated specifically, the development may preferably be carried out while applying an alternating electric field and in such a state that a magnetic brush formed of the toner and the magnetic carrier comes into touch with a photosensitive drum 13. A distance B between a developer carrying member (developing sleeve) 11 and the photosensitive drum 13 (distance between S-D) may preferably be from 100 to 1,000 μm. This is desirable for preventing carrier adhesion and improving dot reproducibility. If it is smaller (i.e., the gap is narrower) than 100 μm, the developer tends to be insufficiently fed, resulting in a low image density. If it is larger than 1,000 μm, the magnetic line of force from the magnetic pole S1 held by a magnetism generating means 14 internally provided for the developing sleeve may broaden to make the magnetic brush have a low density, resulting in a poor dot reproducibility, or to weaken the force of binding the carrier, tending to cause carrier adhesion.

The alternating electric field may preferably be applied at a peak-to-peak voltage (Vpp) of from 500 to 5,000 V and a frequency (f) of from 500 to 10,000 Hz, and preferably from 500 to 3,000 Hz, which may each be applied to the process under appropriate selection. In this instance, the waveform used may be selected from triangular waveform, rectangular waveform, sinusoidal waveform, or waveform with a varied duty ratio. If the peak-to-peak voltage is lower than 500 V, a sufficient image density may be hard to attain, and fog toner at non-image areas cannot be satisfactorily collected in some cases. If the peak-to-peak voltage is higher than 5,000 V, the electrostatic latent image may be disordered through the magnetic brush to cause a lowering of image quality.

The use of a two-component developer having a toner desirably charged enables fog take-off voltage (Vback) to be lowered, and enables the photosensitive member to be low charged in its primary charging, thus the photosensitive member can be made to have a longer lifetime. While depending upon development systems, the Vback may preferably be 150 V or below, and more preferably 100 V or below.

As contrast potential, a potential of from 200 V to 500 V may preferably be used so that a sufficient image density can be achieved.

If the frequency (f) is lower than 500 Hz, electric charges may be injected into the carrier, relating also to process speed, so that carrier adhesion may occur or latent images may be disordered, causing a lowering of image quality. If the frequency (f) is higher than 10,000 Hz, the toner can not follow up the electric field to tend to cause a lowering of image quality.

In order to carry out development promising a sufficient image density, achieving a superior dot reproducibility and free of carrier adhesion, the magnetic brush on the developing sleeve 11 may preferably be made to come into touch with the photosensitive drum 13 at a width (developing nip C) of from 3 to 8 mm. If the developing nip C is narrower than 3 mm, it may be difficult to satisfy sufficient image density and dot reproducibility. If it is broader than 8 mm, the developer may be packed into the nip to cause the machine to stop from operating, or it may be difficult to well prevent the carrier adhesion. As methods for adjusting the developing nip, the nip width may appropriately be adjusted by adjusting the distance A between a developer-regulating blade 18 and the developing sleeve 11, or by adjusting the distance B between the developing sleeve 11 and the photosensitive drum 13.

In the formation of full-color images which attaches importance especially to halftones, three or more developing assemblies for magenta, cyan and yellow may be used, and the developer and developing process making use of the toner of the present invention may be used, especially in combination with a development system in which digital latent images are formed. Thus, the latent images are not affected by the magnetic brush and are not disordered, and hence can be developed faithfully to the dot images. Also in the transfer step, the use of the toner of the present invention enables a high transfer efficiency to be achieved, and therefore enables a high image quality to be achieved in both halftone areas and solid areas.

In addition, concurrently with the achievement of a high image quality at the initial stage, the effect of the present invention can be continuously exhibited without any lowering of image quality even in many-sheet copying.

The toner of the present invention may preferably be used also in one-component development. An example of an apparatus for developing electrostatic latent images formed on the electrostatic latent image bearing member by the use of a one-component developer is shown below. Examples are not necessarily limited to the following.

Figure 4:
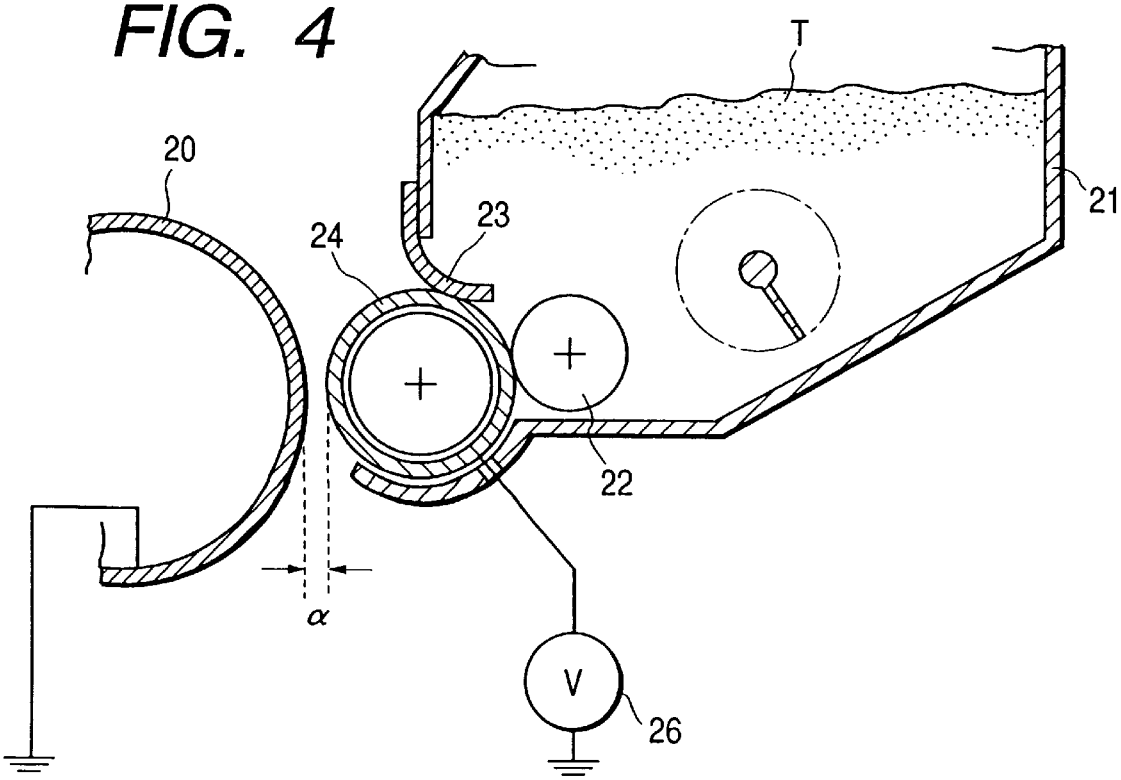
FIG. 4 is an enlarged transverse cross-sectional view of the main part of a developing assembly for a one-component developer used in Examples of the present invention.

In FIG. 4, reference numeral 20 denotes an electrostatic latent image bearing member (photosensitive drum). Latent images are formed by electrophotographic processing means or electrostatic recording means. Reference numeral 24 denotes a toner carrying member (developing sleeve) formed of a non-magnetic sleeve made of aluminum or stainless steel.

Substantially the right half of the periphery of the toner carrying member 24 always comes into contact with a toner reservoir inside a toner container 21, and the toner in the vicinity of the toner carrying member 24 is attracted and held onto the toner carrying member surface by the aid of a magnetic force and/or electrostatic force produced by the magnetism generating means provided in the toner carrying member.

In the present invention, the toner carrying member may preferably have a surface roughness Ra ($\mu$m) so set as to be not larger than 1.5, preferably not larger than 1.0, and more preferably not larger than 0.5.

When the surface roughness Ra is set to be not larger than 1.5, the toner particle transporting performance the toner carrying member has can be controlled, the toner layer formed on the toner carrying member can be made thinner and also the times the toner carrying member comes into contact with the toner increases, and hence the charging performance of the toner can also be improved to cooperatively bring about an improvement in image quality.

If the toner carrying member has a surface roughness Ra larger than 1.5, not only the toner layer on the toner carrying member is hard to make thin, but also the charging performance of the toner is not improved, thus no improvement in image quality can be expected.

In the present invention, the surface roughness Ra of the toner carrying member corresponds to centerline average roughness measured using a surface roughness measuring device (SURFCOADER SE-30H, manufactured by K. K. Kosaka Kenkyusho) according to JIS surface roughness "JIS B-0601"). Stated specifically, a portion of 2.5 mm is drawn out of the roughness curve, setting a measurement length a in the direction of its centerline. When the centerline of this drawn-out portion is represented by X axis, the direction of lengthwise magnification by Y axis, and the roughness curve by y=f(x), the value determined according to the following expression and indicated in micrometer ($\mu$m) is the surface roughness Ra.

$$Ra = \frac{1}{a}\int_0^a |f(x)|dx$$

As the toner carrying member used in the present invention, a cylindrical or belt-like member formed of, e.g., a non-magnetic metal such as stainless steel or aluminum may preferably be used. If necessary, a metal or resin coat may be provided on the surface of its substrate, or a resin in which fine particles of resin, metals, carbon black or charge control agent have been dispersed may be coated.

In the present invention, the speed of surface movement of the toner carrying member may be set 1.05 to 3.0 times the speed of surface movement of the electrostatic latent image bearing member, whereby the toner layer on the toner carrying member can have an appropriate agitation effect and hence the faithful reproduction of the electrostatic latent image can be more improved.

If the speed of surface movement of the toner carrying member is less than 1.05 times the speed of surface movement of the electrostatic latent image bearing member, the agitation effect on the toner layer may become insufficient, so that it can not be expected to form good images. Also, when images requiring a large quantity of toner over a wide area are developed as in the case of solid black images, the quantity of toner fed to the electrostatic latent image tends to become short, resulting in an insufficient image density. If on the other hand the speed of surface movement of the toner carrying member is more than 3.0 times the speed of surface movement of the electrostatic latent image bearing member, not only various problems caused by excessive charging of toner as stated above, but also the deterioration of toner due to mechanical stress or the sticking of toner to the toner carrying member tends to occur undesirably.

The toner, T, is stored in a toner container 21, and is fed onto the developing sleeve 24 by means of a feed member 22. As the feed member, a feed roller comprised of a porous elastic material as exemplified by a foamed material such as soft polyurethane foam may preferably be used. The feed roller may be rotated at a relative speed that is not zero in the forward direction or backward direction with respect to the developing sleeve so that the toner can be fed onto the developing sleeve and also the toner remaining on the developing sleeve (the toner not participated in development) can be stripped off. In this instance, taking account of the balance of the feeding and stripping of the toner, the feed roller may be brought into contact with the developing sleeve at a width (a nip) of from 2.0 to 10.0 mm, and more preferably from 4.0 to 6.0 mm. On the other hand, this inevitably imposes an excess stress to the toner to tend to cause an increase in agglomeration due to the deterioration of toner, or cause the melt-adhesion or sticking of toner to the developing sleeve and feed roller. However, since the toner used in the developing process of the present invention has excellent fluidity and releasability and has a running stability, the toner is preferably usable also in the developing system having such a feed member. A brush member formed of resin fiber such as nylon or rayon may also be used as the feed member. Such a feed member is very effective in a non-magnetic one-component development carried out using a non-magnetic one-component developer (non-magnetic toner), in which any magnetic binding force can not be utilized. It may also be used in a magnetic one-component development carried out using a magnetic one-component developer (magnetic toner).

The toner fed onto the developing sleeve is coated in thin layer and uniformly by a regulation member. The regulation member, 23, for making thin toner layer may be a doctor blade such as a metal blade or magnetic blade provided a given interval apart from the developing sleeve. Alternatively, in place of the doctor blade, a rigid-material roller or sleeve formed of metal, resin or ceramic may be used, and a magnetism generating means may be provided in the inside thereof. Also, an elastic member such as an elastic blade or an elastic roller for coating the toner under pressure contact may be used as the regulation member for making thin toner layer. For example, as shown FIG. 4, an elastic blade 23 is, at its upper side base portion, fixedly held on the side of the toner container 21 and is so provided that its blade inner face side (or its outer face side in the case of the backward direction) is, at its lower side, brought into touch with the surface of the developing sleeve 24 under an appropriate elastic pressure in such a state that it is deflected against the elasticity of the blade in the forward direction or backward direction of the rotation of the developing sleeve. According to such construction, a toner layer can be formed which is stable even in environmental variations and is dense. The reason therefor is not necessarily clear, and it is presumed that the toner is forcibly brought into friction with the developing sleeve surface by the elastic member and hence the toner is charged always in the like state without regard to any changes in behavior caused by environmental changes of toner.

On the other hand, the toner tends to be so excessively charged that it tends to melt-adhere to the developing sleeve or elastic blade. However, the toner of the present invention can be preferably used because it has a superior releasability and has a stable triboelectric chargeability.

As the elastic blade, it is preferable to select a material of triboelectric series suited for electrostatically charging the toner to the desired polarity, which includes rubber elastic materials such as silicone rubber, urethane rubber or NBR; synthetic resin elastic materials such as polyethylene terephthalate; and metal elastic materials such as stainless steel, steel and phosphor bronze, as well as composite materials thereof, any of which may be used.

In instances where the elastic member and the developing sleeve are required to have a durability, resin or rubber may preferably be stuck to, or coated on, the metal elastic material so as to touch the part coming into contact with the sleeve.

An organic or inorganic substance may also be added to, may be melt-mixed in, or may be dispersed in, the elastic member. For example, any of metal oxides, metal powders, ceramics, carbon allotropes, whiskers, inorganic fibers, dyes, pigments and surface-active agents may be added so that the charging performance of the toner can be controlled. Especially when the elastic member is formed of a molded product of rubber or resin, a fine metal oxide powder such as silica, alumina, titania, tin oxide, zirconium oxide or zinc oxide, carbon black, or a charge control agent commonly used in toners may preferably be incorporated therein.

A DC electric field and/or an AC electric field may also be applied to a developing blade serving as the regulation member, a feed roller as the feed member and a brush member, whereby the uniform thin-layer coating performance and uniform chargeability can be more improved at the regulated part on the developing sleeve because of the loosening action acting on the toner and the toner can be smoothly fed and stripped off, so that a sufficient image density can be achieved and images with a good quality can be formed.

It is effective for the elastic member to be brought into touch with the toner carrying member (developing sleeve) at a pressure of 0.1 kg/m or above, preferably from 0.3 to 25 kg/m, and more preferably from 0.5 to 12 kg/cm, as a linear pressure in the generatrix direction of the toner carrying member. This makes it possible to effectively loosen the agglomeration of toner and makes it possible to effect instantaneous rise of the charge quantity of toner. If the touch pressure is below 0.1 kg/m, it is difficult to uniformly coat the toner, resulting in a broad charge quantity distribution of the toner to cause fog or black spots around line images. If the touch pressure is above 25 kg/m, a great pressure is applied to the toner to cause deterioration of the toner and occurrence of aggregates of the toner, and also a great torque is required in order to drive the toner carrying member, undesirably.

The gap a between the electrostatic latent image bearing member and the toner carrying member may preferably be set to be from 50 to 500 $\mu$m, and the gap between the doctor blade and the toner carrying member may preferably be set to be from 50 to 400 $\mu$m.

The layer thickness of the toner layer formed on the toner carrying member may preferably be made smaller than the gap a between the electrostatic latent image bearing member and the toner carrying member. In some cases, the layer thickness of the toner layer may be regulated in such an extent that part of a large number of toner ears constituting the toner layer comes into contact with the surface of the electrostatic latent image bearing member.

Meanwhile, an alternating electric field may be applied across the toner carrying member and the electrostatic latent image bearing member by a bias power source 26. This makes it easy for the toner to move from the toner carrying member to the electrostatic latent image bearing member and to form images with a much higher image quality. The alternating electric field may preferably be applied at Vpp of 100 V or above, preferably from 200 to 3,000 V, and more preferably from 300 to 2,000 V. It may also preferably be applied at a frequency (f) of from 500 to 5,000 Hz, more preferably from 1,000 to 3,000 Hz, and still more preferably from 1,500 to 3,000 Hz. As the waveform of this electric field, rectangular waveform, sine waveform, sawtooth waveform and triangle waveform may be used. An asymmetrical AC bias having different time for which forward/backward voltages are applied may also be used. It is also preferable to use a bias formed by superimposing an AC bias on to a DC bias.

In the apparatus shown in FIG. 2, the electrostatic latent image bearing member 1 is a photosensitive drum or photosensitive belt having a photoconductive insulating material layer formed of α-Se, CdS, $ZnO_2$, OPC or a-Si. The electrostatic latent image bearing member 1 is rotatively driven by means of a drive system (not shown) in the direction of an arrow.

As the electrostatic latent image bearing member 1, a photosensitive member having an amorphous silicon photosensitive layer or an organic photosensitive layer may preferably be used.

The organic photosensitive layer may be of a single-layer type in which the photosensitive layer contains a charge generating material and a charge transporting material in the same layer, or may be a function-separated photosensitive layer comprised of a charge transport layer and a charge generation layer. A multi-layer type photosensitive layer comprising a conductive substrate, and the charge generation layer and the charge transport layer superposed on the substrate in this order is one of preferred examples.

As binder resins for the organic photosensitive layer, polycarbonate resins, polyester resins or acrylic resins may preferably be used because they provide a good transfer performance and a good cleaning performance, and may hardly cause faulty cleaning, melt-adhesion of toner to the photosensitive member and filming of external additives.

The step of charging has a system in which the charging means and the electrostatic latent image bearing member 1 are in non-contact with each other as in a corona charging assembly, or a contact type system in which they are in contact with each other as in a charging roller. Either system may be used. The contact charging system as shown in FIG. 2 may preferably be used so as to enable efficient and uniform charging, simplify the system and make ozone less occur.

A charging roller 2 is constituted basically of a mandrel 2*b* at the center and a conductive elastic layer 2*a* that forms the periphery of the former. The charging roller 2 is brought into pressure contact with the surface of the electrostatic latent image bearing member 1 and is rotated following the rotation of the electrostatic latent image bearing member 1.

When the charging roller is used, the charging process may preferably be performed under the conditions of a roller contact pressure of 5 to 500 g/cm, and an AC voltage of 0.5 to 5 kVpp, an AC frequency of 50 Hz to 5 kHz and a DC voltage of ±0.2 to ±1.5 kV when a voltage formed by superimposing an AC voltage on a DC voltage is applied, and a DC voltage of from ±0.2 to ±5 kV when only a DC voltage is applied.

As a charging means other than the charging roller, there are a method making use of a charging blade and a method making use of a conductive brush. These contact charging means have the effect of, e.g., making high voltage unnecessary and making ozone less occur.

The charging roller and charging blade as contact charging means may preferably be made of a conductive rubber, and a release coat may be provided on its surface. The release coat may be formed of a nylon resin, PVDF (polyvinylidene fluoride) or PVDC (polyvinylidene chloride), any of which may be used.

The toner image on the electrostatic latent image bearing member is primarily transferred to an intermediate transfer member 5 to which a voltage (e.g., ±0.1 to ±5 kV) is applied. The surface of the electrostatic latent image bearing member is cleaned by a cleaning means 9 having a cleaning blade 8.

The intermediate transfer member 5 is comprised of a pipe-like conductive mandrel 5*b* and a medium-resistance elastic material layer 5*a* formed on its periphery. The mandrel 5*b* may comprise a plastic pipe provided thereon with a conductive coating.

The medium-resistance elastic material layer 5*a* is a solid or foamed-material layer made of an elastic material such as silicone rubber, Teflon rubber, chloroprene rubber, urethane rubber or EPDM (an ethylene-propylene-diene terpolymer) in which a conductivity-providing agent such as carbon black, zinc oxide, tin oxide or silicon carbide has been mixed and dispersed to adjust electrical resistance (volume resistivity) to a medium resistance of from $10^5$ to $10^{11}$ Ω·cm.

The intermediate transfer member 5 is provided in contact with the bottom part of the electrostatic latent image bearing member, being axially supported in parallel to the electrostatic latent image bearing member 1, and is rotatively driven at the same peripheral speed as the electrostatic latent image bearing member 1 in the direction as shown by an arrow.

The first-color toner image formed and held on the surface of the electrostatic latent image bearing member 1 is, in the course of passing through the transfer nip portion where the electrostatic latent image bearing member 1 and the intermediate transfer member 5 come into contact with each other, intermediately sequencially transferred to the periphery of the intermediate transfer member 5 by the aid of the electric filed formed at the transfer nip portion, by a transfer bias applied to the intermediate transfer member 5.

If necessary, after the toner image has been transferred to the transfer medium, the surface of the intermediate transfer member 5 may be cleaned by a detachable cleaning means 10. When the toner is present on the intermediate transfer member 5, the cleaning means 10 is separated from the surface of the intermediate transfer member so that the toner image is not disordered.

A transfer means 7 by which the toner image is secondarily transferred from the intermediate transfer member to the transfer medium is provided in contact with the bottom part of the intermediate transfer member 5, being axially supported in parallel to the intermediate transfer member 5. The transfer means 7 is, e.g., a transfer roller or a transfer belt, and is rotatively driven at the same peripheral speed as the intermediate transfer member 5 in the clockwise direction as shown by an arrow. The transfer means 7 may be so provided that it comes into direct contact with the intermediate transfer member 5, or may be so disposed that a belt comes into contact with and between the intermediate transfer member 5 and the transfer means 7 therebetween.

In the case of the transfer roller, it is basically comprised of a mandrel 7*b* at the center and a conductive elastic layer 7*a* that forms the periphery of the former.

The intermediate transfer member and the transfer roller may be formed of commonly available materials. The elastic layer of the transfer roller may be made to have a volume resistivity set smaller than the volume resistivity of the elastic layer of the intermediate transfer member, whereby the voltage applied to the transfer roller can be lessened, good toner images can be formed on the transfer medium and also the transfer medium can be prevented from being wound around the intermediate transfer member. In particular, the elastic layer of the intermediate transfer member may preferably have a volume resistivity at least 10 times the volume resistivity of the elastic layer of the transfer roller.

For example, a conductive elastic layer 7*b* of the transfer roller 7 is made of, e.g., an elastic material having a volume resistivity of $10^6$ to $10^{10}$ Ω·cm, such as polyurethane, or an ethylene-propylene-diene type terpolymer (EPDM), with a conductive material, such as carbon, dispersed therein. A bias is applied to the mandrel 7*a* by a constant voltage power source. As bias conditions, a voltage of from ±0.2 to ±10 kV is preferred.

Figure 5:
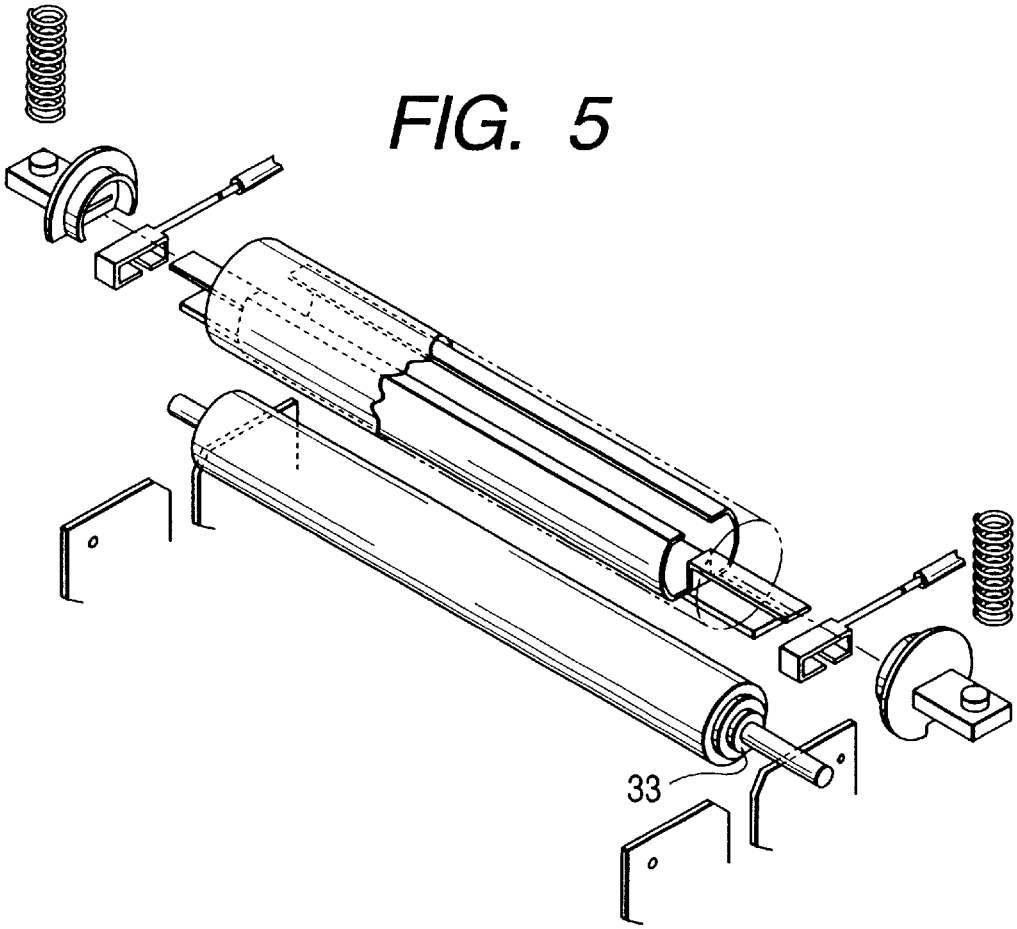
FIG. 5 is an exploded perspective view of the main part of a fixing assembly used in Examples of the present invention.
Figure 6:
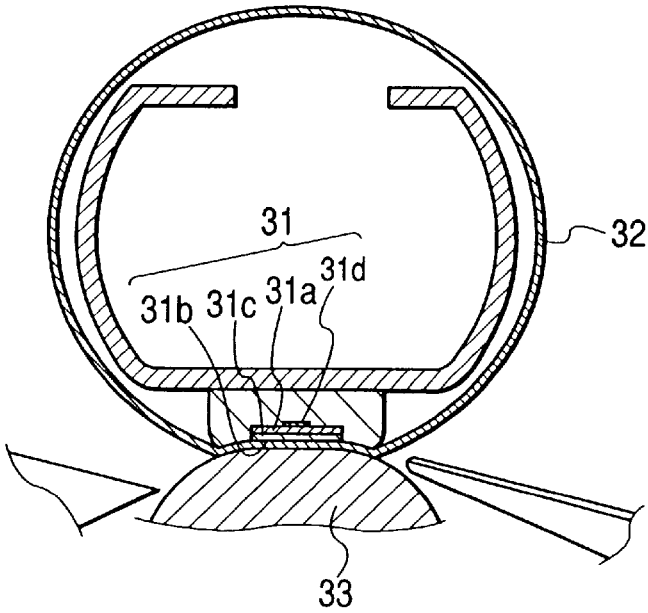
FIG. 6 is an enlarged transverse cross-sectional view of the main part showing how a film stands when a fixing assembly used in Examples of the present invention is not driven.

The toner image on the transfer medium 6 is fixed by means of a heat-and-pressure fixing means H. The heat-and-pressure fixing means may include a heat roll system constituted basically of a heat roller internally provided with a heating element such as a halogen heater and an elastic-material pressure roller brought into contact therewith under pressure, and a system in which the toner image is fixed by heat and pressure by means of a heater through a film (FIGS. 5 and 6). The toner of the present invention can well match the above heat-and-pressure fixing means because of its superior fixing performance and anti-offset properties.

The toner of the present invention has a high transfer efficiency at the transfer step, may make the toner less remain after transfer and also has a superior cleaning performance, and hence the filming may hardly occur on the electrostatic latent image bearing member. Moreover, the toner of the present invention may less make the external additive bury in the toner particle surfaces than conventional toners even when a many-sheet running test is made, and hence a good image quality can be maintained over a long period of time. Accordingly, it is preferably used especially in an image forming apparatus having what is called the reuse mechanism in which the toner remaining on the electrostatic latent image bearing member and intermediate transfer member after transfer is removed by a cleaning means such as a cleaning blade and the toner remaining after transfer and thus collected is reused.

Figure 10:
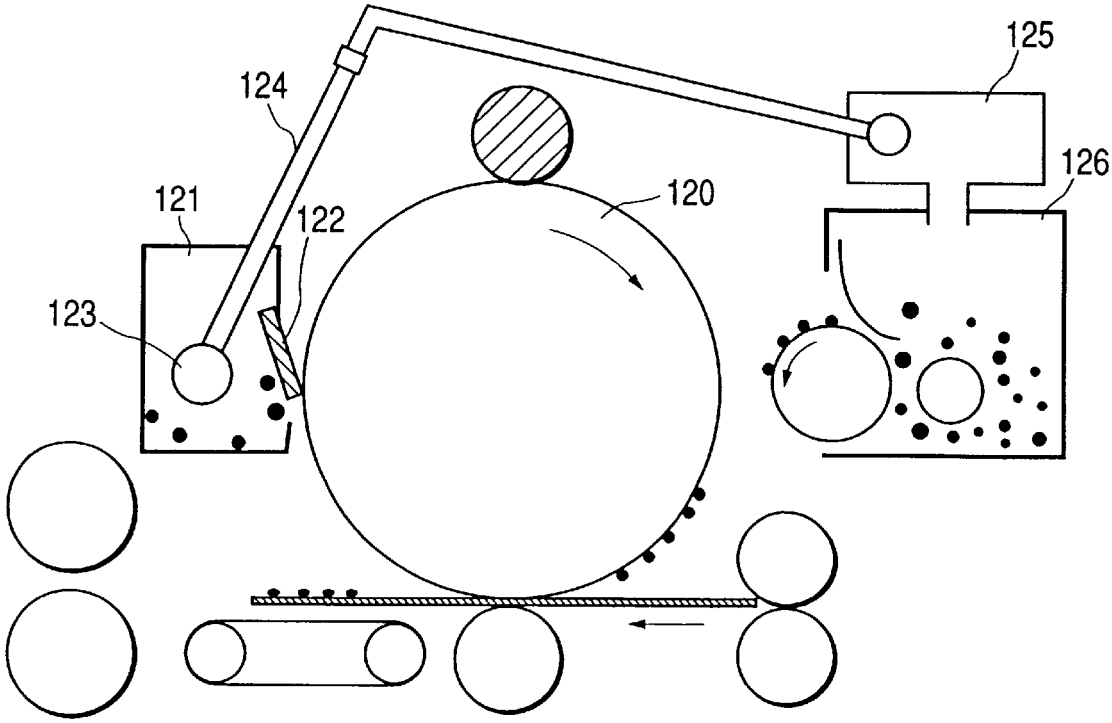
FIG. 10 is a schematic illustration of an image forming apparatus which reuses untransferred toner.

The reuse mechanism is described with reference to FIG. 10. The transfer residual toner present on the surface of a photosensitive drum 120 after transfer is scraped off with an elastic blade 122 coming into touch with the photosensitive drum, and is collected in a cleaner 121. The transfer residual toner thus collected is transported through a cleaner screw 123, by means of a feed pipe 124 provided with a transport screw, and, through a hopper 125, returned to a developing assembly 126. The toner thus returned is again used for development.

A one-component contact development system may also be used in which an elastic roller is used as the toner carrying member, the toner is coated on the surface of this elastic roller to form a toner layer and this toner layer is brought into contact with the surface of the photosensitive member serving as an image bearing member.

In the one-component contact development system, the toner may be either of magnetic and non-magnetic, and it is important that the toner layer and the photosensitive member surface come into contact with each other. The toner carrying member may preferably substantially come into contact with the photosensitive member surface, which means that the toner carrying member comes into contact with the photosensitive member when the toner layer is removed from the toner carrying member. Here, in order to obtain images free of the edge effect through the toner and by the aid of an electric field acting between the photosensitive member surface and the toner carrying member facing the photosensitive member surface, it is necessary for the elastic roller to have a potential on its surface or in the vicinity of the surface and for the electric field to be formed between the photosensitive member surface and the elastic roller toner carrying member surface. Hence, the elastic layer formed by elastic rubber on the surface of a low-resistance core material of the elastic roller may be resistance-controlled in a medium-resistance region so as to keep the electric field while preventing its conduction with the photosensitive member surface, or a thin-layer dielectric layer may be provided on the surface of a low-resistance conductive roller; either method may be used. The system may also bo so constituted that a conductive roller is coated with an insulating substance on its surface side facing the photosensitive member surface or provided with a conductive layer on the inner side of an insulating sleeve not facing the photosensitive member.

When the one-component contact development system is used, a developing roller serving as the toner carrying member for carrying the toner thereon may be rotated in the same direction as the photosensitive member (the same surface movement direction), or may be rotated in the opposite direction. When the developing roller is rotated in the same direction, it may preferably be rotated at a peripheral speed ratio of more than 100% with respect to the peripheral speed of the photosensitive member. If it is not more than 100%, a problem may be left on image quality, e.g., a poor line sharpness. With an increase in the peripheral speed ratio, the quantity of the toner fed to the developing zone increases, and the toner is more frequently taken on and off the latent image, where the toner is repeatedly scraped off at the unwanted part and imparted to the wanted part, so that an image faithful to the electrostatic latent image can be formed.

The image forming method of the present invention will be described with reference to the accompanying drawings.

Figure 7:
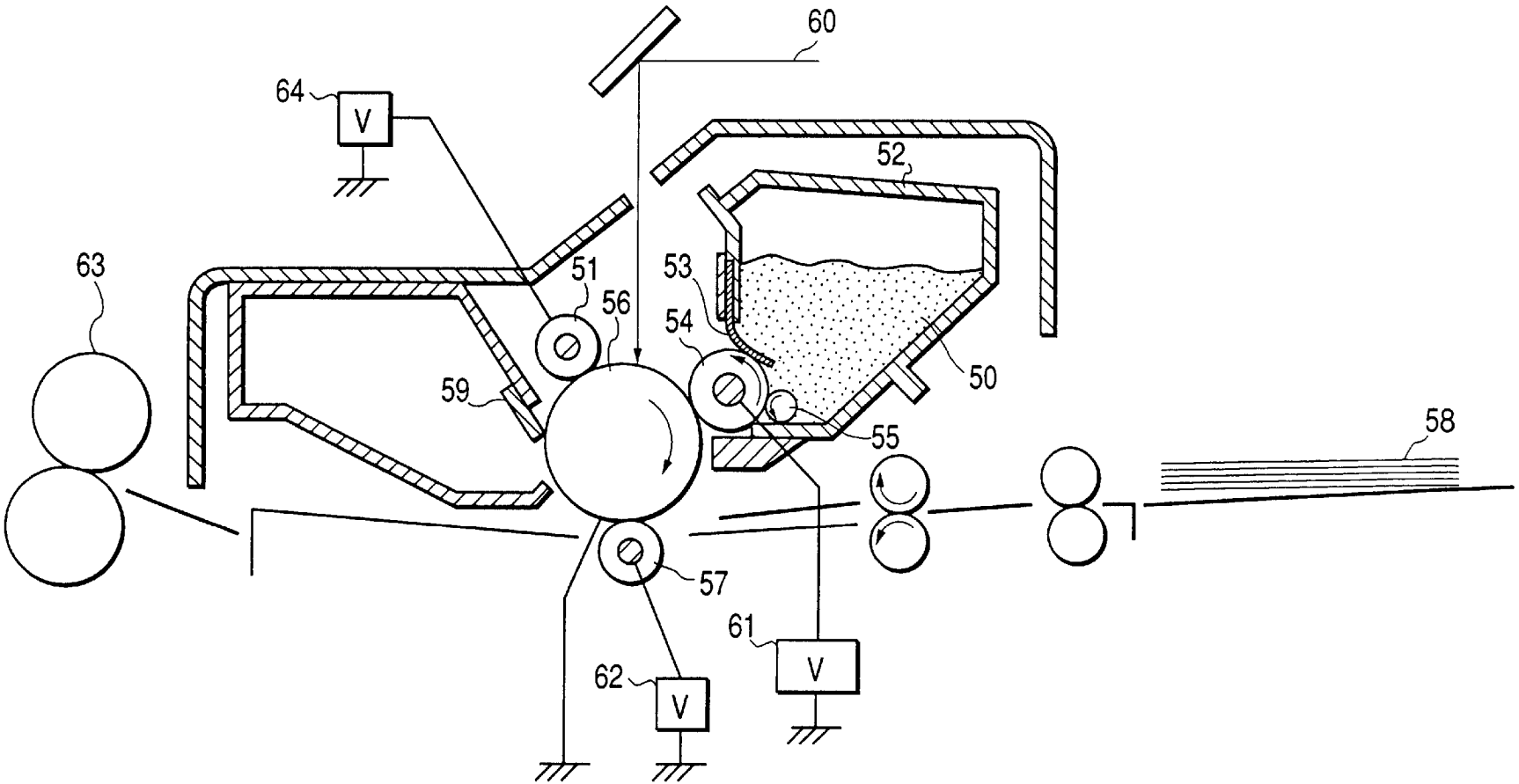
FIG. 7 is a diagrammatic illustration of an image forming method employing a contact one-component developing assembly, used in Examples as an examples of the image forming method of the present invention.

FIG. 7 diagrammatically illustrates, as an example of the one-component contact development system according to the present invention, an image forming apparatus having a process cartridge.

A photosensitive member 56 is electrostatically charged by means of a charging roller 51 serving as the contact charging means, and image areas are exposed to laser light 60 to form an electrostatic latent image. A toner 50 held in a developing assembly 52 is coated on a toner carrying member 54 by means of a toner coating roller 55 and a coating blade 53, a toner layer formed on the toner carrying member 54 is brought into contact with the surface of the photosensitive member 56, and the electrostatic latent image formed on the photosensitive member 56 is developed by reversal development, to form a toner image on the photosensitive member 56. To the toner carrying member 54, at least a DC bias is applied through a bias applying means 61. The toner image on the photosensitive member 56 is transferred onto a transfer medium 58 transported to the transfer zone, by means of a transfer roller 57, serving as the transfer means, to which a bias is applied through a bias applying means 62. The toner image transferred onto the transfer medium is fixed through a heat-and-pressure fixing means 63 having a heating roller and a pressure roller.

The image forming apparatus has a blade-like cleaning member 59 provided in contact with the surface of the photosensitive member 56 between the transfer zone assigned to a transfer roller 57 and the charging zone assigned to a charging roller 51. The transfer residual toner remaining on the photosensitive member 56 after the step of transfer is scraped off by the cleaning member 59 and collected by a cleaner. The photosensitive member 56 from the surface of which the transfer residual toner has been removed is again electrostatically charged by the charging roller 51 and is, after charged, exposed to laser light 60, so that an electrostatic latent image is formed. The electrostatic latent image on the photosensitive member 56 is developed by the toner carried on the developer carrying member 54. A toner image formed on the photosensitive member 56 after the developing step is transferred by means of the transfer roller 57 onto a recording medium 58 transported to the transfer zone. After the transfer step, the photosensitive member 56 is cleaned by the cleaning member 59 to remove the transfer residual toner, and thereafter again electrostatically charged by means of the charging roller 51. A similar process is repeatedly carried out thereafter.

Figure 8:
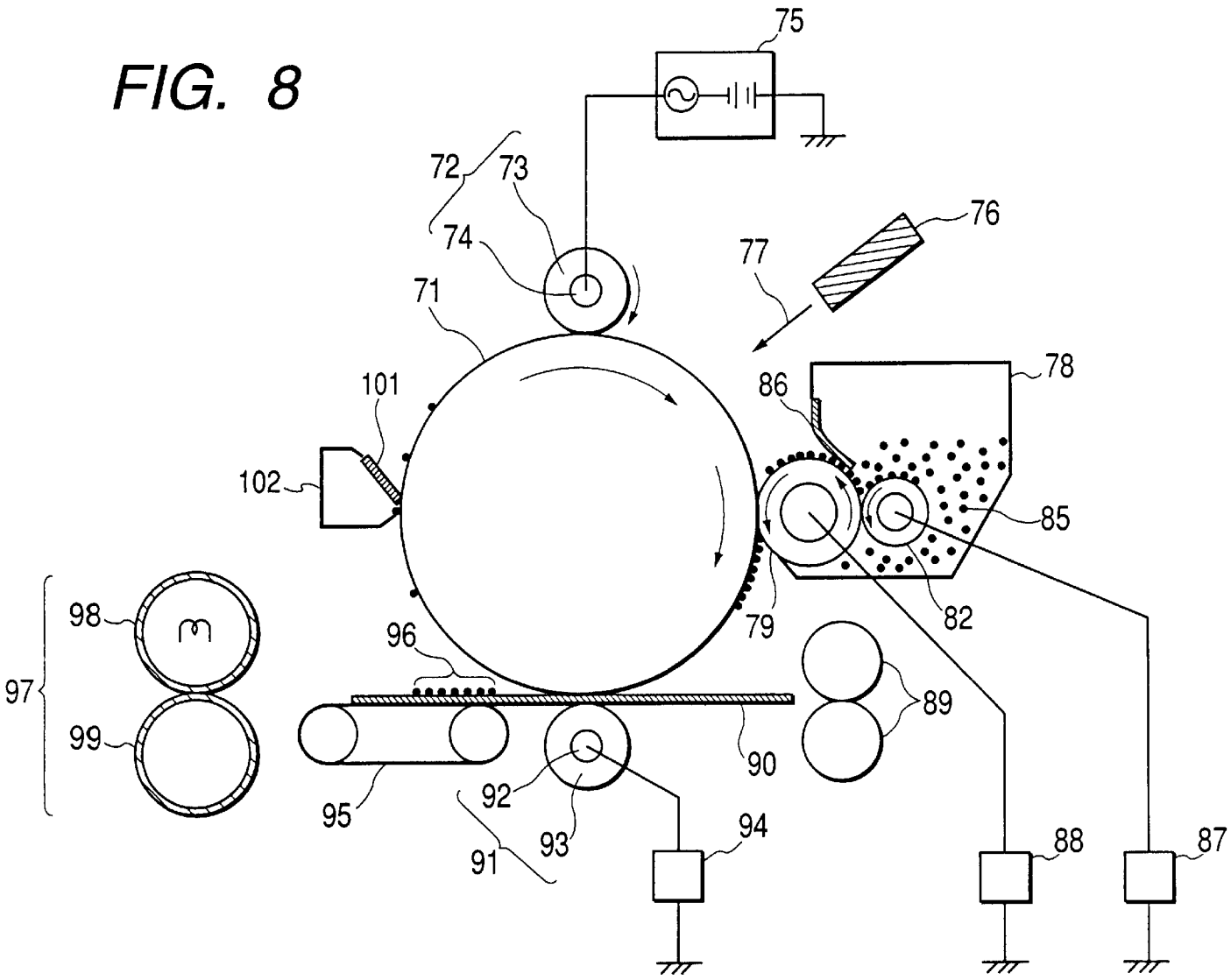
FIG. 8 is a diagrammatic illustration of an image forming method employing a contact one-component developing assembly, used as another example of the image forming method of the present invention.

FIG. 8 illustrates another example of the image forming apparatus, in which the toner can be fed to a developing sleeve serving as the toner carrying member and in addition thereto the toner having participated in development can smoothly be stripped off the developing sleeve.

In FIG. 8, reference numeral 71 denotes a photosensitive drum, around which a primary charging roller 72 as a contact charging means, a developing assembly 78 as a developing means, a transfer charging roller 91 as a contact transfer means and a resistor roller 89 are provided. Then, the photosensitive drum 71 is electrostatically charged to, e.g., −700 V by means of the primary charging roller 72. Voltage applied by a bias applying means 75 is DC voltage which is, e.g., −1,350 V. Then, the photosensitive drum 71 is exposed to laser light 7 emitted from a laser light generator 76 to form a digital electrostatic latent image. The electrostatic latent image on the the photosensitive drum 71 is developed by a non-magnetic one-component developer (toner) 85, and is transferred onto a recording medium 90 by means of the transfer roller 91 to which a bias voltage is applied through a bias applying means 94. The recording medium 90 holding thereon a toner image 96 is transported on a transfer belt 95 to a heat-and-pressure fixing assembly 97 having a heat roller 98 and a pressure roller 99, and the toner image is fixed to the recording medium 90. Reference numeral 102 denotes a cleaner having a cleaning member 101. The transfer residual toner on the photosensitive drum after the transfer step is scraped off by the cleaning member 101 and collected by the cleaner 102.

The charging roller 72 is basically constituted of a mandrel 74 at the center and a conductive elastic layer 73 that forms its periphery.

Figure 9:
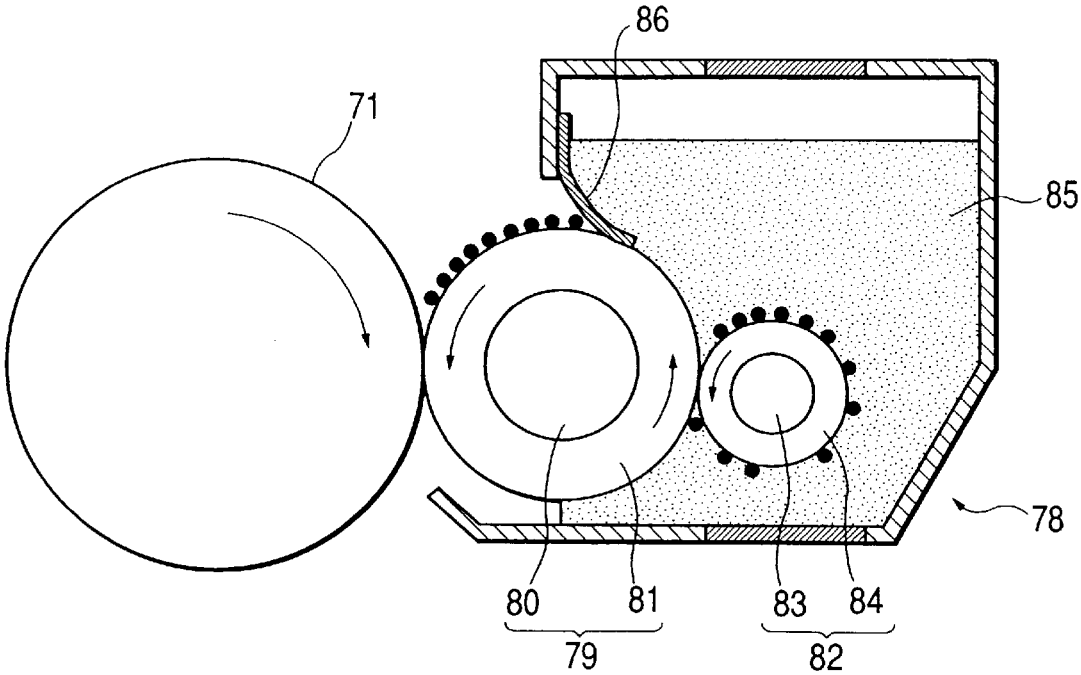
FIG. 9 is an enlarged cross-sectional view of a developing assembly of the image forming apparatus shown in FIGS. 7 and 8.

The developing assembly 78 is, as shown in FIG. 9, provided with a developing sleeve serving as the toner carrying member, which is an elastic roller 79 having a mandrel 80 to which a bias voltage is applied through a bias applying means 88 and an elastic layer 81, and the toner layer on the developing sleeve 79 comes into contact with the photosensitive drum 71. Inside the developing assembly 78, a toner coating roller 82 is provided which has a mandrel 83 to which a bias voltage is applied through a bias applying means 87 and an elastic layer 84. As a member for regulating the quantity of the toner transported while attracted onto the developing sleeve 79, a toner regulating blade 86 is provided so that the quantity (or layer thickness) of the toner transported to the developing zone can be controlled in accordance with a pressure at which the toner regulating blade 86 is brought into touch with the developing sleeve 79. In the developing zone, a DC development bias is applied at least to the developing sleeve 79, and the toner layer on the developing sleeve comes into contact with the photosensitive drum 71 surface and is moved onto the photosensitive drum 71 in accordance with the electrostatic latent image to form a toner image thereon.

When the photosensitive drum 71 has a light-area potential of from 0 to 250 V and a dark-area potential of from 300 to 1,000 V, a feed bias voltage applied from the bias applying means 87 may preferably be from 100 to 900 V and a development bias voltage applied from the bias applying means 88 may preferably be from 100 to 900 V.

The feed bias voltage applied from the bias applying means 87 may also preferably be 10 to 400 V, as an absolute value, higher than the development bias voltage applied from the bias applying means 88. This is preferable because the feeding of the non-magnetic toner 85 to the developing sleeve 79 and the stripping of the non-magnetic toner from the developing sleeve 79 can be made smooth.

In view of the feeding and stripping of the non-magnetic toner, it is preferable for the toner coating roller 82 to be rotated in the same direction as the rotational direction of the developing sleeve 79 so that both their surfaces move in the counter direction each other as shown in arrows in FIG. 9.

In the image forming apparatus shown in FIGS. 7 and 8, the transfer residual toner not transferred in the transfer step and present on the surface of the electrostatic latent image bearing member is removed by bringing the cleaning member into contact with the surface of the electrostatic latent image bearing member. Another image forming method employing what is called "cleaning-at-development system", in which the cleaning for removing the transfer residual toner is simultaneously performed at the time of development in the developing step, is also one of preferred embodiments.

This cleaning-at-development system does not have any cleaning member provided in contact with the surface of the electrostatic latent image bearing member between the transfer zone and the charging zone and between the charging zone and the developing zone for removing the transfer residual toner present on the surface of the electrostatic latent image beating member (photosensitive member).

The charge of the transfer residual toner may change greatly also in accordance with transfer bias conditions and transfer medium resistance. As the transfer bias, a voltage having a polarity reverse to the charge polarity of the toner is commonly applied. In the case when the development is regular development (the toner charge polarity is opposite to the photosensitive member charge polarity) and when the transfer medium is one having a high resistance, such as cardboards and OHP films, toner particles having a high charge go forward to the cleaning step while kept at that charge polarity, without being transferred because of their strong adhesion to the photosensitive member, and hence the photosensitive member tends not to be completely cleaned.

Accordingly, the charge of the toner having participated in development on the photosensitive member may preferably be controlled to an appropriate quantity so that any toner originally having a high charge quantity does not participate in development on the photosensitive member.

In order for the toner with a high charge quantity not to participate in development on the photosensitive member, it is necessary to control the charging of the toner or the charging performance of the toner. However, insufficient charging of the toner tends to cause problems such as toner scatter and a lowering of transfer performance of the toner.

In the toner according to the present invention, since the compound represented by Formula (A) is incorporated in toner particles, it has become possible to restrain toner particles from being excessively charged and to provide the toner with an appropriate charge quantity. Thus, the toner exhibits a stable performance with a superior running performance also in the developing step.

On the other hand, in the case where the development is reversal development (the toner charge polarity is the same polarity as the photosensitive member charge polarity), if the transfer medium is one readily passing through electric fields, such as thin paper, toner particles are strongly charged in a reverse polarity by transfer bias, and the toner particles strongly charged in a reverse polarity have a strong adhesion to the photosensitive member, and hence the photosensitive member tends not to be completely cleaned.

To solve this problem, the toner incorporated with the compound represented by Formula (A) is used in the present invention, thus it has become possible to restrain toner particles from being excessively reverse-charged. In addition, the use of the toner incorporated with the compound represented by Formula (A) according to the present invention makes it easy to control the toner charge quantity affected by transfer bias.

The reason therefor is not necessarily clear, and is presumed according to findings by the present inventors that the compound represented by Formula (A) prevents a charge-up phenomenon, in which the toner is excessively charged in a high quantity, and also makes it hard for toner particles to hold any excessive reverse charge even when an electric field reverse to the charge polarity of the toner is applied in the transfer step.

The principle of the cleaning-at-development system is that the charge polarity and charge quantity of the toner on the photosensitive member are controlled in the respective steps in electrophotography and that a reversal development system is employed.

It will be described by giving an example. When a negatively chargeable photosensitive member and a negatively chargeable toner are used, an image rendered visible is transferred to a transfer medium in the transfer step by means of a transfer member having a positive polarity, where the charge polarity of the transfer residual toner varies from positive up to negative according to the relation between the types of transfer mediums (differences in thickness, resistance and dielectric constant) and the area of images. However, the charging member having a negative polarity, used to charge the negatively chargeable photosensitive member, can uniformly adjust the charge polarity to the negative side even if the polarity of the transfer residual toner has been shifted to the positive side in the transfer step together with that of the photosensitive member surface. Hence, when the reversal development is employed as the developing system, the transfer residual toner, which stands negatively charged, remains at light-area potential portions to be developed, even though toner particles uniformly charged in negative polarity at the time of development are present on the photosensitive member surface. At dark-area potential portions not to be developed, the toner is attracted toward the toner carrying member due to the development electric field and does not remain thereon.

However, in an attempt to form images at a higher process speed by the use of the cleaning-at-development system, it is difficult to charge the photosensitive member surface by means of the charging member and also to uniformly adjust the charge polarity of the transfer residual toner, in correlation with a decrease in charging time per unit area of the photosensitive member. Hence, when the reversal development is used as a development system, the transfer residual toner present on the toner's dark-area potential portions not to be developed can be attracted to the toner carrying member, and is hard to collect by the aid of the development electric field. Moreover, even if it has been collected on the toner carrying member by mechanical force such as rubbing, the transfer residual toner, unless its charge is not uniformly adjusted, may adversely affect the charging performance of the toner present on the toner carrying member, to cause a lowering of developing performance.

The image forming method employing the cleaning-at-development system is established by controlling the charge polarity of the transfer residual toner simultaneously with the charging of the photosensitive member. However, when the image forming method employing the cleaning-at-development system is used in the formation of images at such a higher process speed, it is hard for the charge polarity of the transfer residual toner to be controlled, tending to cause faulty collection at development. Also, since the development itself is performed at a higher seed, there is a problem that the charge of the transfer residual toner collected at the developing step may more greatly affect the developing performance to cause a lowering of developing performance.

In addition, when the image forming method employing the cleaning-at-development system is used in the formation of images at a high process speed, faulty charging tends to occur because of contamination of the charging member.

Studies made by the present inventors have revealed that, when the image forming method employing the cleaning-at-development system is used in the formation of images at a high process speed of 120 mm/sec or above, or further 150 mm/sec or above, as the process speed of a developing roller, the control of charge polarity must be made more quickly in order to improve transfer residual toner collection performance at the time of development, and, in order to keep developing performance, the control of charge polarity of the transfer residual toner must be made more surely and uniformly when it passes through the charging member.

Especially in the so-called contact charging, in which the charging member is brought into contact with the photosensitive member to charge it, its charging mechanism utilizes electric discharge according to the Paschen's law, where the adhesion of toner to the charging member may seriously occur which is caused by the facts that the charging member comes into contact with the photosensitive member and the energy of electric discharge deteriorates the toner.

In the cleaning system in which the transfer residual toner is removed from the surface of the photosensitive member by means of a cleaning member such as a blade or a fur brush, none of studies have ever been made in consideration of any influence on the charging of the toner present on the photosensitive member, the performance of its collection to the developing assembly and the developing performance of the toner collected to and reused in the developing assembly.

Accordingly, the present inventors have made extensive studies on various toners, and have discovered that, in the image forming method employing the cleaning-at-development system, the performance of charge control at the time the toner passes through the charging member is closely concerned with the running performance and image quality characteristics, and have discovered especially that the incorporation of the compound represented by Formula (A) into the toner brings about an improvement in the performance of charge control at the time the toner passes through the charging member.

EXAMPLES

The present invention will be specifically described below by giving production examples and working examples. These by no means limit the present invention. In the following formulation, "part(s)" refers to "part(s) by weight" in all occurrences.

Toner Production

Example 1

Into a 2-liter four-necked flask having a high-speed stirrer TK-type homomixer (manufactured by Tokushu Kika Kogyo), 710 parts of ion-exchanged water and 450 parts of an aqueous 0.1 mol/liter $Na_3PO_4$ solution were introduced, and the mixture was heated to 60° C. with stirring by means of the high-speed stirrer at a number of revolution adjusted to 10,000 rpm. Then, 68 parts of an aqueous 1.0 mol/liter $CaCl_2$ solution was added thereto slowly to prepare an aqueous dispersion medium containing fine-particle slightly water-soluble dispersion stabilizer $Ca_3(PO_4)_2$.

| | |
|---|---|
| Styrene monomer | 165 parts |
| n-Butyl acrylate monomer | 35 parts |
| Divinylbenzene monomer | 0.5 part |
| Colorant (carbon black: bulk density: 370 g/cm$^3$) | 14 parts |
| Saturated polyester resin (terephthalic acid-propylene oxide modified bisphenol A; acid value: 15 mg KOH/g) | 10 parts |
| Charge control agent (compound No. 1) | 2 parts |
| Wax (ester compounds; m.p.: 70° C.) | 20 parts |

Meanwhile, the above materials were dispersed for 3 hours by means of an attritor (manufactured by Mitsui Mining & Smelting Co., Ltd.), followed by addition of 10 parts of a polymerization initiator 2,2'-azobis(2,4-dimethylvaleronitrile) to obtain a polymerizable monomer composition, which was then put into the above aqueous dispersion medium to carry out granulation while maintaining the number of revolution of the high-speed stirrer at 10,000 rpm. Thereafter, the reaction was carried out at 70° C. for 2 hours with stirring by means of paddle stirring blades, and thereafter polymerization was carried out at 90° C. for 10 hours.

After the reaction was completed, the suspension obtained was cooled, and diluted hydrochloric acid was added thereto to remove the slightly water-soluble dispersion stabilizer, followed by filtration, water washing and drying, and further followed by air classification to classify particles to the desired particle size, thus colored particles (A) were obtained.

To 100 parts by weight of the colored particles (A), 1.5 parts of a hydrophobic fine silica powder (BET specific surface area: 250 m$^2$/g) was dry-process mixed by means of a Henschel mixer (manufactured by Mitsui Mining & Smelting Co., Ltd.) to obtain toner (A) of the present invention.

In particle size distribution of the toner (A) as measured with Coulter Counter Multisizer (manufactured by Coulter Co.), its weight-average particle diameter (D4) was 6.8 $\mu$m, number-average particle diameter (D1) was 5.4 $\mu$m, coefficient of variation was 26, and fine-powder content (the proportion of presence of 4.00 $\mu$m or smaller particles in number distribution) was 16% by number. Its shape factors SF-1 and SF-2 were 120 and 115, respectively, and the value of (SF-2)/(SF-1) was 0.96.

Measurement with a flow type particle image analyzer FPIA-1000 (manufactured by Toa Iyou Denshi K.K.) revealed that the toner had an average circularity ($\bar{c}$) of 0.976 and a circularity standard deviation (SDc) of 0.031. The proportion of particles having a circularity of less than 0.950 was 13% by number.

The quantity of triboelectricity of the toner (A) was also measured to find to be −45 mC/kg.

In the present invention, the quantity of triboelectricity of the toner was measured by suction gauging. First, 0.5 g of the toner and 9.5 g of a carrier (EFV-200/300, available from Powder Teck Co.) were weighed out. These were put in a polyethylene container, and left for 2 days in a measuring environment (23° C./60% RH). Thereafter, the container was hermetically stoppered, and shaked 50 times to prepare a toner-carrier mix sample.

Figure 12:
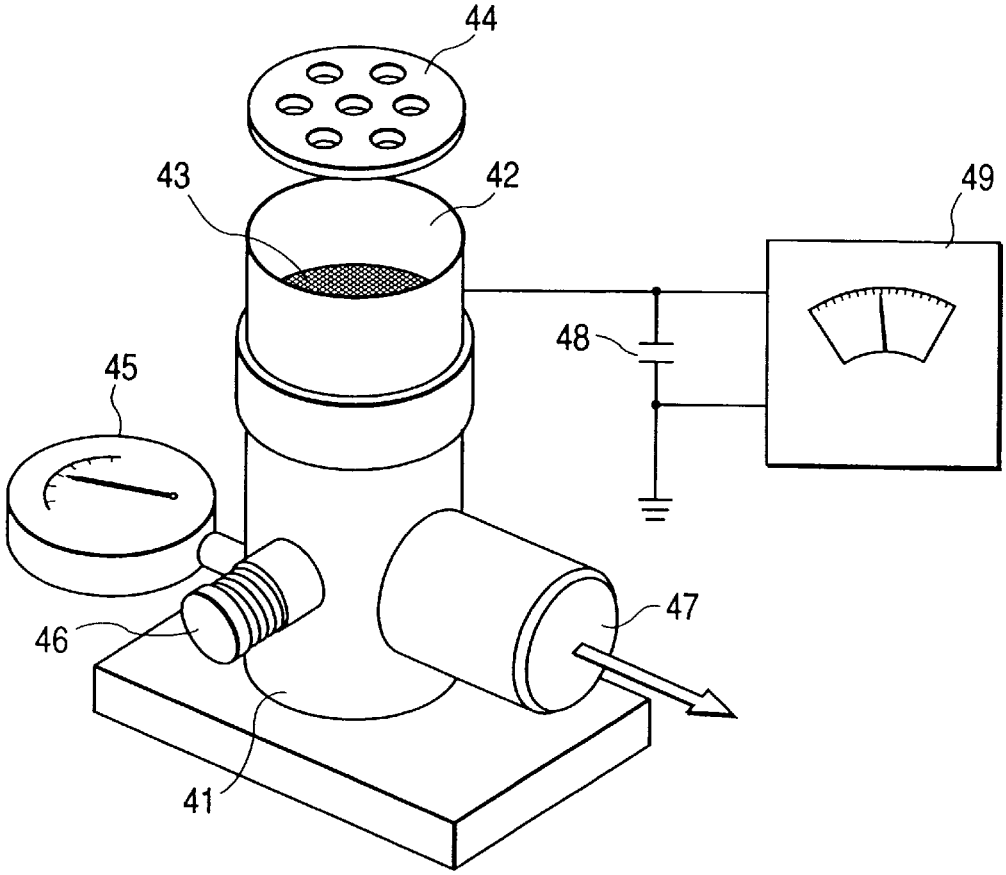
FIG. 12 is a perspective view of a device for measuring the quantity of triboelectricity of toners, used in the present invention.

A charge quantity measuring device used in the present invention is shown in FIG. 12. In its measuring container 42 made of a metal and provided at the bottom thereof a conductive screen 43 of 500 meshes, having such an opening diameter that can capture the carrier and remove only the toner by suction, 1.0 to 1.2 g of the above mix sample are weighed out and put, and the container is covered with a plate 44 made of a metal. Next, using a suction device connected with the measuring container 42 via an insulating portion, the sample is sucked for 1 minute from a suction opening 47 by operating an air-flow control valve 46 to control the pressure indicated by a vacuum indicator 45 to be 250 mm$H_2O$. Here, the charge quantity calculated from the voltage value V (V) indicated by a potentiometer 49 and from the electrostatic capacity C ($\mu$F) of a capacitor 48 is divided by the weight W (g) of the toner having been removed by suction, and the value obtained is regarded as quantity of triboelectricity (mC/kg).

$$\text{Quantity of triboelectricity (mC/kg)} = CV/W$$

The state of the wax contained in toner particles of the toner (A) was observed by TEM to confirm that it was encapsulated in substantially a spherical form in such a state that it does not dissolve in the binder resin and vice versa as diagrammatically shown in FIG. 10A, and the value of $(r/R)_{st}$ was 0.62.

7 parts of the toner (A) and 93 parts of a resin-coated magnetic ferrite carrier (average particle diameter: 45 $\mu$m) were blended, thus a two-component developer (A) was also prepared.

Toner Production

Examples 2 to 4

Toners (B) to (D) and two-component developers (B) to (D) were obtained in the same manner as in Toner Production Example 1 except that the compound No. 1 and the carbon black were replaced with charge control agents and colorants, respectively, shown in Table 3.

Toner Production

Example 5

Styrene-butyl acrylate copolymer resin (glass transition temperature: 70° C.) 100 parts

| | |
|---|---|
| Colorant (carbon black used in Toner Production Example 1: bulk density: 370 g/cm$^3$) | 5 parts |
| Charge control agent (compound No. 1) | 1 part |
| Wax (low molecular weight polypropylene; m.p.: 125° C.) | 4 parts |

The above materials were mixed, and melt-kneaded by means of a twin-screw extruder. The kneaded product obtained was cooled and thereafter crushed using a hammer mill. The resultant crushed product was pulverized by means of a jet mill, and the particles obtained were further heated and made spherical, followed by classification to obtain colored particles (E).

To 100 parts by weight of the colored particles (E), 1.5 parts of a hydrophobic fine silica powder treated with hexamethyldisilazane (BET specific surface area: 200 $m^2/g$) was dry-process mixed by means of a Henschel mixer to obtain toner (E).

The wax in toner particles of the toner (E) was found to be dispersed in a finely dispersed state, and the value of $(r/R)_{st}$ was 0.01 or below.

7 parts of the toner (E) and 93 parts of a resin-coated magnetic ferrite carrier (average particle diameter: 45 $\mu$m) were blended, thus a two-component developer (E) was also prepared.

Toner Production

Examples 6 and 7

Toners (F) and (G) and two-component developers (F) and (G) were prepared in the same manner as in Toner Production Example 1 except that the compound No. 1 was used in an amount of 0.2 part and 7.0 parts, respectively.

Toner Production

Comparative Example 1

Comparative toner (a) and comparative two-component developer (a) were obtained in the same manner as in Toner Production Example 5 except that the treatment to make the particles spherical by heating was not made.

Toner Production

Comparative Example 2

Comparative toner (b) and comparative two-component developer (b) were obtained in the same manner as in Toner Production Example 1 except that the compound No. 1 was replaced with 2 parts of an iron complex salt of salicylic acid and the wax was replaced with 4 parts of an acid-modified polypropylene wax (m.p.: 125° C.).

The formulation of toner and various properties of toner in each Production Example are shown in Table 3 (as Table 3A–3B).

Examples 1 to 7 &

Comparative Examples 1, 2

In these Examples and Comparative Examples, the image forming apparatus as shown in FIG. 2 was used. As the developing assembly, the one shown in FIG. 3 was used.

The photosensitive drum 1 comprises a substrate la and provided thereon a photosensitive layer 1*b* having an organic photo-semiconductor, and is rotated in the direction of an arrow. By means of the charging roller 2 (the conductive elastic layer 2*a* and the mandrel 2*b*) facing the photosensitive drum 1 and rotating in contact with it, the surface of the photosensitive drum 1 is electrostatically charged to have a surface potential of about −600 V. Exposure 3 is carried out using a polygon mirror by on-off control on the photosensitive drum 1 in accordance with digital image information, whereby an electrostatic latent image with an exposed-area potential of −100 V and a dark-area potential of −600 V is formed. Using the developing assembly 4-1, a toner image is formed on the photosensitive drum 1 by reversal development. The toner image is transferred to the intermediate transfer member 5 (the elastic layer 5*a* and the mandrel 5*b* as a support). The toner remaining on the photosensitive drum 1 after transfer is collected in a residual toner container 9 by means of a cleaning member 8.

The intermediate transfer member 5 is comprised of the pipe-like mandrel 5*b* and the elastic layer 5*a* provided thereon by coating, formed of nitrile-butadiene rubber (NBR) in which carbon black conductivity-providing agent has been well dispersed. The elastic layer 5*a* thus formed has a hardness according to JIS K-6301, of 30 degrees and a volume resistivity of $10^9$ Ω·cm. Transfer electric current necessary for the transfer from the photosensitive drum 1 to the intermediate transfer member 5 was about 5 $\mu$A, which was obtained by applying a voltage of +500 V to the mandrel 5*b* from a power source.

The transfer roller 7 has an external diameter of 20 mm, and has an elastic layer 7*a* formed by coating on a mandrel 7*b* of 10 mm diameter, a foamable material of an ethylene-propylene-diene terpolymer (EPDM) in which carbon black conductivity-providing agent has been well dispersed. As the elastic layer 7*a*, the one showing a volume resistivity of $10^6$ Ω·cm and a hardness according to JIS K-6301, of 35 degrees was used. A voltage was applied to the transfer roller to flow a transfer current of 15 $\mu$A.

In the heat fixing assembly H, a fixing assembly of a hot-roll type having no function of oil application was used. Here, as both the upper roller and the lower roller, those having surface layers of fluorine resin were used, having roller diameter of 60 mm. The fixing temperature was set at 160° C., and the nip width at 7 mm.

Under the above conditions, a 10,000-sheet printing test was made in an environment of normal temperature and normal humidity (25° C., 60% RH) at a printing rate of 12 sheets(A4-size)/minute in a monochromatic intermittent mode (i.e., a mode in which the developing assembly was made to pause for 10 seconds every time the images were printed on one sheet so that the deterioration of the toner was accelerated by preliminary operation of the developing assembly when again driven) while successively supplying each of the two-component developers (A) to (G) and the comparative two-component developers (a) and (b). Then, evaluation on printed images thus obtained was made in respect of the items shown later.

At the same time, the matching of the above developers to the image forming apparatus used was also evaluated.

The transfer residual toner collected by cleaning was transported to the developing assembly through the reuse mechanism, and reused.

The results of the above evaluation are shown in Table 4.

Examples 1 to 4 show especially good results on the matching to image forming apparatus. With regard to the reasons therefor, the present inventors consider that in the present invention the shape distribution of toner and the internal structure of toner have precisely been controlled, and hence the following two points have cooperatively acted, one being that the superior charge-providing ability the charge control agent according to the present invention has can readily be exhibited and the other being that the toner of the present invention has restrained image forming apparatus from contamination.

Example 8

In the present Example, a reuse mechanism was attached to a commercially available laser beam printer LBP-EX (manufactured by CANON INC.) to remodel the printer, which was again set up and used. As a primary charging roller, a rubber roller (diameter: 12 mm; contact pressure: 50 g/cm) in which conductive carbon was dispersed, and covered with a nylon resin, was used. On the electrostatic latent image bearing member (photosensitive drum), a dark-area potential $V_D$ of −700 V and a light-area potential $V_L$ of −200 V were formed by laser exposure (600 dpi). As the toner carrying member, a developing sleeve whose surface was coated with a resin having carbon black dispersed therein and had a surface roughness Ra of 1.1 was used, where its surface movement speed was so set as to be 1.1 times the movement speed of the photosensitive drum surface, and then the gap (S-D distance) between the photosensitive drum and the developing sleeve was set at 270 μm. As the toner regulation member, a blade made of urethane rubber was used in contact with the developing sleeve. As the development bias, a bias formed by superimposing an AC bias component on a DC bias component was used. The fixing temperature of the heat-fixing assembly was set at 150° C.

Under the above conditions, a 5,000-sheet printing test was made in an environment of high temperature and high humidity (30° C., 80% RH) at a printing rate of 12 sheets (A4-size)/minute in an intermittent mode (i.e., a mode in which the developing assembly was made to pause for 30 minutes every time the images were printed on 100 sheets so that the deterioration of the toner was accelerated by preliminary operation of the developing assembly when again driven) while successively supplying the toner (A). Then, the printed images thus formed were evaluated to obtain good image reproduction results that the image density was good and stable and image fog little occurred.

The matching of the above toner to the image forming apparatus was also good.

Example 9

In an environment of normal temperature and normal humidity (25° C., 60% RH), evaluation was made in the same manner as in Examples 1 to 7 except that the developing assembly of the image forming apparatus, shown in FIG. 3, was replaced with the one shown in FIG. 4, the movement speed of the toner carrying member surface was so set as to be 3.0 times the movement speed of the electrostatic latent image bearing member surface, and images were printed in a monochromatic intermittent mode (i.e., a mode in which the developing assembly was made to pause for 1 minutes every time the images were printed on one sheet so that the deterioration of the toner was accelerated by preliminary operation of the developing assembly when again driven) while successively supplying the toner (A).

The toner carrying member used here had a surface roughness Ra of 1.5, and the toner regulation blade used was the one comprising a phosphor bronze base plate to which urethane rubber was bonded and the side coming into contact with the toner carrying member of which was coated with nylon. Also, in the heat fixing assembly H, a fixing assembly shown in FIGS. 5 and 6 was used. The surface temperature of a temperature detector 31*d* of a heating element 31 (31*a*: heater substrate; 31*b*: heating element; 31*c*: surface protective layer; 31*d*: temperature detector) was set at 140° C., the total pressure between the heating element 31 and a spongy pressure roller 33 having a foam of silicon rubber in its lower layer was set to be 8 kg, and the nip between the pressure roller and a fixing film 32 was set to be 6 mm. As a fixing film 32, a 60 μm thick heat-resistant polyimide film was used which had on its side coming into contact with the transfer medium a low-resistance release layer formed of PTFE (of a high-molecular-weight type) having a conductive material dispersed therein. The results of evaluation are summarized in Table 5.

Example 10

Using the image forming apparatus shown in FIG. 2, the two-component developers (A) to (D) were put into the respectively corresponding developing assemblies 4-1, 4-2, 4-3 and 4-4. Full-color images were reproduced in an environment of 25° C. and 60% RH at a printing speed of 3 sheets(A4-size)/minute, and images formed were evaluated. As a result, the matching to the developing sleeve, photosensitive drum, intermediate transfer member and fixing assembly was good, and full-color images having good image characteristics were rerpoduced.

The evaluation items stated in Examples and Comparative Examples and their evaluation criteria are as described below.

Printed-Image Evaluation (1) Image density:

Evaluated on how image density was maintained when images were printed on a prescribed number of sheets of usual plain paper (75 g/m$^2$) for copying machines. The image density was measured with MACBETH REFLECTION DENSITOMETER (manufactured by Macbeth Co.), as relative density with respect to an image printed on a white ground area with a density of 0.00 of an original.

A: 1.40 or more.
B: From 1.35 to less than 1.40.
C: From 1.00 to less than 1.35.
D: less than 1.00.

(2) Image fog:

Fog density (%) was calculated from a difference between the whiteness at a white background area of images and the whiteness of the recording medium to make evaluation on image fog, which was measured with REFLECTOMETER (manufactured by Tokyo Denshoku Co., Ltd.).

A: Less than 1.5%.
B: From 1.5% to less than 2.5%.
C: From 2.5% to less than 4.0%.
D: More than 4.0%.

Figure 13A:
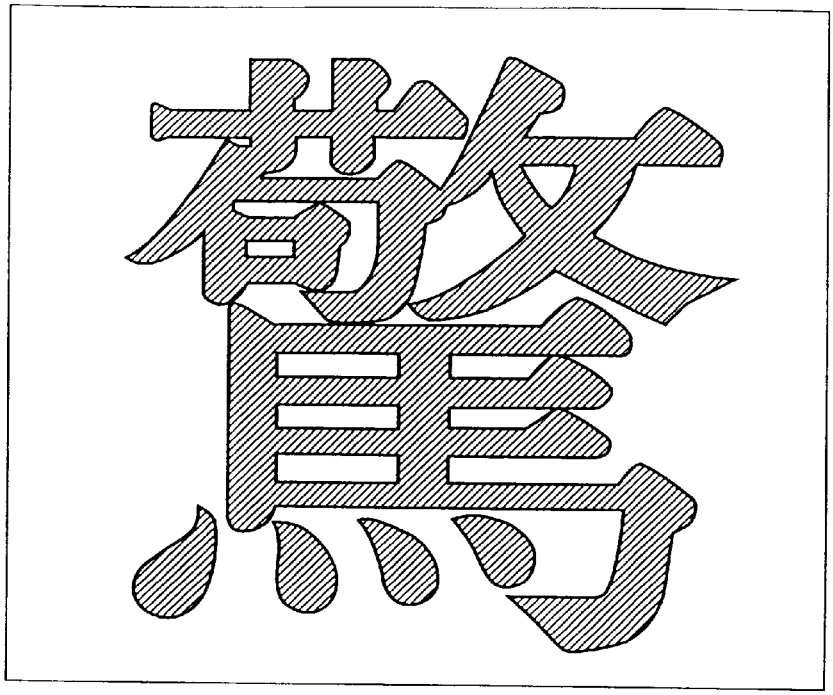
FIGS. 13A and 13B diagrammatically illustrate the state of blank areas caused in character images.
Figure 13B:
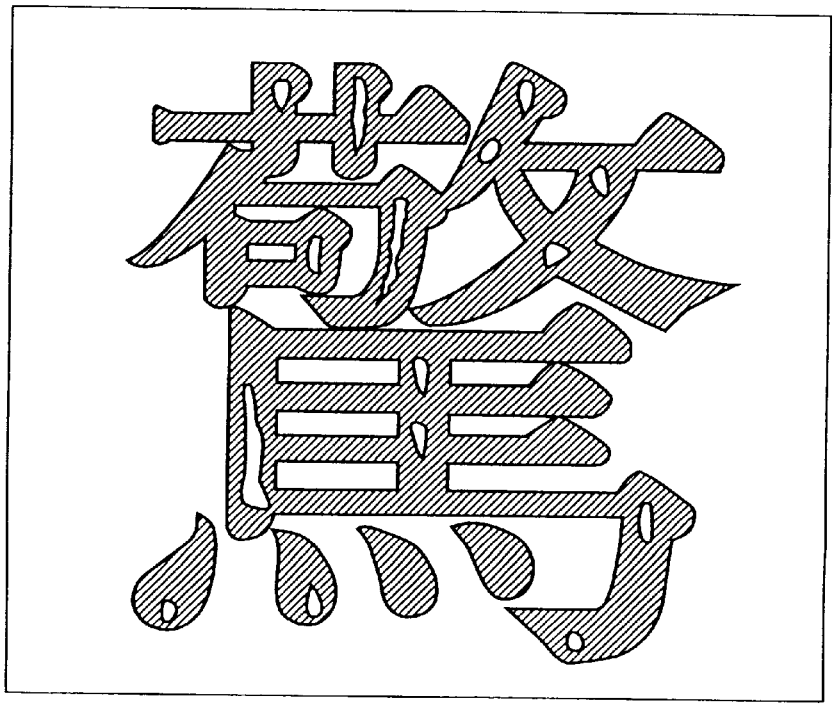

(3) Image blank areas:

A character pattern as shown in FIG. 13A was printed on a cardboard, where evaluation was visually made by examining any blank areas (the state shown in FIG. 13B) in character areas.

A: Blank areas little occur.
B: Slight blank areas are seen.
C: Blank areas are a little seen.
D: Conspicuous blank areas are seen.

Evaluation on Matching to Image Forming Apparatus (1) Matching to developing sleeve:

After the printing test was finished, evaluation was visually made by examining any sticking of the toner remaining on the developing sleeve surface and how it affects printed images.

A: No sticking occurs.
B: Sticking little occurs.
C: Sticking is a little seen, but less affects images.
D: Sticking is greatly seen, and uneven images occur.

(2) Matching to photosensitive drum:

After the printing test was finished, evaluation was visually made by examining any scratches on the photosensitive drum surface and any sticking of the toner remaining thereon, and how they affect printed images A: None of them occurs.
B: Scratches are seen to slightly occur, but do not affect images.
C: Sticking and scratches are seen, but less affect images.
D: Sticking is greatly seen, and faulty images occur as vertical lines.

(3) Matching to intermediate transfer member:

After the printing test was finished, evaluation was visually made by examining any scratches on the intermediate transfer member surface and any sticking of the toner remaining thereon.

A: None of them occurs.

B: Scratches are seen to slightly occur, but do not affect images.

C: Sticking and scratches are seen, but less affect images.

D: Sticking is greatly seen, and faulty images occur as vertical lines.

(4) Matching to fixing assembly:

After the printing test was finished, evaluation was visually made by examining any scratches on the fixing roller or fixing film surface and any sticking of the toner remaining thereon.

A: None of them occurs.

B: Little occur.

C: Sticking and scratches are seen, but less affect images.

D: Sticking is greatly seen, and faulty images occur as vertical lines.

Toner Production

Example 8

Into a 2-liter four-necked flask having a high-speed stirrer KUREA MIX (manufactured by Emu Technique Co.), 700 parts of ion-exchanged water and 800 parts of an aqueous 0.1 mol/liter $Na_3PO_4$ solution were introduced, and the mixture was heated to 65° C. with stirring by means of the high-speed stirrer at a number of revolution set to 15,000 rpm. Then, 70 parts of an aqueous 1.0 mol/liter $CaCl_2$ solution was added thereto to prepare an aqueous dispersion medium containing fine-particle slightly water-soluble dispersion stabilizer $Ca_3(PO_4)_2$. The aqueous dispersion medium was reprepared by adding diluted hydrochloric acid so that the pH of the aqueous dispersion medium becomes 5.0.

Meanwhile, as a dispersoid, the following was used.

| | |
|---|---|
| Styrene monomer | 77 parts |
| 2-Ethylhexyl acrylate monomer | 23 parts |
| Divinylbenzene monomer | 0.2 part |
| Colorant (carbon black: volatile: 1.0%) | 5 parts |
| Polycarbonate resin (peak molecular weight: 7,500) | 5 parts |
| Charge control agent (compound No. 1) | 2 parts |
| Ester wax A | 7 parts |

The ester wax A, and ester wax B used in Toner Production Example 12 described later were produced from the following long-chain alkylcarboxylic acids and long-chain alkyl alcohols. Physical properties of the ester waxes A and B are shown in Table 6.

Long-chain alkylcarboxylic acid components:

Palmitic acid ($C_{16}H_{32}O_2$)

Stearic acid ($C_{18}H_{36}O_2$)

Arachidic acid ($C_{20}H_{40}O_2$)

Behenic acid ($C_{22}H_{44}O_2$)

Lignoceric acid ($C_{24}H_{48}O_2$)

Long-chain alkyl alcohol components:

Palmityl alcohol ($C_{16}H_{34}O$)

Stearyl alcohol ($C_{18}H_{38}O$)

Arachidyl alcohol ($C_{20}H_{42}O$)

Behenyl alcohol ($C_{22}H_{46}O$)

The above materials were dispersed for 3 hours by means of an attritor, followed by addition of 7 parts of 2,2'-azobis (2,4-dimethylvaleronitrile) to prepare a polymerizable monomer composition.

Next, the polymerizable monomer composition was put into the above aqueous dispersion medium to carry out granulation with stirring for 15 minutes in an atmosphere of $N_2$ and internal temperature of 70° C. and while maintaining the number of revolution of the high-speed stirrer at 15,000 rpm. Thereafter, the stirrer was replaced with a stirrer having paddle stirring blades, and the same temperature was maintained while stirring the system at 80 rpm. At the time the polymerization conversion of the polymerizable monomer composition reached 93%, an aqueous 0.1 mol/liter NaOH solution was added to change the pH of the aqueous dispersion medium to 12. The reaction temperature was further raised to 80° C., and the polymerization reaction was completed at the time the polymerization conversion reached nearly 100%.

After the polymerization was completed, residual monomers were evaporated off under reduced pressure, and then, after cooling, diluted hydrochloric acid was added thereto to dissolve the slightly water-soluble dispersion stabilizer. Washing with water was further repeated several times, followed by drying by means of a conical ribbon dryer (manufactured by Ohkawara Seisakusho), thus colored particles (H) were obtained.

100 parts by weight of the colored particles (H) and 2 parts of a hydrophobic oil-treated fine silica powder (BET specific surface area: 200 $m^2/g$) were dry-process mixed by means of a Henschel mixer (manufactured by Mitsui Mining & Smelting Co., Ltd.) to obtain toner (H) of the present invention.

In particle size distribution of the toner (H), its weight-average particle diameter (D4) was 6.5 $\mu$m, coefficient of variation was 21, and fine-powder content was 10% by number. Its shape factors SF-1 and SF-2 were 113 and 111, respectively, and the value of (SF-2)/(SF-1) was 0.98. In its circularity frequency distribution, the average circularity was 0.985 and the circularity standard deviation was 0.026. The proportion of particles having a circularity of less than 0.950 was 3% by number.

The state of the wax contained in toner particles of the toner (H) was observed by TEM to confirm that it was encapsulated in substantially a spherical form in such a state that it does not dissolve in the binder resin and vice versa as diagrammatically shown in FIG. 11A, and the value of $(r/R)_{st}$ was 0.43.

Toner Production

Examples 9 to 14

Colored particles (I) to (N) were produced and then toners (I) to (N) of the present invention were prepared in the same manner as in Toner Production Example 8 except that the types and amount of the charge control agent, colorant and wax and the pH of the aqueous dispersion medium at the time of the polymerization reaction were changed.

Toner Production

Comparative Examples 3 and 4

Comparative colored particles (c) and (d) were produced in the same manner as in Toner Comparative Production Example 1 except that the types of the charge control agent, colorant and wax were changed.

100 parts by weight of each of the comparative colored particles (c) and (d) and 2 parts of a hydrophobic oil-treated fine silica powder (BET specific surface area: 200 $m^2/g$) were dry-process mixed by means of a Henschel mixer to obtain comparative toners (c) and (d), respectively.

Toner Production

Comparative Example 5

Comparative colored particles (e) were produced and then comparative toner (e) was prepared in the same manner as in Toner Production Example 8 except that 2 parts of a boron complex of salicylic acid was used as the charge control agent, 4 parts of modified polyethylene wax (m.p.: 115° C.) was used as the wax, and the pH of the aqueous dispersion medium at the time of polymerization reaction was made constant.

Toner formulation and production conditions in each Toner Production Example are shown in Table 7, and various properties of the tones obtained are shown in Table 8.

Photosensitive Drum

Production Example

An aluminum cylinder of 30 mm diameter and 254 mm long was used as a substrate, and layers with configuration as shown below were successively formed thereon in layers by dip coating. Thus, photosensitive drum (1) was produced.

(1) Conductive coating layer: Mainly composed of powders of tin oxide and titanium oxide dispersed in phenol resin. Layer thickness: 15 μm.

(2) Subbing layer: Mainly composed of a modified nylon and a copolymer nylon. Layer thickness: 0.6 μm.

(3) Charge generation layer: Mainly composed of an azo pigment having absorption in long wavelength range, dispersed in butyral resin. Layer thickness: 0.6 μm.

(4) Charge transport layer: Mainly composed of a hole-transporting triphenylamine compound dissolved in polycarbonate resin (molecular weight: 20,000 as measured by Ostwald viscometry) in weight ratio of 8:10, and in which polytetrafluoroethylene powder (average particle diameter: 0.2 μm) was further added in an amount of 10% by weight based on the total solid content and uniformly dispersed. Layer thickness: 25 μm.

The contact angle to water of the surface of Photosensitive Drum (1) thus obtained was 95 degrees.

The contact angle was measured using pure water and using a contact angle meter Model CA-DS, manufactured by Kyowa Kaimen Kagaku K.K.

Example 11

As an image forming apparatus, a 600 dpi laser beam printer LBP-8 Mark IV (manufactured by CANON INC.) was made ready for testing. This apparatus was remodeled, images were printed at a process speed of 80 mm/sec and on 12 sheets per minute as LTR (letter) size paper. As shown in FIG. 7, this apparatus has the following process: The surface of the photosensitive member 56 (30 mm diameter) is uniformly charged using the charging roller to which DC and AC components have been applied. Here, the DC component is controlled to a constant voltage and the AC component is controlled to a constant current. Subsequent to the charging, images areas are exposed to laser light 60 to form an electrostatic latent image, which is then made into a visible image by the use of the toner 50 to form a toner image, and thereafter the toner image is transferred to the transfer medium 58 by means of the transfer roller 57 to which a voltage has been applied.

Next, the developing assembly 52 of the process cartridge was also modified in the following way: In place of the toner feeding member aluminum sleeve internally provided with a magnet, a medium-resistance rubber roller (diameter: 16 mm) formed of silicone rubber whose resistance had been controlled by dispersing carbon black in it was used as the toner carrying member 54 and was brought into contact with the photosensitive member 56. The toner carrying member 54 was so driven that the movement of its surface was in the same direction as that of the surface of the photosensitive member 56 at the former's part coming into contact with the latter and its rotational peripheral speed was 150% with respect to the rotational peripheral speed of the photosensitive member; i.e., the toner carrying member was rotated at a peripheral speed of 120 mm/sec, and at a relative peripheral speed of 40 mm/sec with respect to the surface of the photosensitive member.

As a means for coating the toner on the toner carrying member, the toner coating roller 55 was provided inside the developer container and was brought into contact with the toner carrying member. The toner coating roller 55 was so rotated that the movement direction of its surface was opposite to the movement direction of the surface of the toner carrying member at the contact part, and in this way the toner was coated on the toner carrying member. Also, for the purpose of coat layer control of the toner on the toner carrying member, a resin-coated blade 53 made of stainless steel was attached. As the cleaning member 59, a blade made of urethane rubber was used.

The photosensitive drum (1), produced in Photosensitive Drum Production Example 1, was used as the photosensitive member and the toner (H) was used as the toner. Process conditions were so set as to provide the following development conditions.

Photosensitive member dark-area potential: −700 V
Photosensitive member light-area potential: −150 V
Development bias: −450 V (DC component only)

A 2,000 sheet continuous printing test was made in an environment of normal temperature and normal humidity (25° C., 60% RH) while supplying the toner. Thereafter, the evaluation environment was changed to an environment of high temperature and high humidity (30° C., 80% RH) to make a further 3,000 sheet printing test, and printed images were evaluated. As a result, good results were obtained on all of image density, prevention of black spots around line images, prevention of image blank areas, prevention of fog, and dot reproducibility. Also, any faulty cleaning did not occur, and the image quality equal to that of initial stage was attained. After the printing test was completed, the surfaces of the developing roller, photosensitive member and fixing assembly were examined, but no melt-adhesion of toner was seen, and it was unnecessary to change them for new ones.

The results of evaluation are shown in Table 9.

Example 12

The procedure of Example 11 was repeated except the following.

The toner carrying member was so driven that the movement of its surface was in the same direction as that of the surface of the photosensitive member at the former's part coming into contact with the latter and its rotational peripheral speed was 200% with respect to that of the photosensitive member; i.e., the toner carrying member was rotated at a peripheral speed of 160 mm/sec, and at a relative peripheral speed of 80 mm/sec with respect to the surface of the photosensitive member.

Process conditions were so set as to fulfill the following development conditions.

Development bias: −500 V (DC component only)

A continuous printing test was made in the same manner as in Example 11. As a result, though slightly inferior to Example 11 because of severer conditions due to a higher process speed, good results were obtained on the whole. Any faulty cleaning also did not occur, and the image quality equal to that of initial stage was attained. After the printing test was completed, the surfaces of the developing roller, photosensitive member and fixing assembly were examined, but no melt-adhesion of toner was seen, and it was unnecessary to change them for new ones.

The results of evaluation are shown in Table 9.

Examples 13 to 18

Printing tests were made in the same manner as in Example 11 except for using the toners (I) to (N), respectively, as the toner. Evaluation was made similarly. As the result, as shown in Table 9, good results were obtained on the whole.

Comparative Examples 3 to 5

Printing tests were made in the same manner as in Example 11 except for using the comparative toners (c) to (e), respectively, as the toner. Evaluation was made similarly. The results of evaluation are shown in Table 9.

The evaluation items stated in Examples 11 to 18 and Comparative Examples 3 to 5 and their evaluation criteria are as described below.

Printed-Image Evaluation (1) Image density:

Evaluated according to the evaluation criteria for the image evaluation in Example 1.

(2) Spots around line images:

This is evaluation on spots around fine line images, concerning image quality of graphical images. Evaluation was visually made by examining the reproducibility of line images and any spots of toner around line images formed when one-dot line images tending to cause spots around line images than character images were printed on plane paper (75 g/m$^2$).

A: Spots around line images little occur, showing a good line reproducibility.

B: Very slight black spots around line images are seen.

C: Spots around line images are slightly seen, less affect line reproducibility.

D: Conspicuous black spots around line images are seen, showing a poor line reproducibility.

(3) Image blank areas:

Evaluated according to the evaluation criteria for the image evaluation in Example 1.

(4) Image fog:

Evaluated according to the evaluation criteria for the image evaluation in Example 1.

Figure 14:
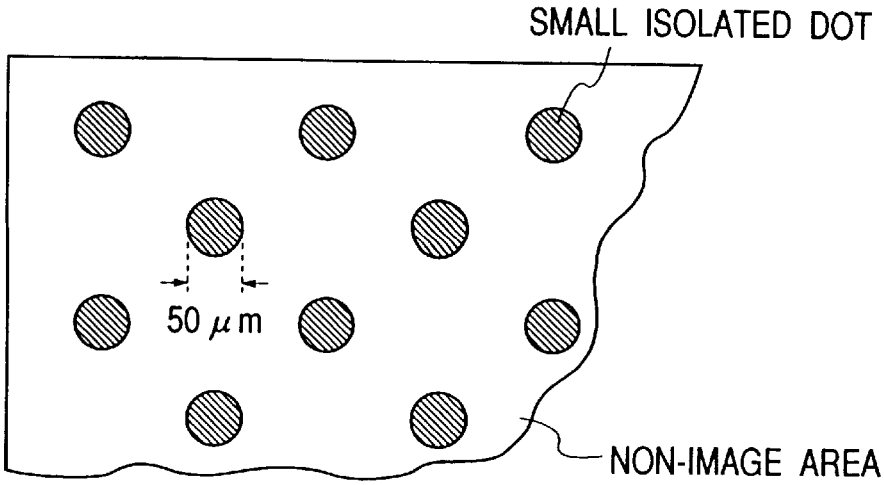
FIG. 14 illustrates an isolated-dot pattern used to evaluate dot reproducibility.

(5) Dot reproducibility:

Images of a pattern of isolated dots of small diameter (50 $\mu$m each) as shown in FIG. 14, which tend to form closed electric fields on account of latent image electric fields and are difficult to reproduce, were printed and the reproducibility of the dots was evaluated.

A: Missing dots are 2 or less per 100 dots.

B: Missing dots are 3 to 5 per 100 dots.

C: Missing dots are 6 to 10 per 100 dots.

D: Missing dots are 11 or more per 100 dots.

Evaluation on Matching to Image Forming Apparatus (1) Matching to developing roller:

After the printing test was finished, evaluation was visually made by examining any sticking of the toner to the developing roller surface and how it affects printed images.

A: No sticking occurs.

B: Contamination a little occurs, but sticking little occurs.

C: Sticking occurs, but less affect images.

D: Sticking greatly occurs, and uneven images occur.

(2) Matching to photosensitive member:

Evaluated according to the evaluation criteria for the matching evaluation in Example 1.

(3) Matching to fixing assembly:

Evaluated according to the evaluation criteria for the matching evaluation in Example 1.

Example 19

Images were formed in the same manner as in Example 11 except that, in the image forming apparatus used therein, the toner coating roller 55 in the developing assembly 52 was replaced with a sponge roller constituted of a single layer and a bias voltage was applied to the toner coating roller 55 from a bias applying means (not shown).

In this development, only a DC component of −300 V was applied as the development bias voltage to the developing roller 54, and only a DC component of −450 V was applied as the coating bias voltage to the toner coating roller 55.

Evaluation was made in the same manner as in Example 11. As a result, the image density and the prevention of image fog were both stable and good, any faulty cleaning did not occur, and good image quality was attained. The matching to image forming apparatus was also good.

Example 20

Images were formed by using the toner (H) in the developing assembly 4-4 of the image forming apparatus shown in FIG. 2.

In the image forming apparatus, as shown in FIG. 2, a cleaner having a cleaning member coming into contact with the photosensitive member surface as a first cleaning means for removing the toner remaining on the photosensitive member surface after primary transfer is provided between the primary-transfer zone and the charging zone where the photosensitive member is charged, and a cleaner having a cleaning member coming into contact with the intermediate transfer member surface as a second cleaning means for removing the toner remaining on the intermediate transfer member surface after secondary transfer is provided on the downstream side of the secondary-transfer zone and the downstream side of the primary-transfer zone.

As the developing assembly 4-4, a developing assembly constituted like the developing assembly 78 shown in FIG. 9 was used.

A medium-resistance rubber roller (diameter: 16 mm) formed of silicone rubber whose resistance had been controlled by dispersing carbon black in it was used as the toner carrying member 79 and was brought into contact with the photosensitive member surface. The toner carrying member 79 was so driven that the movement of its surface was in the same direction as that of the surface of the photosensitive member surface at the former's part coming into contact with the latter and its rotational peripheral speed was 150% with respect to the rotational peripheral speed of the photosensitive member. Namely, the toner carrying member was rotated at a peripheral speed of 120 mm/sec and at a relative peripheral speed of 80 mm/sec with respect to the surface of the photosensitive member.

As a means for coating the toner on the toner carrying member, a sponge roller constituted of a single layer was provided as the toner coating roller 82 and was brought into contact with the toner carrying member. The toner coating roller 82 was so rotated that the movement direction of its surface was opposite to the movement direction of the surface of the toner carrying member at the contact part, and in this way the toner was coated on the toner carrying member. Also, for the purpose of coat layer control of the toner on the toner carrying member, a resin-coated blade 86 made of stainless steel was attached.

The photosensitive drum (1), produced in Photosensitive Drum Production Example 1, was used as the photosensitive member. Image forming conditions were so set as to fulfill the following development and transfer conditions.

Photosensitive member dark-area potential: −700 V

Photosensitive member light-area potential: −150 V

Development bias applied to the toner carrying member: −450 V (DC component only)

Coating bias applied to the toner coating roller: −300 V (DC component only)

Transfer bias applied to the intermediate transfer member in the primary transfer step: 300 V (DC component only)

Transfer bias applied to the transfer roller in the secondary transfer step: 1,000 V (DC component only)

Under the above image forming conditions, toner images transferred to transfer mediums were heat-fixed to the recording mediums by means of the following heat fixing assembly.

As the heat fixing assembly H, a fixing assembly of a heat roll system having no function of oil application was used. Here, the fixing assembly used had fluorine resin surface layers on both the upper roller and the lower roller, and the rollers each had a diameter of 60 mm. The fixing temperature was set at 150° C., and the nip width in 7 mm.

Using the image forming apparatus constituted as described above, a 5,000 sheet continuous printing test was made. As a result, high-quality images with high density and free of image stains were obtained.

The matching to image forming apparatus was also good.

Example 21

As the image forming apparatus shown in FIG. 7, a 600 dpi laser beam printer LBP-860 (manufactured by CANON INC.) was made ready for testing. The printer was modified on the following points and remodeled into an apparatus employing the cleaning-at-development system.

From the process cartridge, the cleaning rubber blade was detached. The charging system was changed for the contact charging system in which a rubber roller is brought into contact, and a voltage of a DC component (−1,400 V) was applied, and the process speed was changed to 94 mm/sec. Correspondingly to the process speed made higher, conditions are set severer for uniform charging of the photosensitive member.

The photosensitive drum (1) was used as the photosensitive member.

Next, the developing part of the process cartridge was modified. A medium-resistance rubber roller (diameter: 16 mm; hardness: ASKER C 45 degrees; resistance: $10^5$ Ω·cm) formed of foamed urethane was used in place of the toner carrying member stainless steel sleeve, and was brought into contact with the photosensitive member. The toner carrying member was so driven that the movement of its surface was in the same direction as that of the surface of the photosensitive member at the former's part coming into contact with the latter and its rotational peripheral speed was 130% with respect to the rotational peripheral speed of the photosensitive member.

As a means for coating the toner on the toner carrying member, a toner coating roller was provided in contact with the toner carrying member in the developing part. Also, for the purpose of coat layer control of the toner on the toner carrying member, a resin-coated blade made of stainless steel was attached. The development bias applied to the toner carrying member at the time of development was changed to a DC component (−450 V) only.

The image forming apparatus was so modified and process conditions were so set as to fit such modification of the process cartridge.

With regard to the charge potential of the photosensitive member, its dark-area potential was set at −800 V, and light-area potential at −150 V. Paper of 75 g/$m^2$ in basis weight was used as transfer mediums.

Using the toner (H), character images with a printed area percentage of 4% were continuously printed on 100 sheets in an environment of normal temperature and normal humidity (25° C., 60% RH), and thereafter, images were evaluated and any image stains due to faulty charging were examined. As a result, good results were obtained on all of image density, prevention of image stains, transfer performance, prevention of fog, and dot reproducibility. The quantity (mg) of toner adhering to the charging roller per unit surface area ($cm^2$) was also measured to find that it was as very small as 0.01 mg/$m^2$. After the evaluation at the initial 100-sheet printing was completed, images were continuously printed on further 2,000 sheets, and images were again evaluated, whereupon the same image quality as that of initial stage was attained. Also, the photosensitive member and the developing roller were both observed, where any melt-adhesion of toner did not occur, and it was unnecessary to change them for new ones.

The results of evaluation are shown in Table 10.

Example 22

Evaluation was made in the same manner as in Example 21 except that the process speed was made higher to 120 mm/sec. As the result, though slightly inferior to Example 21 because of severer conditions due to a higher process speed, good results were obtained on the whole.

Examples 23 to 25

Printing tests were made in the same manner as in Example 21 except for using the toners (L) to (N), respectively, as the toner. Evaluation was made similarly. The results are shown in Table 10.

Comparative Examples 6 to 8

Printing tests were made in the same manner as in Example 21 except for using the comparative toners (c) to (e), respectively, as the toner. Evaluation was made similarly. The results are shown in Tnable 10.

In Comparative Examples 6 and 7, which made use of toners not satisfying the specific shape of the present invention, the toner came to seriously adhere to the charging roller surface with progress of running, and the tests were stopped halfway because it was difficult to continue the 2,000-sheet continuous printing tests.

The evaluation items stated in Examples 21 to 25 and Comparative Examples 6 to 8 and their evaluation criteria are as described below.

Printed-Image Evaluation (1) Image density:

Evaluated according to the evaluation criteria for the image evaluation in Example 1.

(2) Image stains:

A halftone image constituted of one-dot lines and one-dot spaces was printed on plane paper (75 g/$m^2$), where evaluation was visually made by examining occurrence of any image stains.

A: No stain occurs.

B: Stains are slightly seen.

C: Stains in fine black spots are seen.

D: Periodical belt-like stains or vertical-line stains are seen.

(3) Image blank areas:

Evaluated according to the evaluation criteria for the image evaluation in Example 1.

(4) Image fog:

Evaluated according to the evaluation criteria for the image evaluation in Example 1.

(5) Dot reproducibility:

Evaluated according to the evaluation criteria for the image evaluation in Example 11.

Charging Roller Toner Adhesion

The quantity of the toner per unit area having adhered to the charging roller per unit surface area was measured. The less the quantity of the toner adhering is, the better it is meant to be.

A: Less than 0.20 mg/cm$^2$.
B: From 0.20 mg/cm$^2$ to less than 0.35 mg/cm$^2$.
C: From 0.35 mg/cm$^2$ to less than 0.55 mg/cm$^2$.
D: More than 0.55 mg/cm$^2$.

Evaluation on Matching to Image Forming Apparatus (1) Matching to developing roller:

Evaluated according to the evaluation criteria for the matching evaluation in Example 11.

(2) Matching to photosensitive member:

Evaluated according to the evaluation criteria for the matching evaluation in Example 1.

(3) Matching to fixing assembly:

Evaluated according to the evaluation criteria for the matching evaluation in Example 1.

TABLE 1

| No. | M | $R_1$ and $R_4$ | $R_2$ and $R_3$ | $X^{n+}$ |
|---|---|---|---|---|
| 1 | B | 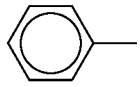 | 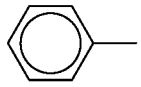 | $K^+$ |
| 2 | B | 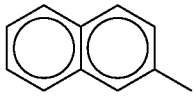 | H— | $(CH_3)_2\overset{+}{N}H_2$ |
| 3 | B | 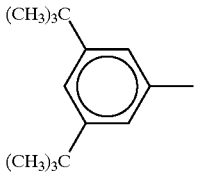 | H— | $H\overset{+}{N}(C_2H_5)_3$ |
| 4 | B | 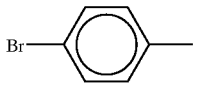 | 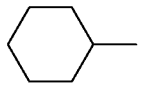 | $Mg^{2+}$ |
| 5 | B | 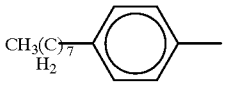 | $CH_3$— | $Zn^{2+}$ |
| 6 | Cr | 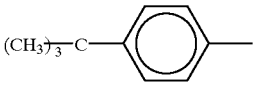 | 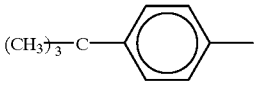 | 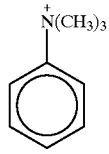 |
| 7 | Co | 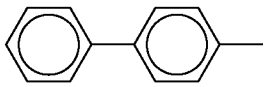 | H— | 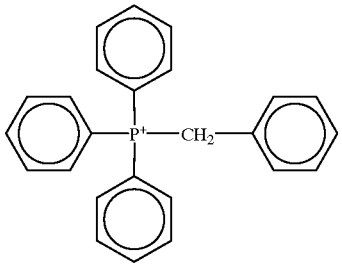 |
| 8 | Co | 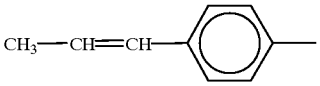 | n-$C_{12}H_{25}$— | 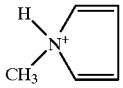 |
| 9 | Al | 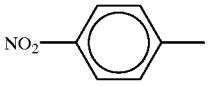 | H— | $\overset{+}{N}H_4$ |

TABLE 1-continued

| No. | M | $R_1$ and $R_4$ | $R_2$ and $R_3$ | $X^{n+}$ |
|---|---|---|---|---|
| 10 | Al | 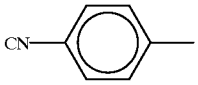 | $CH_3$— | 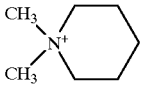 |

TABLE 2

| No. | M | $R_1$ and $R_4$ | $R_2$ and $R_3$ | $X^{n+}$ |
|---|---|---|---|---|
| 11 | Ti | 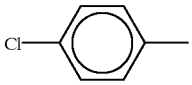 | $C_2H_5$— | 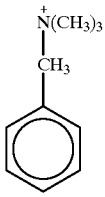 |
| 12 | Ti | 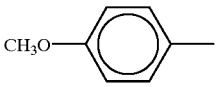 | $CH_3(CH_2)_7$— | 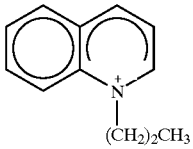 |
| 13 | Ni | 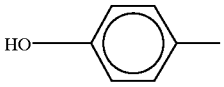 | $CH_3$—$CH(CH_2)_2$—<br>$CH_3$ | $H^+$ |
| 14 | Fe | 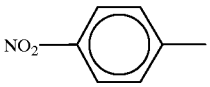 | $CH_3$— | $NH_4^+$ |
| 15 | Fe | 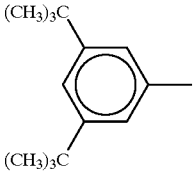 | H— | 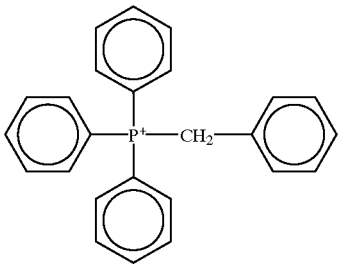 |

TABLE 3A

| | | Toner formulation | | | Shape factors | | |
|---|---|---|---|---|---|---|---|
| | Toner | Charge control agent (pbw) | Colorant (pbw) | (1) (pbw) | SF-1 | SF-2 | (SF-2)/(SF-1) |
| Toner Production Example: | | | | | | | |
| 1 | Toner (A) | Compound No. 1 (1) | Carbon black (7) | 1 | 120 | 115 | 0.96 |
| 2 | Toner (B) | Compound No. 1 (1) | C.I. P.Red 1 (5) | 1 | 121 | 118 | 0.98 |
| 3 | Toner (C) | Compound No. 1 (1) | C.I. P.Bl 2 (5) | 1 | 121 | 110 | 0.91 |
| 4 | Toner (D) | Compound No. 9 (1) | C.I. P.Yl 16 (5) | 1 | 127 | 117 | 0.92 |
| 5 | Toner (E) | Compound No. 14 (1) | Carbon black (5) | 1 | 120 | 136 | 1.13 |
| 6 | Toner (F) | Compound No. 1 (0.1) | Carbon black (7) | 0.1 | 130 | 130 | 1.00 |

TABLE 3A-continued

| | Toner | Toner formulation: Charge control agent (pbw) | Toner formulation: Colorant (pbw) | (1) (pbw) | Shape factors SF-1 | Shape factors SF-2 | Shape factors (SF-2)/(SF-1) |
|---|---|---|---|---|---|---|---|
| 7 | Toner (G) | Compound No. 1 (3.5) | Carbon black (7) | 3.5 | 150 | 130 | 0.86 |
| Toner Production Comparative Example: | | | | | | | |
| 1 | Toner (a) | Compound No. 1 (1) | Carbon black (5) | 1 | 164 | 143 | 0.87 |
| 2 | Toner (b) | Salicylic acid iron complex (1) | Carbon black (7) | 1 | 132 | 125 | 0.95 |

(1): Amount of charge control agent per 100 parts by weight of the binder resin

P. Red.: Pigment Red

P.Bl: Pigment Blue

P.Yl: Pigment Yellow

Remarks:

In the table, the toner formulation is expressed as the amount per 100 parts by weight as total parts by weight of the polymerizable monomer or total parts by weight of the binder resin.

TABLE 3B (* by number)

| | Coulter Counter particle size distribution: Weight = average particle diameter D4 (μ) | Coulter Counter: Number = average particle diameter D1 (μm) | Coulter Counter: Fine = powder content (%)* | Coulter Counter: Coefficient of variation | FPIA circularity frequency distribution: Average circularity $\bar{c}$ | FPIA: Circularity standard deviation SDc | FPIA: Circularity less than 0.950 (%)* | State of presence of wax (r/R)st | Quantity of triboelectricity (mC/kg) |
|---|---|---|---|---|---|---|---|---|---|
| Toner Production Example: | | | | | | | | | |
| 1 | 6.8 | 5.4 | 16 | 22 | 0.976 | 0.031 | 13 | Spherical 0.62 | −45 |
| 2 | 7.2 | 5.5 | 10 | 23 | 0.973 | 0.030 | 12 | Spherical 0.59 | −42 |
| 3 | 6.9 | 5.8 | 15 | 22 | 0.974 | 0.030 | 15 | Spherical 0.63 | −50 |
| 4 | 7.5 | 6.2 | 10 | 21 | 0.971 | 0.033 | 19 | Spherical 0.60 | −37 |
| 5 | 7.0 | 6.2 | 22 | 31 | 0.972 | 0.037 | 25 | Fine dispersion ≦0.01 | −43 |
| 6 | 7.0 | 6.0 | 10 | 24 | 0.966 | 0.034 | 20 | Spherical 0.55 | −10 |
| 7 | 6.9 | 6.5 | 12 | 23 | 0.945 | 0.037 | 33 | Spherical 0.48 | −75 |
| Toner Production Comparative Example: | | | | | | | | | |
| 1 | 7.1 | 5.6 | 31 | 33 | 0.928 | 0.059 | 59 | Fine dispersion ≦0.01 | −34 |
| 2 | 6.9 | 5.7 | 32 | 26 | 0.970 | 0.036 | 21 | Fine dispersion 0.03 | −26 |

TABLE 4

| | | Evaluation of printed images | | | | | | Evaluation of matching to image forming apparatus | | | |
|---|---|---|---|---|---|---|---|---|---|---|---|
| | | Image density | | | | | Image | Devel- | Photo- | Inter- mediate | |
| | Developer | Initial stage | 1,000 sheets | 5,000 sheets | 10,000 sheets | Image fog | blank areas | oping sleeve | sensitive drum | transfer member | Fixing assembly |
| Example: | | | | | | | | | | | |
| 1 | (A) | A | A | A | A | A | A | A | A | A | A |
| 2 | (B) | A | A | A | A | A | A | A | A | A | A |
| 3 | (C) | A | A | A | A | A | A | A | A | A | A |
| 4 | (D) | A | A | A | A | A | B | A | A | A | A |
| 5 | (E) | A | A | B | C | C | C | C | C | C | C |
| 6 | (F) | B | B | B | C | C | B | B | C | B | A |
| 7 | (G) | A | A | B | B | B | C | B | B | C | B |
| Comparative Example: | | | | | | | | | | | |
| 1 | (a) | A | B | C | D | D | D | D | C | C | D |
| 2 | (b) | C | A | B | C | C | C | D | D | C | B |

TABLE 5

| | | Evaluation of printed images | | | | | Evaluation of matching to image forming apparatus | | |
|---|---|---|---|---|---|---|---|---|---|
| | | Image density | | | | | | Photo- | |
| | Toner | Initial stage | 1,000 sheets | 5,000 sheets | 10,000 sheets | Image fog | Developing sleeve | sensitive drum | Fixing assembly |
| Example: | | | | | | | | | |
| 9 | (A) | A | A | A | A | A | A | A | A |

TABLE 6

| | Content of ester compounds (% by weight) | | | | | | | | | Melting | | | |
|---|---|---|---|---|---|---|---|---|---|---|---|---|---|
| Ester | Total number of carbon atoms of ester compounds | | | | | | | | | point | Hard- | | |
| wax | $C_{32}$ | $C_{34}$ | $C_{36}$ | $C_{38}$ | $C_{40}$ | $C_{42}$ | $C_{44}$ | $C_{46}$ | Others | (° C.) | ness | Mw | Mn |
| A | 0 | 0 | 0 | 0.3 | 6.1 | 16.5 | 74.9 | 0.6 | 1.6 | 74.4 | 1.8 | 630 | 500 |
| B | 0 | 0 | 5.2 | 5.8 | 13.8 | 27.0 | 40.0 | 2.7 | 5.5 | 72.9 | 1.3 | 590 | 480 |

TABLE 7

| | | | | | | | | * at switching Production conditions | | |
|---|---|---|---|---|---|---|---|---|---|---|
| | | Charge control agent | | Wax | | Colorant | | 1st reac- | Polymer-* ization | 2nd reac- |
| | Toner | Type | Amt. (pbw) | Type | Amt. (pbw) | Type | Amt. (pbw) | tion pH | conver- sion | tion pH |
| Toner Production Example: | | | | | | | | | | |
| 8 | Toner (H) | Compound No. 1 | 2 | Ester wax A | 7 | Carbon black | 7 | 5.0 | 93 | 12 |
| 9 | Toner (I) | Compound No. 1 | 2 | Ester wax A | 7 | C.I. P.Red 1 | 5 | 5.0 | 95 | 12 |
| 10 | Toner (J) | Compound No. 1 | 2 | Ester wax A | 7 | C.I. P.Bl 2 | 5 | 5.0 | 90 | 12 |
| 11 | Toner (K) | Compound No. 1 | 2 | Ester wax A | 7 | C.I. P.Yl 16 | 5 | 5.5 | 85 | 11 |

TABLE 7-continued

| | | Charge control agent | | Wax | | Colorant | | * at switching Production conditions | | |
|---|---|---|---|---|---|---|---|---|---|---|
| | Toner | Type | Amt. (pbw) | Type | Amt. (pbw) | Type | Amt. (pbw) | 1st reaction pH | Polymerization conversion | 2nd reaction pH |
| 12 | Toner (L) | Compound No. 6 | 3 | Ester wax B | 7 | Carbon black | 7 | 5.3 | 80 | 12 |
| 13 | Toner (M) | Compound No. 9 | 1 | Paraffin wax (mp:70° C.) | 30 | Carbon black | 7 | 6.2 | 56 | 10 |
| 14 | Toner (N) | Compound No. 9 | 1 | Modified polyethylene wax (mp:115° C.) | 4 | Carbon black | 7 | 8.3 | 15 | 9 |
| Toner Production Comparative Example: | | | | | | | | | | |
| 3 | Toner (c) | Compound No. 1 | 2 | Paraffin wax (mp:70° C.) | 7 | Carbon black | 7 | — | — | — |
| 4 | Toner (d) | Compound No. 1 | 2 | Paraffin wax (mp:70° C.) | 7 | Carbon black | 7 | — | — | — |
| 5 | Toner (e) | Salicylic acid boron complex | 2 | Modified polyethylene wax (mp:115° C.) | 4 | Carbon black | 7 | 9.0 | — | — |

(P.Red.: Pigment Red, P.Bl: Pigment Blue, P.Yl: Pigment Yellow

TABLE 8

(* by number)

| | | | Shape factors | | Coulter Counter particle size distribution | | | FPIA particle size distribution | | | |
|---|---|---|---|---|---|---|---|---|---|---|---|
| | Toner | (1) (pbw) | SF-1 | SF-2 | Weight = average particle diameter (μm) | Fine = powder content (%)* | Coefficient of variation | Average circularity | Circularity standard deviation | Circularity less than 0.950 (%)* | State of presence of wax (r/R)st |
| Toner Production Example: | | | | | | | | | | | |
| 8 | (H) | 2 | 113 | 111 | 6.5 | 10 | 21 | 0.985 | 0.026 | 3 | Spherical 0.43 |
| 9 | (I) | 2 | 116 | 114 | 6.3 | 12 | 22 | 0.980 | 0.029 | 7 | Spherical 0.41 |
| 10 | (J) | 2 | 107 | 106 | 6.1 | 9 | 20 | 0.989 | 0.020 | 1 | Spherical 0.44 |
| 11 | (K) | 2 | 129 | 118 | 6.9 | 17 | 24 | 0.973 | 0.033 | 9 | Spherical 0.39 |
| 12 | (L) | 3 | 142 | 125 | 7.2 | 20 | 26 | 0.964 | 0.034 | 14 | Spherical 0.33 |
| 13 | (M) | 1 | 148 | 129 | 7.4 | 21 | 26 | 0.952 | 0.036 | 26 | Spherical 0.79 |
| 14 | (N) | 1 | 155 | 138 | 7.3 | 23 | 29 | 0.946 | 0.038 | 32 | Spherical 0.08 |
| Toner Production Comparative Example: | | | | | | | | | | | |
| 3 | (c) | 2 | 155 | 146 | 6.4 | 26 | 32 | 0.926 | 0.061 | 64 | Fine dispers. ≦0.01 |
| 4 | (d) | 2 | 172 | 153 | 6.2 | 29 | 34 | 0.931 | 0.057 | 55 | Fine dispers. ≦0.01 |
| 5 | (e) | 2 | 148 | 141 | 7.0 | 22 | 27 | 0.943 | 0.037 | 40 | Fine dispers. 0.03 |

(1): Amount of charge control agent per 100 parts by weight of the binder resin

TABLE 9

| | | After 2,000-sheet image reproduction in N/N | | | | | After 3,000-sheet image reproduction in H/H (after 5,000 sheets in total) | | | | | | | |
|---|---|---|---|---|---|---|---|---|---|---|---|---|---|---|
| | | Evaluation of printed images | | | | | Evaluation of printed images | | | | | Evaluation of matching to image forming apparatus | | |
| | Toner | (1) | (2) | (3) | (4) | (5) | (1) | (2) | (3) | (4) | (5) | Developing roller | Photo-sensitive drum | Fixing assembly |
| Example: | | | | | | | | | | | | | | |
| 11 | Toner (H) | A | A | A | A | A | A | A | A | A | A | A | A | A |
| 12 | Toner (H) | A | A | A | A | A | A | B | B | A | B | A | A | A |
| 13 | Toner (I) | A | A | A | A | A | A | A | A | A | A | A | A | A |
| 14 | Toner (J) | A | A | A | A | A | A | A | A | A | A | A | A | A |
| 15 | Toner (K) | A | A | A | B | B | A | B | A | A | B | A | A | A |
| 16 | Toner (L) | B | B | B | B | B | B | B | B | C | B | B | B | B |
| 17 | Toner (M) | B | B | B | C | B | B | C | C | C | C | B | C | B |
| 18 | Toner (N) | B | B | C | C | C | B | C | C | C | C | C | C | C |
| Comparative Example: | | | | | | | | | | | | | | |
| 3 | Toner (c) | C | C | C | C | D | D | D | D | D | D | C | D | D |
| 4 | Toner (d) | C | C | C | C | C | C | D | D | D | D | D | C | D |
| 5 | Toner (e) | B | B | B | C | C | C | C | C | D | C | D | D | C |

N/N: Normal temperature/normal humidity environment
H/H: High temperature/high humidity environment
(1): Image density
(2): Spots around line images
(3): Image blank areas
(4): Image fog
(5): Dot reproducibility

TABLE 10

| | | After 100-sheet image reproduction | | | | | | After 2,000-sheet image reproduction | | | | | | | |
|---|---|---|---|---|---|---|---|---|---|---|---|---|---|---|---|
| | | Evaluation of printed images | | | | | | Evaluation of printed images | | | | | Evaluation of matching to image forming apparatus | | |
| | Toner | (1) | (2) | (3) | (4) | (5) | (6) | (1) | (2) | (3) | (4) | (5) | Developing roller | Photo-sensitive drum | Fixing assembly |
| Example: | | | | | | | | | | | | | | | |
| 21 | (H) | A | A | A | A | A | A | A | A | A | A | A | A | A | A |
| 22 | (H) | A | A | A | A | A | B | A | A | A | B | B | A | A | A |
| 23 | (L) | B | B | B | B | B | B | B | B | B | C | B | B | B | B |
| 24 | (M) | B | B | B | C | C | A | B | C | C | C | C | B | C | B |
| 25 | (N) | B | B | B | C | C | C | B | C | B | C | C | B | C | C |
| Comparative Example: | | | | | | | | | | | | | | | |
| 6 | (c) | B | B | C | C | C | D | — | — | — | — | — | — | — | — |
| 7 | (d) | C | C | B | D | C | D | — | — | — | — | — | — | — | — |
| 8 | (e) | C | B | B | C | C | C | B | C | C | D | C | D | D | C |

(1): Image density
(2): Image stains
(3): Image blank areas
(4): Image fog
(5): Dot reproducibility
(6): Charging roller toner adhesion

What is claimed is:

1. A toner comprising toner particles containing at least a binder resin, a wax and a compound represented by Formula (A):

(A)

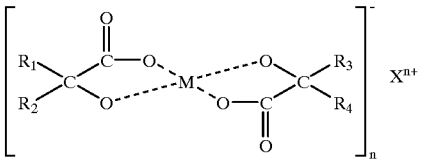

wherein $R_1$ and $R_4$ each represent a substituted or unsubstituted aromatic group, inclusive of a condensed ring; $R_2$ and $R_3$ each represent a hydrogen atom, an alkyl group, a substituted or unsubstituted aromatic group, inclusive of a condensed ring; M represents an element selected from B, Ti, Fe, Co, Cr, Al and Ni; and $X^{n+}$ represents a cation, said toner having shape factors SF-1 and SF-2 with a value of 100<SF-1≦160 and a value of 100<SF-2≦140.

2. The toner according to claim 1, wherein the shape factor SF-1 is 100<SF-1≦150 and the shape factor SF-2 is 100<SF-2≦130.

3. The toner according to claim 1, wherein the shape factor SF-1 is 100<SF-1≦140 and the shape factor SF-2 is 100<SF-2≦120.

4. The toner according to claim 1, wherein the ratio of the shape factor SF-1 to the shape factor SF-2, (SF-2)/(SF-1), is in a value of 1 or less.

5. The toner according to claim 1, which has an average circularity of from 0.920 to 0.995 and a circularity standard deviation of less than 0.040 in its circularity frequency distribution as measured with a flow type particle image analyzer.

6. The toner according to claim 1, which has an average circularity of from 0.950 to 0.995 and a circularity standard deviation of less than 0.040 in its circularity frequency distribution as measured with a flow type particle image analyzer.

7. The toner according to claim 1, which has an average circularity of from 0.970 to 0.990 and a circularity standard deviation of from 0.015 to less than 0.035 in its circularity frequency distribution as measured with a flow type particle image analyzer.

8. The toner according to claim 1, wherein a toner having an average circularity less than 0.950 in its circularity frequency distribution is in a content of 15% by number or less.

9. The toner according to claim 1, which has a weight-average particle diameter of from 4 μm to 9 μm.

10. The toner according to claim 1, which has a coefficient of variation in number distribution, of 30 or less.

11. The toner according to claim 1, wherein a toner fine powder having particle diameters of 4.00 μm or smaller in number distribution is in a content not more than 25% by number.

12. The toner according to claim 1, which has a weight-average particle diameter of from 4 μm to 9 μm, has a coefficient of variation in number distribution, of 30 or less, and has a toner fine powder having particle diameters of 4.00 μm or smaller in number distribution in a content not more than 25% by number.

13. The toner according to claim 1, which has a weight-average particle diameter of from 4 μm to 9 μm, has a coefficient of variation in number distribution, of 25 or less, and has a toner fine powder having particle diameters of 4.00 μm or smaller in number distribution in a content not more than 20% by number.

14. The toner according to claim 1, wherein said wax is dispersed in the form of substantially a spherical or spindle-shaped island or islands in such a way that, when in cross-sectional observation of toner particles on a transmission electron microscope (TEM);

(1) twenty planes of cross sections of toner particles having length R (μm) satisfying the relation of 0.9≦R/D4≦1.1 with respect to weight-average particle diameter D4 (μm) are picked up; and (2) each length r of the largest among phase-separated structures ascribable to the wax present in the cross-sectional plane of the toner particles thus picked up is measured;

the arithmetic mean value of r/R, $(r/R)_{st}$, thus determined satisfies:

$$0.05 \leqq (r/R)_{st} \leqq 0.95.$$

15. The toner according to claim 14, wherein the $(r/R)_{st}$ satisfies:

$$0.25 \leqq (r/R)_{st} \leqq 0.90.$$

16. The toner according to claim 1, wherein said wax has a maximum endothermic peak at from 50° C. to 100° C. at the time of temperature rise, in the DSC curve as measured with a differential scanning calorimeter.

17. The toner according to claim 1, wherein said wax is an ester wax having ester compounds satisfying the following general formula:

$$R_1—COO—R_2$$

wherein $R_1$ and $R_2$ each represent a hydrocarbon group having 15 to 45 carbon atoms.

18. The toner according to claim 17, wherein said ester wax contains ester compounds having the same number of carbon atoms in total, in an amount of from 50% by weight to 95% by weight.

19. The toner according to claim 1, which contains an inorganic fine powder.

20. The toner according to claim 19, wherein said inorganic fine powder has been treated with silicone oil.

21. The toner according to claim 1, which is negatively chargeable.

22. The toner according to claim 1, wherein said compound represented by Formula (A) is contained in an amount of from 0.1 part by weight to 10 parts by weight based on 100 parts by weight of the binder resin.

23. The toner according to claim 1, wherein said compound represented by Formula (A) is contained in an amount of from 0.6 part by weight to 5 parts by weight based on 100 parts by weight of the binder resin.

24. The toner according to claim 1, wherein said toner particles are obtained by subjecting a polymerizable monomer composition containing a polymerizable monomer, the wax and the compound represented by Formula (A), to suspension polymerization in an aqueous medium.

25. The toner according to claim 24, wherein said compound represented by Formula (A) is added in an amount of from 0.1 part by weight to 10 parts by weight based on 100 parts by weight of the polymerizable monomer.

26. The toner according to claim 24, wherein the compound represented by Formula (A) is added in an amount of from 0.6 part by weight to 5 parts by weight based on 100 parts by weight of the polymerizable monomer.

27. A process for producing a toner, comprising;

a granulation step of dispersing in an aqueous medium a polymerizable monomer composition containing at least a polymerizable monomer, a colorant, a wax, a polymerization initiator and a compound represented by Formula (A):

(A)

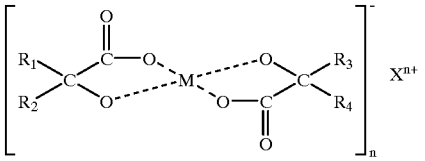

wherein $R_1$ and $R_4$ each represent a substituted or unsubstituted aromatic group, inclusive of a condensed ring; $R_2$ and $R_3$ each represent a hydrogen atom, an alkyl group, a substituted or unsubstituted aromatic group, inclusive of a condensed ring; M represents an element selected from B, Ti, Fe, Co, Cr, Al and Ni; and $X^{n+}$ represents a cation, to form particles of the polymerizable monomer composition; and a polymerization step of polymerizing the polymerizable monomer present in the particles of the polymerizable monomer composition to form toner particles;

the reaction to polymerize the polymerizable monomer in the course of from the granulation step to the polymerization step being carried out while keeping the pH of the aqueous medium at 4.5 to 8.5, until the polymerization conversion of the polymerizable monomer comes to be 10% or more; and the toner having shape factors SF-1 and SF-2 with a value of 100<SF-1≦160 and a value of 100<SF-2≦140.

28. The process according to claim 27, wherein said reaction to polymerize the polymerizable monomer in the course of from the granulation step to the polymerization step is carried out while keeping the pH of the aqueous medium at 4.5 to 6.0, until the polymerization conversion of the polymerizable monomer comes to be 10% or more.

29. The process according to claim 27, wherein, after the polymerization conversion of the polymerizable monomer is made higher to 10% or more by the reaction to polymerize the polymerizable monomer in the course of from the granulation step to the polymerization step, the pH of the aqueous medium is adjusted to 9 to 13 to make the polymerization conversion still higher.

30. An image forming method comprising:

a charging step of applying a voltage to a charging member from the outside to charge an electrostatic latent image bearing member;

a latent image forming step of forming an electrostatic latent image on the electrostatic latent image bearing member thus charged;

a developing step of developing the electrostatic latent image by the use of a toner to from a toner image on the electrostatic latent image bearing member;

a transfer step of transferring the toner image formed on the electrostatic latent image bearing member, to a transfer medium with or without intervention of an intermediate transfer member; and a fixing step of heat-fixing the toner image transferred to the transfer medium;

wherein said toner comprises toner particles containing at least a binder resin, a colorant, a wax and a compound represented by Formula (A):

(A)

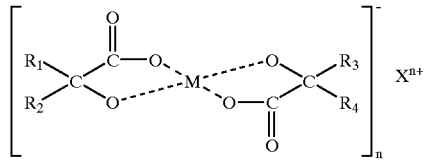

wherein $R_1$ and $R_4$ each represent a substituted or unsubstituted aromatic group, inclusive of a condensed ring; $R_2$ and $R_3$ each represent a hydrogen atom, an alkyl group, a substituted or unsubstituted aromatic group, inclusive of a condensed ring; M represents an element selected from B, Ti, Fe, Co, Cr, Al and Ni; and $X^{n+}$ represents a cation, and said toner has shape factors SF-1 and SF-2 with a value of 100<SF-1≦160 and a value of 100<SF-2≦140.

31. The image forming method according to claim 30, wherein, in said developing step, the surface movement speed of the toner carrying member at its developing zone is a speed of from 1.05 to 3.0 times the surface movement speed of the electrostatic latent image bearing member.

32. The image forming method according to claim 30, wherein the toner carrying member has a surface roughness Ra (μm) of 1.5 or less.

33. The image forming method according to claim 30, wherein, in said developing step, the surface movement speed of the toner carrying member at its developing zone is a speed of from 1.05 to 3.0 times the surface movement speed of the electrostatic latent image bearing member, and the toner carrying member has a surface roughness Ra (μm) of 1.5 or less.

34. The image forming method according to claim 30, wherein a ferromagnetic metal blade is provided opposingly to the toner carrying member, leaving a minute gap between them.

35. The image forming method according to claim 30, wherein a blade comprising an elastic material is brought into touch with the toner carrying member.

36. The image forming method according to claim 30, wherein, in said charging step, the charging member is brought into contact with the electrostatic latent image bearing member to charge the electrostatic latent image bearing member.

37. The image forming method according to claim 30, wherein, in said transfer step, the electrostatic latent image bearing member or intermediate transfer member comes into contact with a transfer assembly with intervention of the transfer medium.

38. The image forming method according to claim 30, wherein said fixing step comprises heat-fixing the toner image by means of a heat-fixing assembly to which any offset-preventive liquid is not fed or which do not have any fixing cleaner.

39. The image forming method according to claim 30, which has a toner reuse mechanism in which transfer residual toner remaining on the electrostatic latent image bearing member after said transfer step is collected by cleaning and the toner collected is supplied to a developing means to make the developing means again hold the toner to develop the electrostatic latent image formed on the electrostatic latent image bearing member.

40. The image forming method according to claim 30, wherein, in said developing step, a toner layer formed of the toner carried on the surface of the toner carrying member comes into contact with the surface of the electrostatic latent image bearing member to develop the electrostatic latent image.

41. The image forming method according to claim 40, wherein, in said developing step, transfer residual toner remaining on the electrostatic latent image bearing member after said transfer step is collected at the time the electrostatic latent image is developed.

42. The image forming method according to claim 30, wherein in said toner the shape factor SF-1 is 100<SF-2≦150 and the shape factor SF-2 is 100<SF-2≦130.

43. The image forming method according to claim 30, wherein in said toner the shape factor SF-1 is 100<SF-1≦140 and the shape factor SF-2 is 100<SF-2≦120.

44. The image forming method according to claim 30, wherein in said toner the ratio of the shape factor SF-1 to the shape factor SF-2, (SF-2)/(SF-1), is in a value of 1 or less.

45. The image forming method according to claim 30, wherein said toner has an average circularity of from 0.920 to 0.995 and a circularity standard deviation of less than 0.040 in its circularity frequency distribution as measured with a flow type particle image analyzer.

46. The image forming method according to claim 30, wherein said toner has an average circularity of from 0.950 to 0.995 and a circularity standard deviation of less than 0.040 in its circularity frequency distribution as measured with a flow type particle image analyzer.

47. The image forming method according to claim 30, wherein said toner has an average circularity of from 0.970 to 0.990 and a circularity standard deviation of from 0.015 to less than 0.035 in its circularity frequency distribution as measured with a flow type particle image analyzer.

48. The image forming method according to claim 30, wherein in said toner a toner having an average circularity less than 0.950 in its circularity frequency distribution is in a content of 15% by number or less.

49. The image forming method according to claim 30, wherein said toner has a weight-average particle diameter of from 4 μm to 9 μm.

50. The image forming method according to claim 30, wherein said toner has a coefficient of variation in number distribution, of 30 or less.

51. The image forming method according to claim 30, wherein said toner has a toner fine powder having particle diameters of 4.00 μm or smaller in number distribution in a content not more than 25% by number.

52. The image forming method according to claim 30, wherein said toner has a weight-average particle diameter of from 4 μm to 9 μm, has a coefficient of variation in number distribution, of 30 or less, and has a toner fine powder having particle diameters of 4.00 μm or smaller in number distribution in a content not more than 25% by number.

53. The image forming method according to claim 30, wherein said toner has a weight-average particle diameter of from 4 μm to 9 μm, has a coefficient of variation in number distribution, of 25 or less, and has a toner fine powder having particle diameters of 4.00 μm or smaller in number distribution in a content not more than 20% by number.

54. The image forming method according to claim 30, wherein said wax is dispersed in the form of substantially a spherical or spindle-shaped island or islands in such a way that, when in cross-sectional observation of toner particles on a transmission electron microscope (TEM);

(1) twenty planes of cross sections of toner particles having length R (μm) satisfying the relation of $0.9 \leqq R/D4 \leqq 1.1$ with respect to weight-average particle diameter D4 (μm) are picked up; and (2) each length r of the largest among phase-separated structures ascribable to the wax present in the cross-sectional plane of the toner particles thus picked up is measured;

the arithmetic mean value of r/R, $(r/R)_{st}$, thus determined satisfies:

$$0.05 \leqq (r/R)_{st} \leqq 0.95.$$

55. The image forming method according to claim 54, wherein the $(r/R)_{st}$ satisfies:

$$0.25 \leqq (r/R)_{st} \leqq 0.90.$$

56. The image forming method according to claim 30, wherein said wax has a maximum endothermic peak at from 50° C. to 100° C. at the time of temperature rise, in the DSC curve as measured with a differential scanning calorimeter.

57. The image forming method according to claim 30, wherein said wax is an ester wax having ester compounds satisfying the following general formula.

$$R_1—COO—R_2$$

wherein $R_1$ and $R_2$ each represent a hydrocarbon group having 15 to 45 carbon atoms.

58. The image forming method according to claim 57, wherein said ester wax contains ester compounds having the same number of carbon atoms in total, in an amount of from 50% by weight to 95% by weight.

59. The image forming method according to claim 30, wherein said toner contains an inorganic fine powder.

60. The image forming method according to claim 59, wherein said inorganic fine powder has been treated with silicone oil.

61. The image forming method according to claim 30, wherein said toner is negatively chargeable.

62. The image forming method according to claim 30, wherein said toner contains the compound represented by Formula (A) in an amount of from 0.1 part by weight to 10 parts by weight based on 100 parts by weight of the binder resin.

63. The image forming method according to claim 30, wherein said toner contains the compound represented by Formula (A) in an amount of from 0.6 part by weight to 5 parts by weight based on 100 parts by weight of the polymerizable monomer.

64. The image forming method according to claim 30, wherein said toner particles are obtained by subjecting a polymerizable monomer composition containing a polymerizable monomer, the wax and the compound represented by Formula (A), to suspension polymerization in an aqueous medium.

65. The image forming method according to claim 64, wherein said compound represented by Formula (A) is added in an amount of from 0.1 part by weight to 10 parts by weight based on 100 parts by weight of the polymerizable monomer.

66. The image forming method according to claim 64, wherein the compound represented by Formula (A) is added in an amount of from 0.6 part by weight to 5 parts by weight based on 100 parts by weight of the polymerizable monomer.

* * * * *

UNITED STATES PATENT AND TRADEMARK OFFICE

CERTIFICATE OF CORRECTION

PATENT NO. : 6,096,468
DATED : August 1, 2000
INVENTOR(S) : Manabu Ohno et al.

It is certified that error appears in the above-identified patent and that said Letters Patent is hereby corrected as shown below:

Column 1,
Line 53, "accordingly," should read -- Accordingly, --.

Column 2,
Line 9, "ever" should be deleted;
Line 17, "discloses" should read -- disclose --;
Line 37, "toner" should read -- toners --; and
Line 46, "reseaches" should read -- researches --.

Column 4,
Line 26, "from" should read -- form --.

Column 5,
Line 10, "examples" should -- example --.

Column 7,
Line 26, "can" should read -- can- --.

Column 8,
Line 27, "1 $\leq$ 120." should read -- 2 $\leq$ 120. --;
Line 39, "low type" should read -- flow type -- and "an be" should read -- can be --;
Line 48, "ever" should read -- always --;
Line 50, "effectively" should read -- efective --; and
Line 51, "appear" should be deleted.

Column 9,
Line 13, "Circularity =" should be deleted;
Line 27, "complicate" should read -- complicated --;
Line 28, "circularity is." should read -- circularity. --;
Formula 1, "Average circularity" (1st occurrence) should be deleted; and
Formula 2, "Circularity standard deviation SDC" (1st occurrence) should be deleted.

Column 10,
Line 30, "apparatus." should have no ¶ break;
Line 31, "¶ If" should have no ¶ break/indent.

Column 11,
Line 30, "sample obtained" should read -- sample is obtained --.

UNITED STATES PATENT AND TRADEMARK OFFICE

CERTIFICATE OF CORRECTION

PATENT NO. : 6,096,468
DATED : August 1, 2000
INVENTOR(S) : Manabu Ohno et al.

It is certified that error appears in the above-identified patent and that said Letters Patent is hereby corrected as shown below:

Column 13,
Line 22, "-a zobisisobutyrate)." should read -- azobisobutyoate). --;
Line 32, "an improves" should read -- and improves --; and
Line 38, "step, thus," should read -- step; thus, --; and
Line 61, "can not" should read -- cannot --.

Column 14,
Formula 2, 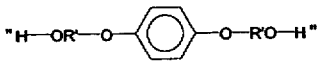 should read (b)

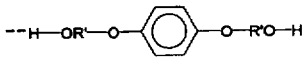 --; and

Line 61, "1,4 butane diol," should read -- 1,4 butanediol --.

Column 15,
Line 20, "contain" should read -- contains --; and
Line 33, "used the" should read -- used in the --.

Column 16,
Line 47, "2.2-bis (" should read -- 2.2-bis --;
Line 48, "4-hydroxybphenyl)" should read -- (4-hydroxyphenyl) --;
Line 63, "dihydroxybenzenes" should read -- dihydroxybenzenes --; and
Line 64, "dihyroxynaphthalenes" should read -- dihydroxynaphthalenes --.

Column 20,
Line 27, "of a" should read -- of an --; and
Line 51, "calorie" should read -- calorie value --.

Column 22,
Formula 2, "$CH_2$-$(CH_2)$-$_{22}$COO-$(CH_2)$-$_{21}CH_3$" should read $$--CH_3-(CH_2)-_{22}COO-(CH_2)-_{21}CH_3--;$$

Line 14, "blow," should read -- below, --; and
Line 65, "weight" should read -- weight. --.

Column 23,
Line 63, "tend" should read -- tends --.

UNITED STATES PATENT AND TRADEMARK OFFICE

CERTIFICATE OF CORRECTION

PATENT NO. : 6,096,468
DATED : August 1, 2000
INVENTOR(S) : Manabu Ohno et al.

It is certified that error appears in the above-identified patent and that said Letters Patent is hereby corrected as shown below:

Column 24,
Line 63, "mertorious" should read -- meritorious --.

Column 25,
Line 6, "potions" should read -- portions --;
Line 18, "mount" should read -- amount --; and
Line 23, "hydrophobic and control" should read -- it hydrophobic and controlling --.

Column 26,
Line 18, "can not" should read -- cannot --.

Column 27,
Line 42, "used" (2nd occurrence) should be deleted.

Column 28,
Line 14, "to from" should read -- to form --; and
Line 15, "phosphate," should read -- phosphate; --.

Column 29,
Line 20, "can not" should read -- cannot --; and
Line 25, "11" should be in boldface.

Column 30,
Line 16, "times" should read -- number of times --; and
Line 61, "can not" should read -- cannot --.

Column 31,
Line 33, "can" should read -- can- --.

Column 32,
Lines 53 and 60, "gap a" should read -- gap α --.

Column 33,
Line 15, "on to" should read -- onto --; and
Line 18, "1" should be in boldface.

Column 34,
Line 39, "sequencially" should read -- sequentially --; and
Line 41, "filed" should read -- field --.

Column 35,
Line 64, "of" should be deleted and "and" (2nd occurrence) should read -- or --.

UNITED STATES PATENT AND TRADEMARK OFFICE

CERTIFICATE OF CORRECTION

PATENT NO. : 6,096,468
DATED : August 1, 2000
INVENTOR(S) : Manabu Ohno et al.

It is certified that error appears in the above-identified patent and that said Letters Patent is hereby corrected as shown below:

Column 36,
Line 20, "bo so" should read -- be so --.

Column 37,
Line 39, "the the" should read -- the --.

Column 38,
Line 27, "each" should read -- to each --; and
Line 45, "beating" should read -- bearing --.

Column 39,
Line 21, "invention," should read -- invention; --.

Column 40,
Line 54, "none of" should read -- no --.

Column 41,
Lines 17 and 39, "revolution" should read -- revolutions --.

Column 42,
Line 6, "to find" should read -- and found --;
Line 13, "shaked" should read -- shaken --;
Line 21, "and put" should read -- in place --;
Line 55, "Styrene-butyl acrylate copolymer resin (glass transistion" should be deleted;
Line 56, ""temperature: 70° C.) 100 parts" should be deleted; and
TABLE, insert "Styrene-butyl acrylate copolymer resin (glass transistion temperature: 70° C.) 100 parts".

Column 43,
Line 45, "1a" should be in boldface.

Column 45,
Line 20, "and image" should read -- and little image -- and "little" should be deleted; and
Line 34, "minutes" should read -- minute --.

Column 46,
Line 2, "rerpoduced." should read -- reproduced. --; and
Line 56, "images" should read -- images. --.

Column 47,
Line 24, "revolution" should read -- revolutions --; and
Line 29, "reprepared" should read -- prepared --.

UNITED STATES PATENT AND TRADEMARK OFFICE

CERTIFICATE OF CORRECTION

PATENT NO. : 6,096,468
DATED : August 1, 2000
INVENTOR(S) : Manabu Ohno et al.

It is certified that error appears in the above-identified patent and that said Letters Patent is hereby corrected as shown below:

Column 48,
Line 1, "revolution" should read -- revolutions --.

Column 49,
Line 43, "images" should read -- image --.

Column 51,
Line 20, "images than" should read -- images rather than -- and
"plane" should read -- plain --.

Column 53,
Line 12, "width in" should read -- width is --.

Column 54,
Line 28, "Tnabel" should read -- Table --; and
Line 45, "plane" should read -- plain --.

Column 55,
TABLE 1,

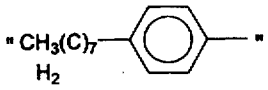

should read

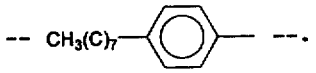

UNITED STATES PATENT AND TRADEMARK OFFICE

CERTIFICATE OF CORRECTION

PATENT NO. : 6,096,468
DATED : August 1, 2000
INVENTOR(S) : Manabu Ohno et al.

It is certified that error appears in the above-identified patent and that said Letters Patent is hereby corrected as shown below:

Column 57,
TABLE 2, "$CH_3(CH_2)$—" should read -- $CH_3(CH_2)_7$ --

Column 69,
Line 59, "to from" should read -- to form --.

Column 71,
Line 12, "$2 \leq 150$" should read -- $1 \leq 150$ --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,096,468
DATED : August 1, 2000
INVENTOR(S) : Manabu Ohno et al.

It is certified that error appears in the above-identified patent and that said Letters Patent is hereby corrected as shown below:

Column 1,
Line 53, "accordingly," should read -- Accordingly, --.

Column 2,
Line 9, "ever" should be deleted;
Line 17, "discloses" should read -- disclose --;
Line 37, "toner" should read -- toners --; and
Line 46, "reseaches" should read -- researches --.

Column 4,
Line 26, "from" should read -- form --.

Column 5,
Line 10, "examples" should read -- example --.

Column 7,
Line 26, "can" should read -- can- --.

Column 8,
Line 27, "1 $\leq$ 120." should read -- 2 $\leq$ 120. --;
Line 39, "low type" should read -- flow type -- and "an be" should read -- can be --;
Line 48, "ever" should read -- always --;
Line 50, "effectively" should read -- efective --; and
Line 51, "appear" should be deleted.

Column 9,
Line 13, "Circularity =" should be deleted;
Line 27, "complicate" should read -- complicated --;
Line 28, "circularity is." should read -- circularity. --;
Formula 1, "Average circularity" (1st occurrence) should be deleted; and
Formula 2, "Circularity standard deviation SDC" (1st occurrence) should be deleted.

Column 10,
Line 30, "apparatus." should have no ¶ break;
Line 31, "¶ If" should have no ¶ break/indent.

Column 11,
Line 30, "sample obtained" should read -- sample is obtained --.

UNITED STATES PATENT AND TRADEMARK OFFICE

CERTIFICATE OF CORRECTION

PATENT NO. : 6,096,468
DATED : August 1, 2000
INVENTOR(S) : Manabu Ohno et al.

It is certified that error appears in the above-identified patent and that said Letters Patent is hereby corrected as shown below:

Column 13,
Line 22, "-a zobisisobutyrate)." should read -- azobisobutyoate). --;
Line 32, "an improves" should read -- and improves --; and
Line 38, "step, thus," should read -- step; thus, --; and
Line 61, "can not" should read -- cannot --.

Column 14,
Formula 2, 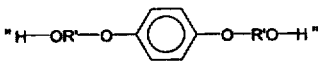 should read (b)

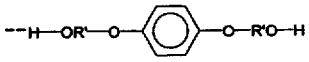 --; and

Line 61, "1,4 butane diol," should read -- 1,4 butanediol --.

Column 15,
Line 20, "contain" should read -- contains --; and
Line 33, "used the" should read -- used in the --.

Column 16,
Line 47, "2.2-bis (" should read -- 2.2-bis --;
Line 48, "4-hydroxybphenyl)" should read -- (4-hydroxyphenyl) --;
Line 63, "dihydroxybenzenes" should read -- dihydroxybenzenes --; and
Line 64, "dihyroxynaphthalenes" should read -- dihydroxynaphthalenes --.

Column 20,
Line 27, "of a" should read -- of an --; and
Line 51, "calorie" should read -- calorie value --.

Column 22,
Formula 2, "$CH_2$-$(CH_2)$-$_{22}$COO-$(CH_2)$-$_{21}CH_3$" should read $$--CH_3-(CH_2)_{22}COO-(CH_2)_{21}CH_3--;$$

Line 14, "blow," should read -- below, --; and
Line 65, "weight" should read -- weight. --.

Column 23,
Line 63, "tend" should read -- tends --.

UNITED STATES PATENT AND TRADEMARK OFFICE

CERTIFICATE OF CORRECTION

PATENT NO. : 6,096,468
DATED : August 1, 2000
INVENTOR(S) : Manabu Ohno et al.

It is certified that error appears in the above-identified patent and that said Letters Patent is hereby corrected as shown below:

Column 24,
Line 63, "mertorious" should read -- meritorious --.

Column 25,
Line 6, "potions" should read -- portions --;
Line 18, "mount" should read -- amount --; and
Line 23, "hydrophobic and control" should read -- it hydrophobic and controlling --.

Column 26,
Line 18, "can not" should read -- cannot --.

Column 27,
Line 42, "used" (2nd occurrence) should be deleted.

Column 28,
Line 14, "to from" should read -- to form --; and
Line 15, "phosphate," should read -- phosphate; --.

Column 29,
Line 20, "can not" should read -- cannot --; and
Line 25, "11" should be in boldface.

Column 30,
Line 16, "times" should read -- number of times --; and
Line 61, "can not" should read -- cannot --.

Column 31,
Line 33, "can" should read -- can- --.

Column 32,
Lines 53 and 60, "gap a" should read -- gap α --.

Column 33,
Line 15, "on to" should read -- onto --; and
Line 18, "1" should be in boldface.

Column 34,
Line 39, "sequencially" should read -- sequentially --; and
Line 41, "filed" should read -- field --.

Column 35,
Line 64, "of" should be deleted and "and" (1st occurrence) should read -- or --.

UNITED STATES PATENT AND TRADEMARK OFFICE

CERTIFICATE OF CORRECTION

PATENT NO. : 6,096,468
DATED : August 1, 2000
INVENTOR(S) : Manabu Ohno et al.

It is certified that error appears in the above-identified patent and that said Letters Patent is hereby corrected as shown below:

Column 36,
Line 20, "bo so" should read -- be so --.

Column 37,
Line 39, "the the" should read -- the --.

Column 38,
Line 27, "each" should read -- to each --; and
Line 45, "beating" should read -- bearing --.

Column 39,
Line 21, "invention," should read -- invention; --.

Column 40,
Line 54, "none of" should read -- no --.

Column 41,
Lines 17 and 39, "revolution" should read -- revolutions --.

Column 42,
Line 6, "to find" should read -- and found --;
Line 13, "shaked" should read -- shaken --;
Line 21, "and put" should read -- in place --;
Line 55, "Styrene-butyl acrylate copolymer resin (glass transistion" should be deleted;
Line 56, ""temperature: 70° C.) 100 parts" should be deleted; and
TABLE, insert "Styrene-butyl acrylate copolymer resin (glass transistion temperature: 70° C.) 100 parts".

Column 43,
Line 45, "1a" should be in boldface.

Column 45,
Line 20, "and image" should read -- and little image -- and "little" should be deleted; and
Line 34, "minutes" should read -- minute --.

Column 46,
Line 2, "rerpoduced." should read -- reproduced. --; and
Line 56, "images" should read -- images. --.

UNITED STATES PATENT AND TRADEMARK OFFICE

CERTIFICATE OF CORRECTION

PATENT NO. : 6,096,468
DATED : August 1, 2000
INVENTOR(S) : Manabu Ohno et al.

It is certified that error appears in the above-identified patent and that said Letters Patent is hereby corrected as shown below:

Column 47,
Line 24, "revolution" should read -- revolutions --; and
Line 29, "reprepared" should read -- prepared --.

Column 48,
Line 1, "revolution" should read -- revolutions --.

Column 49,
Line 43, "images" should read -- image --.

Column 51,
Line 20, "images than" should read -- images rather than -- and
"plane" should read -- plain --.

Column 53,
Line 12, "width in" should read -- width is --.

Column 54,
Line 28, "Tnabel" should read -- Table --; and
Line 45, "plane" should read -- plain --.

Column 55,
TABLE 1,

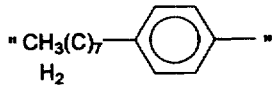

should read

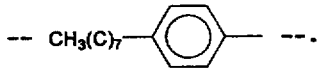

UNITED STATES PATENT AND TRADEMARK OFFICE

CERTIFICATE OF CORRECTION

PATENT NO. : 6,096,468
DATED : August 1, 2000
INVENTOR(S) : Manabu Ohno et al.

It is certified that error appears in the above-identified patent and that said Letters Patent is hereby corrected as shown below:

Column 57,
TABLE 2, "$CH_3(CH_2)$—" should read -- $CH_3(CH_2)_7$ --

Column 69,
Line 59, "to from" should read -- to form --.

Column 71,
Line 12, "$2 \leq 150$" should read -- $1 \leq 150$ --.

This certificate supercedes Certificate of Correction issued November 27, 2001.

Signed and Sealed this

Sixteenth Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,096,468
DATED : August 1, 2000
INVENTOR(S) : Manabu Ohno et al.

It is certified that error appears in the above-identified patent and that said Letters Patent is hereby corrected as shown below:

Title page,
Item [22], Date filed should read: -- June 4, 1999 --.

Signed and Sealed this

Twenty-fourth Day of September, 2002

*Attest:*

*Attesting Officer*

JAMES E. ROGAN
*Director of the United States Patent and Trademark Office*